United States Patent [19]

Morigaki et al.

[11] Patent Number: 5,047,315

[45] Date of Patent: Sep. 10, 1991

[54] SILVER HALIDE COLOR PHOTOGRAPHIC MATERIAL

[75] Inventors: Masakazu Morigaki; Osamu Takahashi, both of Kanagawa, Japan

[73] Assignee: Fuji Photo Film Co., Ltd., Kanagawa, Japan

[21] Appl. No.: 243,391

[22] Filed: Sep. 12, 1988

[30] Foreign Application Priority Data

Sep. 11, 1987 [JP] Japan ..... 62-228033

[51] Int. Cl.[5] ..... G03C 1/34; G03C 1/38

[52] U.S. Cl. ..... 430/544; 430/546; 430/551; 430/631; 430/505; 430/214; 430/382

[58] Field of Search ..... 430/551, 546, 631, 505, 430/544, 372, 377, 382, 214

[56] References Cited

U.S. PATENT DOCUMENTS

| | | | |
|---|---|---|---|
| 3,725,063 | 4/1973 | Wolfarth | 430/236 |
| 4,204,867 | 5/1980 | Kuffner et al. | 430/380 |
| 4,239,851 | 12/1980 | Aoki et al. | 430/546 |
| 4,489,155 | 12/1984 | Sakaroue et al. | 430/551 |
| 4,540,657 | 9/1985 | Krishnamurthy | 430/546 |
| 4,609,618 | 9/1986 | Sasaki et al. | 430/546 |
| 4,684,606 | 8/1987 | Krishnomurthy | 430/546 |
| 4,704,350 | 11/1987 | Morigaki et al. | 430/551 |
| 4,770,987 | 9/1988 | Takahashi et al. | 430/551 |

FOREIGN PATENT DOCUMENTS

| | | | |
|---|---|---|---|
| 0255722 | 2/1988 | European Pat. Off. . | |
| 0258662 | 3/1988 | European Pat. Off. . | |
| 280238 | 8/1988 | European Pat. Off. . | |
| 2236210 | 1/1975 | France . | |
| 0034715 | 3/1977 | Japan | 430/546 |
| 0064333 | 6/1981 | Japan | 430/546 |
| 2178260 | 8/1987 | Japan | 430/546 |
| 2242940 | 10/1987 | Japan | 430/546 |
| 2015184 | 9/1979 | United Kingdom . | |

OTHER PUBLICATIONS

Research Disclosure, No. 195, Jul. 1980, pp. 301-310, No. 19551, Havant Hampshire, GB; "Photographic Applications of Latices".

*Primary Examiner*—Charles L. Bowers, Jr.

*Assistant Examiner*—Lee C. Wright

*Attorney, Agent, or Firm*—Sughrue, Mion, Zinn, Macpeak & Seas

[57] ABSTRACT

A silver halide color photographic material comprising a support having provided thereon a photographic layer containing:

a) at least one compound capable of chemically binding with an aromatic amine developing agent or its oxidation product, which remains after color development processing, to produce a chemically inert and substantially colorless compound and b) at least one of the compounds presented by the following Formulae (I), (II) or (III):

(I)

(II)

(III)

wherein X and X' each represents a divalent to hexavalent polyvalent group; n and m each represents an integer of 2 to 6; R represents an aliphatic group; R' represents an aliphatic group or an aromatic group, provided that R or R' existing in the same molecule may be the same or different from each other; $R_1$, $R_2$, $R_3$ and $R_4$, which may be the same or different, each represents a hydrogen atom, an aliphatic group, an aromatic group, an aliphatic oxycarbonyl group, an aromatic oxycarbonyl group or a carbamoyl group, provided that the sum of the carbon atoms contained in $R_1$, $R_2$, $R_3$ and $R_4$ is 8 or more and at least one combination of $R_1$ and $R_2$, $R_3$ and $R_4$ or $R_1$ and $R_3$ may be bound to each other to form a 5- to 7-membered ring, said compound (a) and compound (b) being incorporated in the same layer or different layers.

19 Claims, No Drawings

SILVER HALIDE COLOR PHOTOGRAPHIC MATERIAL

FIELD OF THE INVENTION

This invention relates to a silver halide color photographic material and, more particularly, to an improvement of preservability of color photographic pictures finally obtained by development-processing of color photographic light sensitive materials. More particularly, it relates to a silver halide color photographic material which shows a preservability improved by preventing color stain which is generated with time after development processing.

BACKGROUND OF THE INVENTION

Silver halide color photographic materials are imagewise exposed, and development-processed with an aromatic primary amine color developing agent, with the resulting oxidation product of the developing agent in turn reacting with dye image-forming couplers (hereinafter referred to as couplers) to form dye images. In color photographic light-sensitive materials, a combination of a yellow couplers, a cyan coupler, and a magenta coupler is employed.

In order to obtain good color reproducibility, it has so far been attempted to develop couplers which can give cyan, magenta or yellow dyes with less side absorption and, at the same time, to develop highly active couplers which permit the color development to be completed within a short period of time. Further, novel additives for inducing the excellent properties of such couplers have also been developed. However, these novel properties cause a reduction in preservability of resulting color photographic pictures together with the components of the processing solution remaining in the light-sensitive materials.

Of the components of processing solutions which remain in light-sensitive materials, developing agents of aromatic primary amine compounds and compounds derived therefrom are known to spoil the fastness of resulting images when influenced by light, heat, high humidity, oxygen or the like or to change to colored substances as a result of self-coupling or reaction with co-existing components to produce so-called "stain" upon storage for a long period of time.

This color stain is most likely to take place when an aromatic amine developing agent, which remains in a light-sensitive material, and a coupler coexist, with different-color stains being formed depending upon the kind of coexisting couplers.

On the other hand, prevention of a certain stain called Y-stain has heretofore been extensively studied as one approach for preventing deterioration of color image. The term "Y-stain" as used herein means a yellow stain formed in non-colored areas (so-called white background) by light or heat, the Y-stain caused chiefly because of coloration of a decomposed product produced by decomposition of coupler. Thus, Y-stain is different from the color stain mentioned in the present invention with regard the respective mechanism of stain formation. Further, the so-called Y-stain-preventing agents, which are currently known, such as hydroquinones, hindered phenols, tocopherols, chromans, coumarans, and compounds prepared by etherifying the phenolic hydroxy groups of these compounds (for example, U.S. Pat. Nos. 3,935,016, 3,930,866, 3,700,455, 3,764,337, 3,432,300, 3,573,050, 4,254,216, British Patents 2,066,975, 1,326,889, and JP-B-51-30462 (the term "JP-B" as used herein means an "examined Japanese patent publication"), are insufficient for preventing the particular stain with which this invention is concerned. The particular color stain is different from the above Y-stain.

It has recently been proposed in, for example, U.S. Pat. Nos. 4,463,085 and 4,483,918, JP-A 59-218445 (the term "JP-A" as used herein means an "unexamined published Japanese patent application") and JP-A-59-229557, that certain amine compounds are effective for preventing stain caused during color development. These conventional compounds, however, are still not sufficient to attain the necessary improvement in preservability.

As a result of various investigations, the inventors have found those compounds which prevent color-stain by chemically bonding with i) an aromatic amine developing agent remaining after color development or ii) the oxidation product of said aromatic amine developing agent.

However, with the rapid progress of the art, desire for prevention of color stain (even when stored for a longer time than before) becomes strong in view of the recording feature of color photographic pictures.

In addition, even the generation of even a slight amount of color-stain is visually conspicuous with some kind of staining colors, and color turbidity, which is a fatal defect for color photographic pictures, takes place even in image areas.

SUMMARY OF THE INVENTION

It is, therefore, a primary object of the present invention to provide a silver halide color photographic light-sensitive material having improved preservability by preventing formation over time of color-stain after development processing.

Another object of the present invention is to provide a silver halide color photographic material which does not suffer side effects such as generation of color-stain due to remaining aromatic amine developing agent even when processed with a running-state processing solution, a washing solution containing a slight amount of water, a processing solution containing no water (stabilizing solution), a substantially benzyl alcohol-free color developer, or a processing solution imposing a load on color development.

A further object of the present invention is to provide a silver halide color photographic material which, even when stored for a long time, can substantially depress generation of color stain without decreasing maximum coloration density of dye image.

In further intensive investigations, the inventors have found that the objects of the present invention can be attained by a light-sensitive material combining:

a) a compound capable of chemically bonding with an amine type developing agent or its oxidation product after development processing and b) a specific high-boiling organic solvent.

That is, the various objects of the present invention have been found to be attained by incorporating, in a photographic layer or layers provided on a support, a) at least one compound capable of chemically bonding with remaining aromatic amine type developing agent or its oxidation product (which remains after color development processing) to produce a chemically inert and substantially colorless compound and b) at least one compound represented by the following Formulae (I), (II) or (III):

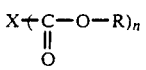

(I)

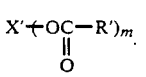

(II)

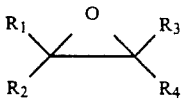

(III)

wherein X and X' each represents a divalent to hexavalent polyvalent group; n and m each represents an integer of 2 to 6; R represents an aliphatic group; R' represents an aliphatic group or an aromatic group, provided that R and R' existing in the same molecule may be the same or different from each other, $R_1$, $R_2$, $R_3$ and $R_4$, which may be the same or different, each represents a hydrogen atom, an aliphatic group, an aromatic group, an aliphatic oxycarbonyl group, an aromatic oxycarbonyl group or a carbamoyl group, provided that the sum of the carbon atoms in $R_1$, $R_2$, $R_3$ and $R_4$ is 8 or more and at least one combination of $R_1$ and $R_2$, $R_3$ and $R_4$, or $R_1$ and $R_3$ may be bound to each other to form a 5- to 7-membered ring, said compound (a) and compound (b) being incorporated in the same layer or different layers.

DETAILED DESCRIPTION OF THE INVENTION

The aromatic amine type developing agents to be used in the present invention include aromatic primary, secondary and tertiary amine compounds. More specifically, phenylenediamine type compounds and aminophenol type compounds are included. Typical examples thereof include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, 4-methyl-2-amino-N,N-diethylaniline, 4-methyl-2-amino-N-ethyl-N-β-methanesulfonamidoethylaniline, 2-amino-N-ethyl-N-β-hydroxyethylaniline, 3-methyl-4-methylamino-N-ethyl-N-β-hydroxyethylaniline, 3-methyl-4-dimethylamino-N-ethyl-N-β-methanesulfonamidoethylaniline, 3-methyl-4-butylamino-N,N-diethylaniline, 3-methyl-4-acetylamino-N-ethyl-N-β-hydroxyethylaniline, 3-methyl-4-methanesulfonamido-N-ethyl-N-β-methanesulfonamidoethylaniline, 3-methyl-4-benzylamino-N-ethyl-N-β-methanesulfonamidoethylaniline, 3-methyl-4-cyclohexylamino-N-ethyl-N-methylaniline, sulfates, hydrochlorides, phosphates, p-toluenesulfonates, tetraphenyl borates or p-(t-octyl)benzenesulfonates thereof, o-aminophenol, p-aminophenol, 4-amino-2-methylphenol, 2-amino-3-methylphenol and 2-hydroxy-3-amino-1,4-dimethylbenzene.

In addition, examples of usable developing agents described in, for example, L. F. A. Mason; "Photographic Processing Chemistry", (Focal Press), pp. 226 to 229, U.S. Pat. Nos. 2,193,015 and 2,592,364, and JP-A-48-64933.

On the other hand, the oxidation products of aromatic amine type developing agents include oxidation products which are formed by removing one or two electrons from the above-described developing agents and those which are formed by further releasing $H^{\oplus}$.

As preferred examples of the compound capable of chemically bonding with an aromatic amine developing agent after color development processing to form a chemically inert and substantially colorless compound, there are illustrated those which are represented by the following Formulae (IV) or (V):

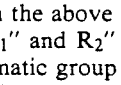

Formula (IV)

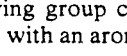

Formula (V)

In the above formulae, $R_1''$ and $R_2''$ each represents an aliphatic group, an aromatic group or heterocyclic group; X'' represents a leaving group capable of being eliminated upon reaction with an aromatic amine developing agent; A represents a group capable of reacting with an aromatic amine developing agent to form a chemical bond; n represents 1 or 0; B represents a hydrogen atom, an aliphatic group, an aromatic group, a heterocyclic group, an acyl group or a sulfonyl group and Y represents a group which accelerates addition of an aromatic amine developing agent to a compound of Formula (V).

$R_1''$ and X'', or Y and $R_2''$, or Y and B may be bound to each other to form a cyclic structure.

However, the compounds represented by the Formulae (IV) and (V) are compounds which have a secondary rate constant of reaction with p-anisidine; $K_5$ (80° C.), of 1.0 liter/mol·sec to $1\times10^{-5}$ liter/mol sec measured according to the method described in EP 258662 A2, hereinafter referred to simply as "secondary rate constant of reaction".

On the other hand, as preferred examples of the compound capable of chemically bonding with an oxidation product of an aromatic amine developing agent to form a substantially colorless compound, there are illustrated those which are represented by the Formula (VI):

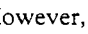

Formula (VI)

In the above Formula (VI), J represents an aliphatic group, aromatic group or heterocyclic group; and Z represents a nucleophilic group or a group capable of being decomposed in a light-sensitive material to release a nucleophilic group, provided that Z is a nucleophilic functional group or a group derived therefrom having a Pearson's nucleophilic $nCH_3I$ value (R. G. Pearson et al., J. Am. Chem. Soc., 90, 319 (1968)) of 5 or more.

Individual groups in the compounds represented by Formulae (IV), (V) and (VI) are described in more detail below.

The term, "aliphatic group" mentioned with respect to $R_1''$, $R_2''$, B and J means a straight, branched or cyclic alkyl, alkenyl or alkynyl group, which may optionally be further substituted by a substituent or substituents. The term "aromatic group" mentioned with respect to $R_1''$, $R_2''$, B and J means either a carbocyclic aromatic group (for example, phenyl or naphthyl) or a heterocyclic aromatic group (for example, furyl, thienyl, pyrazolyl, pyridyl or indolyl), which heterocyclic aromatic group may be a monocyclic system or a fused system (for example, benzofuryl or phenanthridinyl). Further, these aromatic rings may have a substituent or substituents.

The heterocyclic group represented by $R_1''$, $R_2''$, B or J is preferably a 3- to 10-membered cyclic structure constituted by carbon atom, oxygen atom, nitrogen atom, sulfur atom and/or hydrogen atom, with the hetero ring itself being either a saturated ring or an unsaturated ring and optionally being substituted by a substituent or substituents (for example, chromanyl, pyrrolidyl, pyrrolinyl or morpholinyl).

X'' in Formula (IV) represents a leaving group capable of being eliminated upon reaction with an aromatic amine developing agent to eliminate, and is preferably a group bound to A through an oxygen atom, a sulfur atom or a nitrogen atom (for example, 3-pyrazolyloxy, 3H-1,2,4-oxadiazolin-5-oxy, aryloxy, alkoxy, alkylthio, arylthio or substituted N-oxy) or a halogen atom.

A in Formula (IV) represents a group capable of reacting with an aromatic amine developing agent to form a chemical bond and containing a group containing a low-electron-density atom (for example,

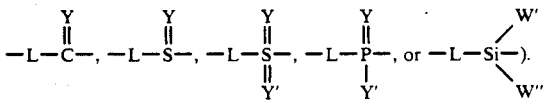

When X'' represents a halogen atom, n represents 0. In the above formulae, L represents a single bond, an alkylene group, —O—, —S—,

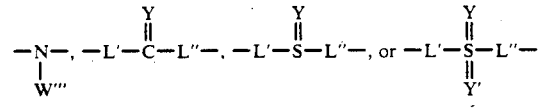

(for example, carbonyl, sulfonyl, sulfinyl, oxycarbonyl, phosphonyl, thiocarbonyl, aminocarbonyl or silyloxy).

Y and Y' both represent a group which accelerates addition of an aromatic amine developing agent to a compound of Formula (VI).

W' and W'', which may be the same or different, each represents —L'''—$R_0$, wherein $R_0$ is the same as defined for $R_1$. W''' represents a hydrogen atom, an aliphatic group (e.g., methyl, isobutyl, t-butyl, vinyl, benzyl, octadecyl or cyclohexyl), an aromatic group (for example, phenyl, pyridyl or naphthyl), a heterocyclic group (for example, piperidinyl, pyranyl, furanyl or chromanyl), an acyl group (for example, acetyl or benzoyl) or a sulfonyl group (for example, methanesulfonyl or benzensulfonyl).

L', L'' and L''' each represents —O—, —S—, or

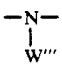

A preferably represents a divalent group represented by

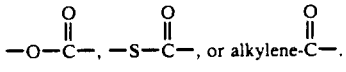

Of the compounds represented by Formula (IV), those which are represented by Formula (IV-a), (IV-b), (IV-c) or (IV-d) and which have a secondary rate constant of reaction with p-anisidine, $k_z$ (80° C.), of $1\times10^{-1}$ liter/mol·sec to $1\times10^{-5}$ liter/mol·sec are more preferable.

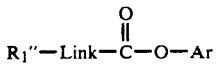

(IV-a)

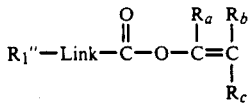

(IV-b)

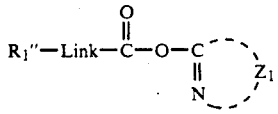

(IV-c)

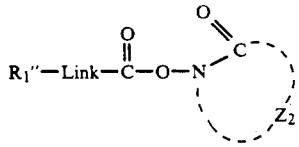

(IV-d)

In the above Formulae, $R_1''$ is the same as defined for $R_1''$ in the general formula (IV), "Link" represents a single bond or —O—, and Ar represents an aromatic group.

$R_a$, $R_b$ and $R_c$, which may be the same or different, each represents a hydrogen atom, an aliphatic group, an aromatic group, a heterocyclic group, an alkoxy group, an aryloxy group, a heterocyclic oxy group, a carboxyl group, an alkylthio group, an arylthio group, a heterocyclic thio group, an amino group, an alkylamino group, an acyl group, an amino group, a sulfonamido group, an acyl group, a sulfonyl group, an alkoxycarbonyl group, a sulfo group, a hydroxy group, an acyloxy group, a ureido group, a urethane group, a carbamoyl group or a sulfamoyl group, provided that $R_a$ and $R_b$, or $R_b$ and $R_c$ may be bound to each other to form a 5- to 7-membered heterocyclic group which may optionally be further substituted by a substituent or substituents or may optionally form, for example, a spiro ring or a bicyclo ring or may be fused with an aromatic ring. $Z_1$ and $Z_2$ both represent non-metallic atoms necessary for forming a 5- to 7-membered hetero ring which may optionally be further substituted by a substituent or substituents or may optionally form, for example, a spiro ring or a bicyclo ring or may be fused with an aromatic ring.

Particularly with compounds represented by Formula (IV-a) (as compared with compounds represented by Formulae (IV-a) to (IV-d)), when Ar represents a carbocyclic aromatic group, adjustment of the secondary rate constant of reaction with anisidine, $k_z$ (80° C.), to between $1\times10^{-1}$ liter/mol·sec to $1\times10^{-5}$ liter/mol·sec is attained by properly selecting substituents. In this case, the sum of the Hammett's $\sigma$ values of the substituents is preferably 0.2 or more, more preferably 0.4 or more, most preferably 0.6 or more, though depending upon the kind of $R_1$.

In the case of adding the compounds represented by Formulae (IV-a) to (IV-d) upon preparation of light-sensitive materials, those compounds which contain a total of 13 or more carbon atoms are preferable, with compounds having more carbon atoms being more preferable than those having fewer.

Those compounds which are to be decomposed upon development processing are not preferable for attaining the objects of the present invention.

Y in Formula (V) preferably represents an oxygen atom, a sulfur atom, =N—$R_4''$ or

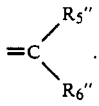

In the above formulae, $R_4''$, $R_5''$ and $R_6''$ each represents a hydrogen atom, an aliphatic group (for example, methyl, isopropyl, t-butyl, vinyl, benzyl, octadecyl or cyclohexyl), an aromatic group (for example, phenyl, pyridyl or naphthyl), a heterocyclic group (for example, piperidyl, pyranyl, furanyl or chromanyl), an acyl group (for example, acetyl or benzoyl), or a sulfonyl group (for example, methanesulfonyl or benzenesulfonyl), or $R_5''$ and $R_6''$ may be bound to each other to form a cyclic structure.

Z in Formula (VI) represents a nucleophilic group or a group capable of being decomposed in a light-sensitive material to release a nucleophilic group. For example, nucleophilic groups wherein the atom to be directly chemically bound to an oxidation product of an aromatic amine developing agent is an oxygen atom, a sulfur atom or a nitrogen atom (for example, a benzenesulfinyl group or a primary amine) are preferable as the nucleophilic groups.

Of the compounds represented by Formula (VI), those represented by the following Formula (VI-a) are more preferable:

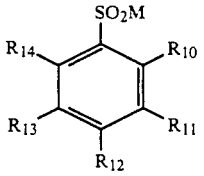

(VI-a)

In the above formula, M represents an atom or atoms forming an inorganic salt (for example, Li, Na, K, Ca or Mg) or an organic salt (for example, triethylamine, methylamine or ammonia),

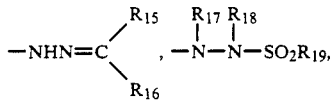

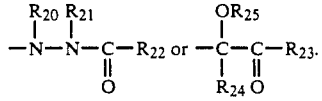

In the above formulae, $R_{15}$ and $R_{16}$, which may be the same or different, each represents a hydrogen atom, an aliphatic group, an aromatic group or a heterocyclic group. $R_{15}$ and $R_{16}$ may be bound to each other to form a 5- to 7-membered ring. $R_{17}$, $R_{18}$, $R_{20}$ and $R_{21}$, which may be the same or different, each represents a hydrogen atom, an aliphatic group, an aromatic group, a heterocyclic group, an acyl group, an alkoxycarbonyl group, a sulfonyl group, a ureido group or a urethane group, provided that at least one of $R_{17}$ and $R_{18}$ and at least one of $R_{20}$ and $R_{21}$ represent a hydrogen atom. $R_{19}$ and $R_{22}$ each represents a hydrogen atom, an aliphatic group, an aromatic group or a heterocyclic group. $R_{19}$ can further represent an alkylamino group, an arylamino group, an alkoxy group, an aryloxy group, an acyl group, an alkoxycarbonyl group or an aryloxycarbonyl group. At least two of $R_{17}$, $R_{18}$ and $R_{19}$ may be bound to each other to form a 5- to 7-membered ring, and at least two of $R_{20}$, $R_{21}$ and $R_{22}$ may be bound to each other to form a 5- to 7-membered ring. $R_{23}$ represents a hydrogen atom, an aliphatic group, an aromatic group or a heterocyclic group, and $R_{24}$ represents a hydrogen atom, an aliphatic group, an aromatic group, a halogen atom, an acyloxy group of a sulfonyl group. $R_{25}$ represents a hydrogen atom or a hydrolyzable group.

$R_{10}$, $R_{11}$, $R_{12}$, $R_{13}$ and $R_{14}$, which may be the same or different, each represents a hydrogen atom, an aliphatic group (for example, methyl, isopropyl, t-butyl, vinyl, benzyl, octadecyl, or cyclohexyl), an aromatic group (for example, phenyl, pyridyl or naphthl), a heterocyclic group (for example, piperidyl, pyranyl, furanyl or chromanyl), a halogen atom (for example, chlorine or bromine), —$SR_{26}$, —$OR_{26}$,

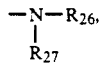

an acyl group (for example, acetyl or benzoyl), an alkoxycarbonyl group (for example, methoxycarbonyl, butoxycarbonyl, cyclohexylcarbonyl or octyloxycabonyl), an aryloxycarbonyl group (for example, phenyloxycarbonyl or naphthyloxycarbonyl), a sulfonyl group (for example, methanesulfonyl or benzenesulfonyl), a sulfonamido group (for example, methanesulfonamido or benzenesulfonamido), a sulfamoyl group, an ureido group, an urethane group, a carbamoyl group, a sulfo group, a carboxyl group, a nitro group, a cyano group, an alkoxalyl group (for example, methoxalyl, isobutyoxalyl, octyloxalyl or benzoyloxalyl), an aryloxalyl group (for example, phenoxalyl or naphthoxalyl), a sulfonyloxy group (for example, methanesulfonyloxy or benzenesulfonyloxy), —$P(R_{26})_2$,

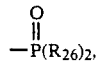

—$P(OR_{26})_2$, or a formyl group. In the above formulae, $R_{26}$ and $R_{27}$ each represents a hydrogen atom, an aliphatic group, an alkoxy group or an aromatic group. Of these, those which have the sum of the Hammett's $\sigma$ values of 0.5 or more for —$SO_2M$ are preferable in view of the advantage of the present invention.

Of compounds represented by Formulae (IV) to (VI), compounds of Formulae (IV) and (VI) are preferable.

Compounds represented by Formulae (IV) to (VI) may be used alone or in combination. In view of the advantage of the present invention, it is preferred to combine use of a compound represented by Formula (IV) with a compound represented by the Formula (VI), combine use of a compound represented by Formula (IV) with a compound represented by Formula (V), and combine use of a compound represented by Formula (VI) with a compound represented by Formula (IV) or (V).

Typical examples of these compounds are illustrated below. However, the present invention is not to be limited thereto.

(IV-1)
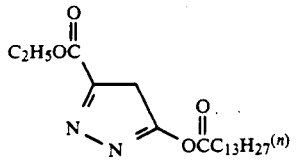
(IV-2)
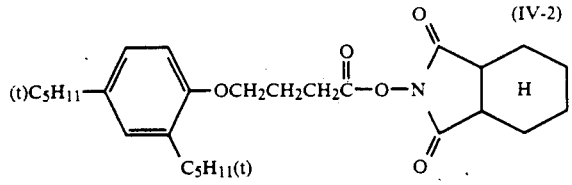
(IV-3)
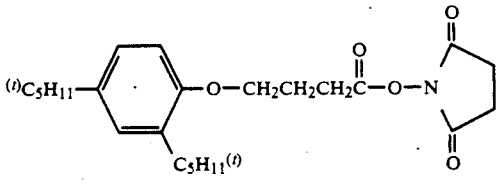
(IV-4)
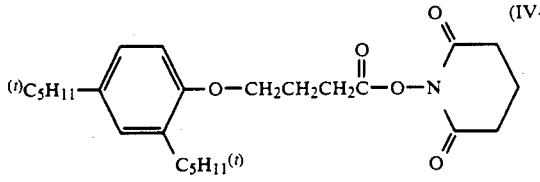
(IV-5)
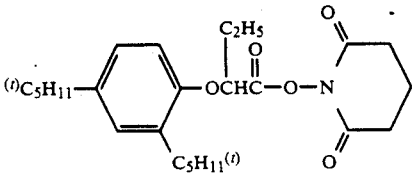
(IV-6)
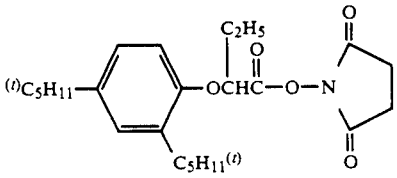
(IV-7)
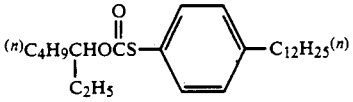
(IV-8)
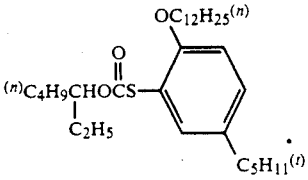
(IV-9)
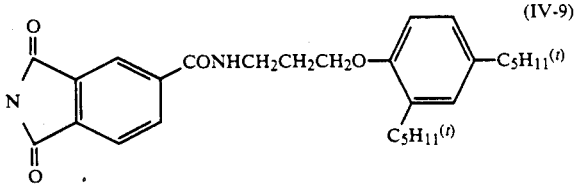
(IV-10)
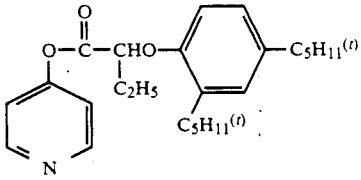
(IV-11)
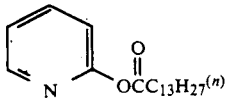
(IV-12)
$^{(n)}C_{18}H_{37}I$
(IV-13)
$^{(n)}C_{18}H_{37}Br$
(IV-14)
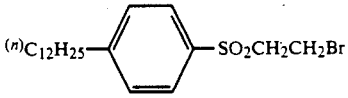
(IV-15)
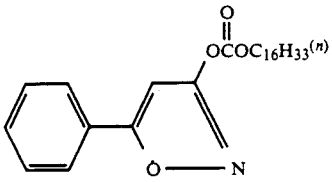
(IV-16)
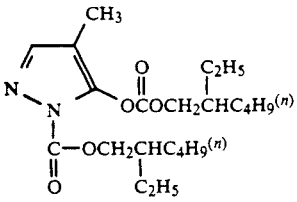
(IV-17)
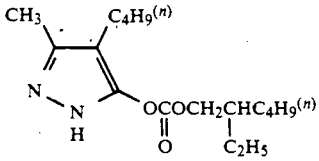

-continued
(IV-18)
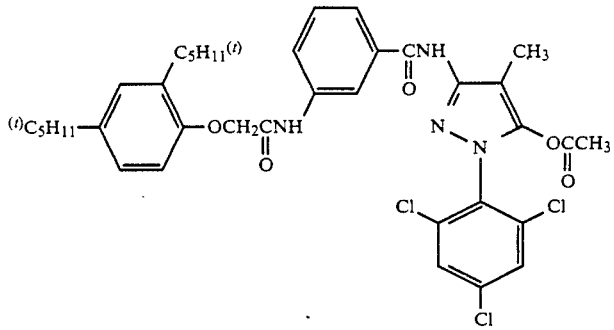
(IV-19)
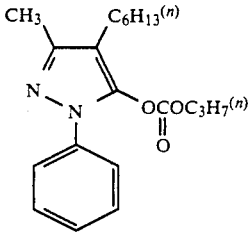
(IV-20)
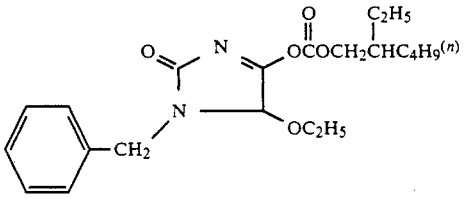
(IV-21)
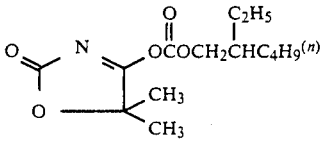
(IV-22)
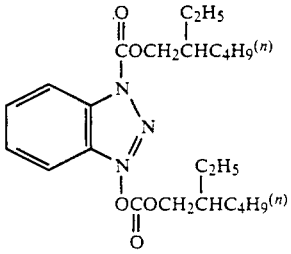
(IV-23)
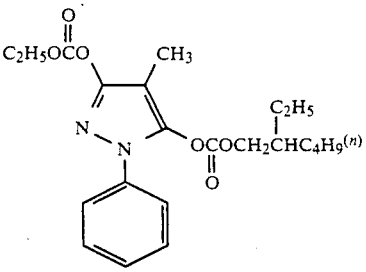
(IV-24)
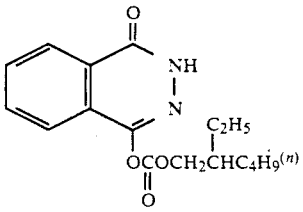
(IV-25)
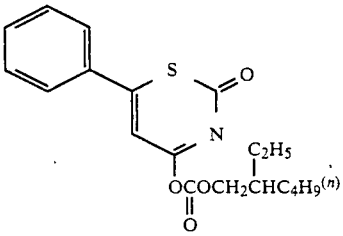
(IV-26)
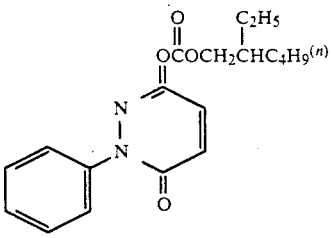
(IV-27)
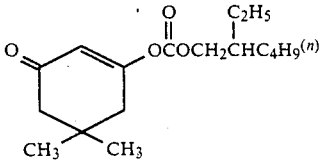
(IV-28)
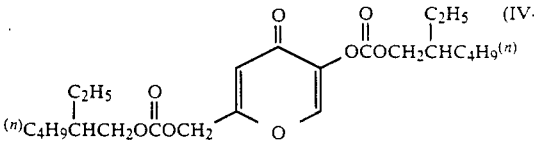

-continued
(IV-29)
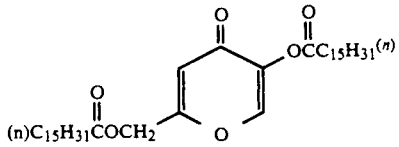
(IV-30)
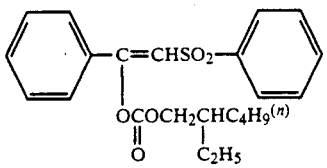
(IV-31)
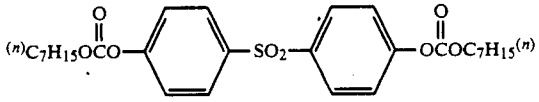
(IV-32)
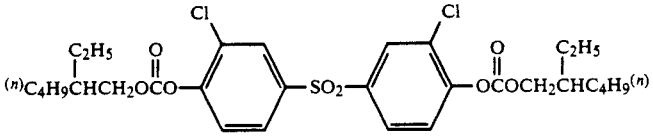
(IV-33)
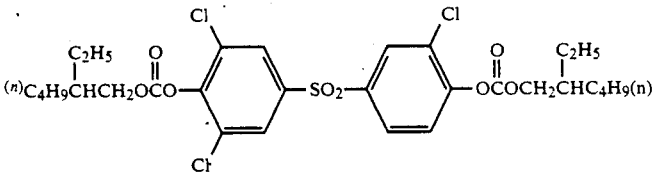
(IV-34)
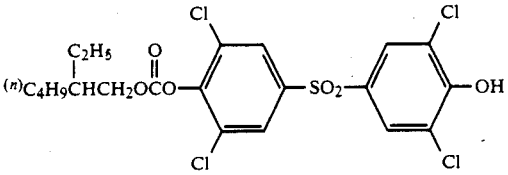
(IV-35)
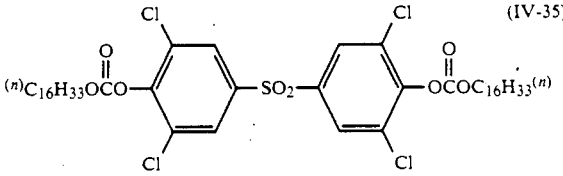
(IV-36)
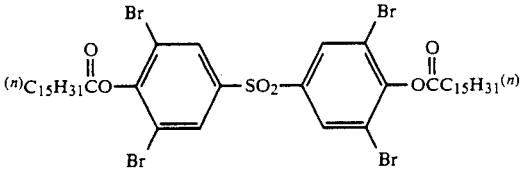
(IV-37)
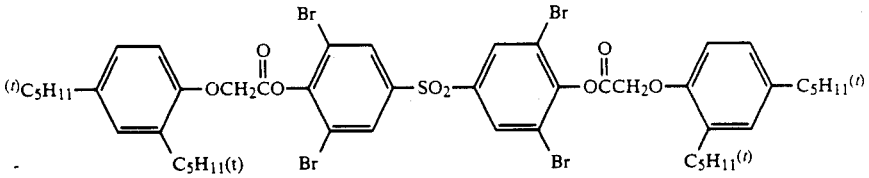
(IV-38)
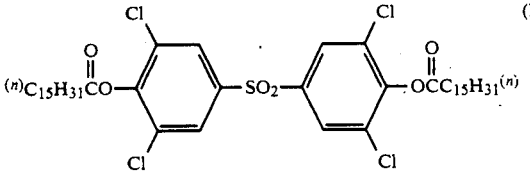
(IV-39)
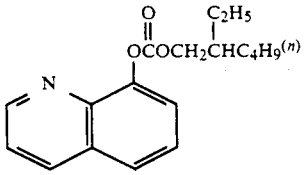
(IV-40)
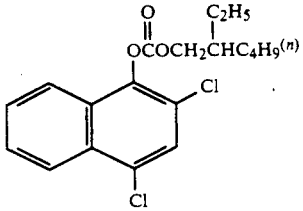
(IV-41)
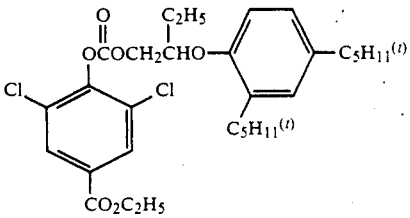

-continued
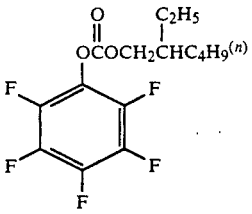
(IV-42)
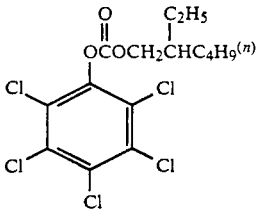
(IV-43)
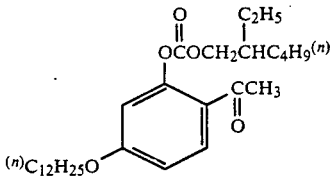
(IV-44)
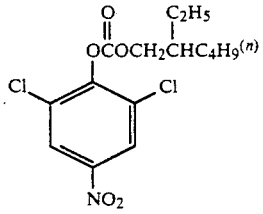
(IV-45)
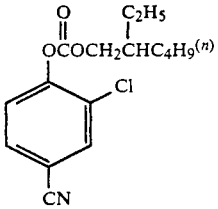
(IV-46)
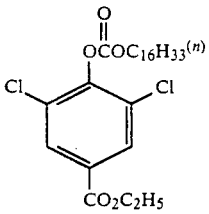
(IV-47)
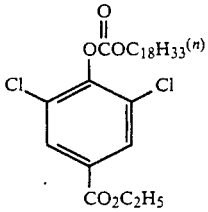
(IV-48)
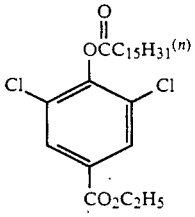
(IV-49)
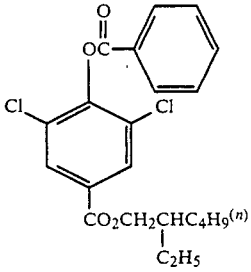
(IV-50)
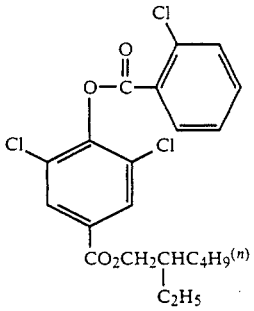
(IV-51)
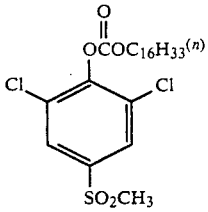
(IV-52)
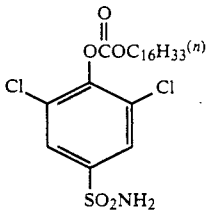
(IV-53)
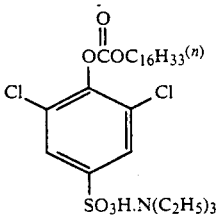
(IV-54)
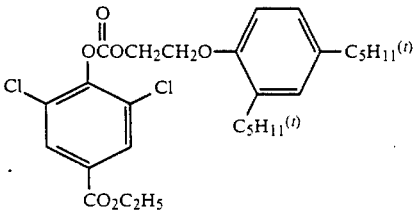
(IV-55)

-continued
(IV-56)
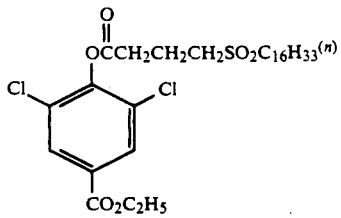
(IV-57)
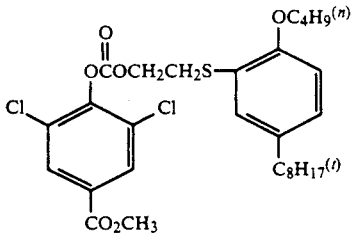
(IV-58)
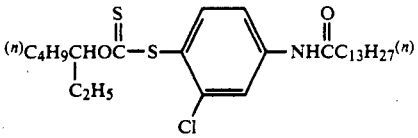
(IV-59)
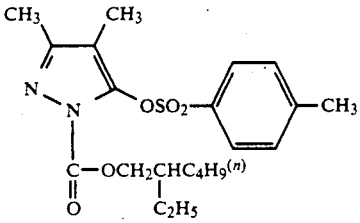
(IV-60)
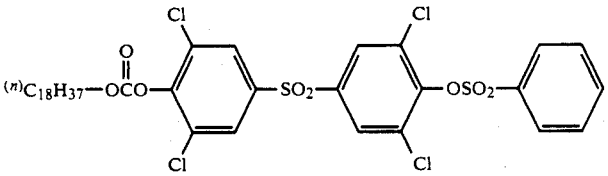
(IV-61)
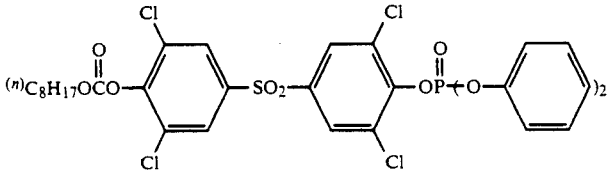
(IV-62)
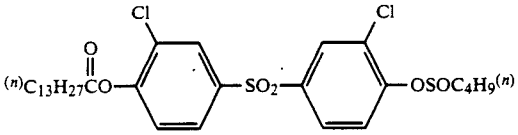
(IV-63)
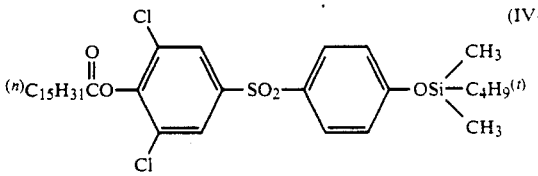
(IV-64)
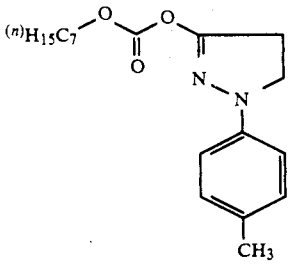
(IV-65)
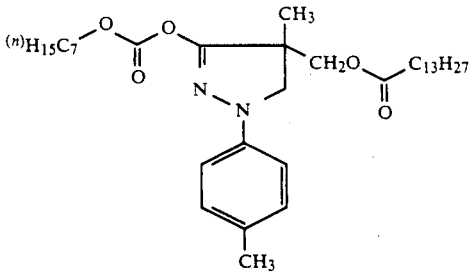
(IV-67)
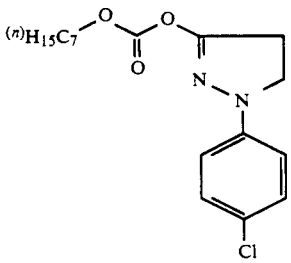
(IV-68)
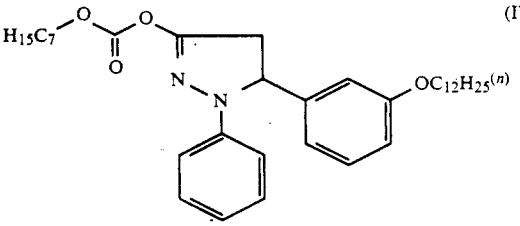

-continued
(IV-69)
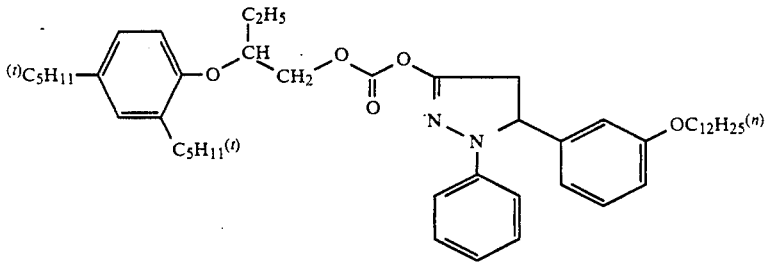
(IV-70)
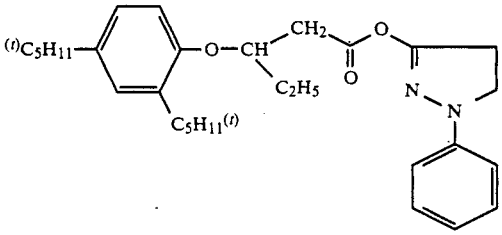
(IV-71)
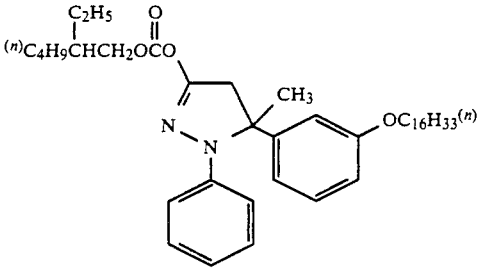
(IV-72)
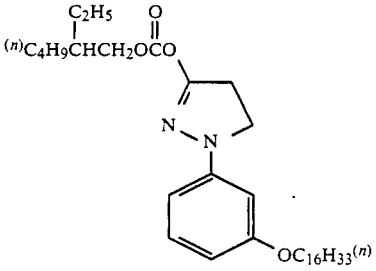
(IV-73)
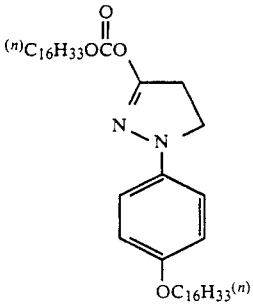
(IV-74)
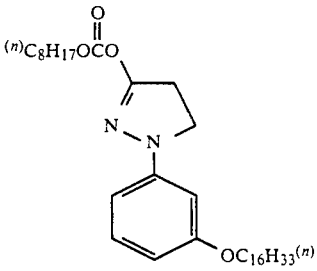
(IV-75)
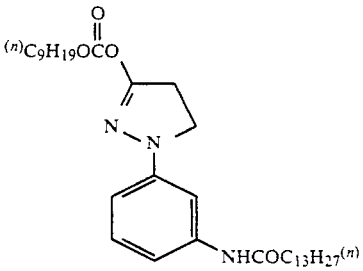
(IV-76)
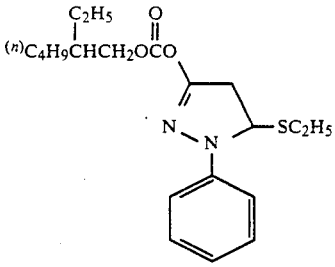
(IV-77)
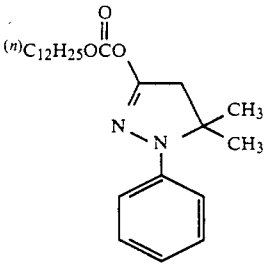
(IV-78)
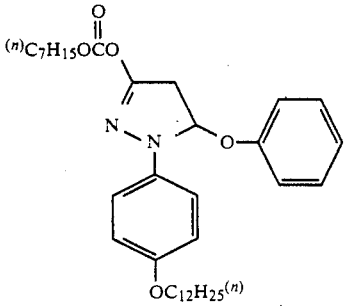
(IV-79)
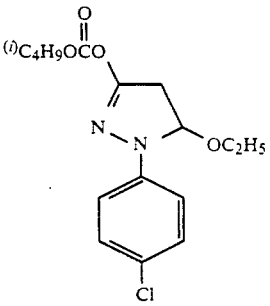

-continued
(IV-80)
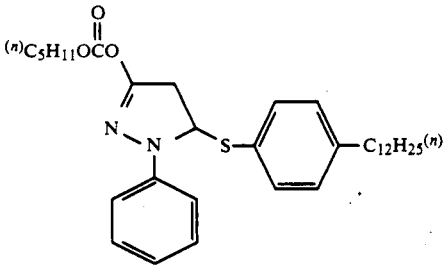
(IV-81)
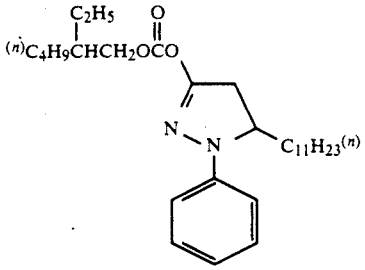
(IV-82)
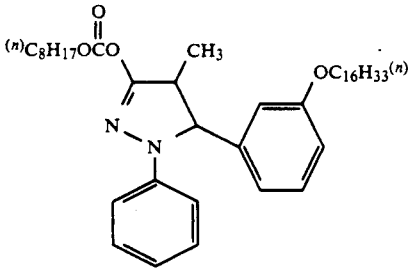
(IV-83)
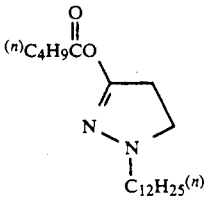
(IV-84)
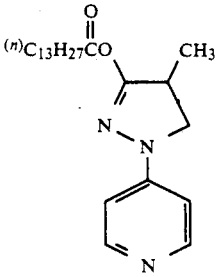
(IV-85)
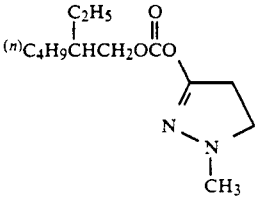
(IV-86)
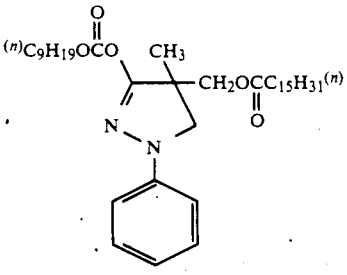
(IV-87)
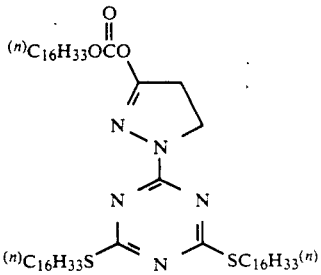
(IV-88)
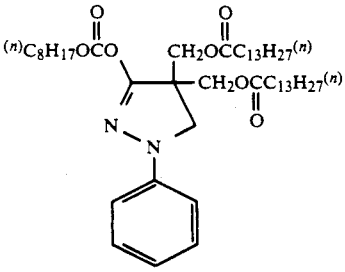
(IV-89)
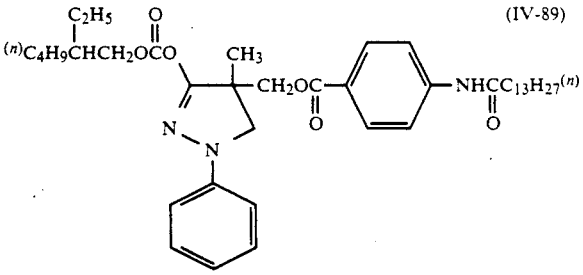
(IV-90)
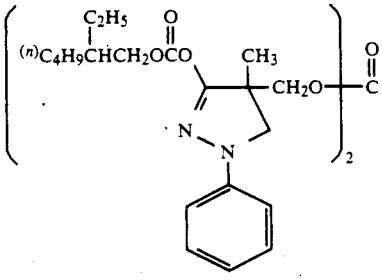
(IV-91)
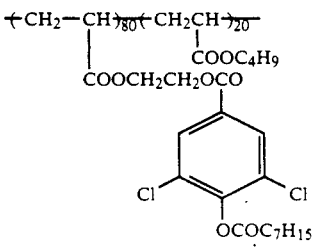

-continued
(IV-92)
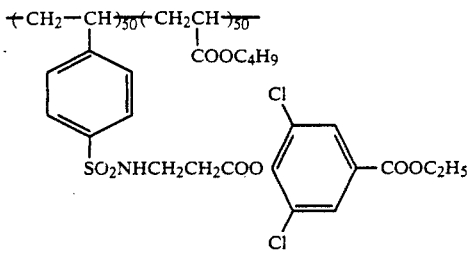
(IV-93)
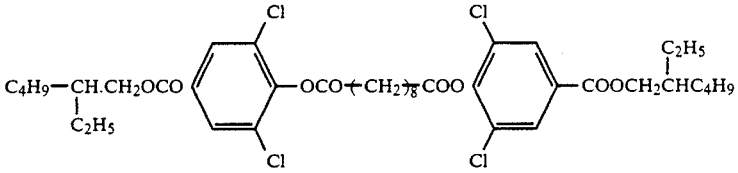
(IV-94)
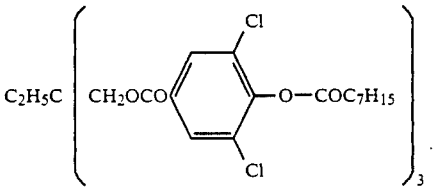
(V-1)
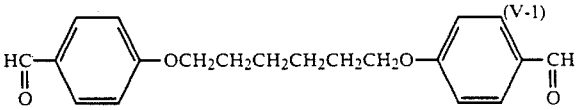
(V-2)
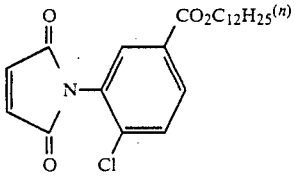
(V-3)
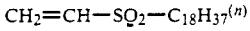
(V-4)
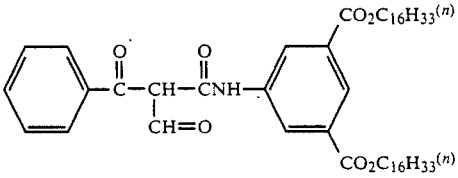
(V-5)
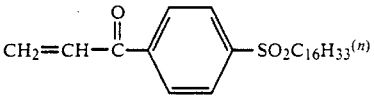
(VI-1)
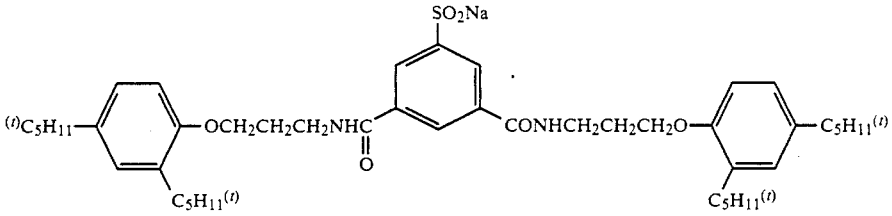
(VI-2)
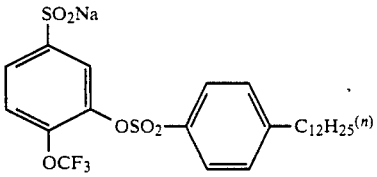
(VI-3)
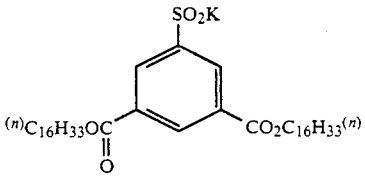
(VI-4)
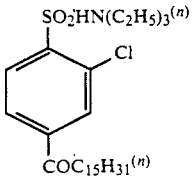
(VI-5)
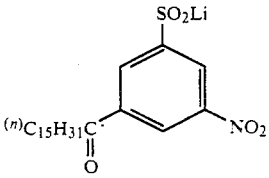

-continued
(VI-6)
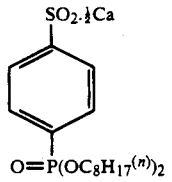
(VI-7)
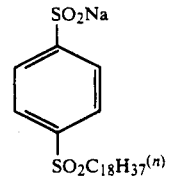
(VI-8)
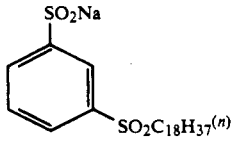
(VI-9)
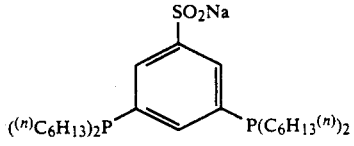
(VI-10)
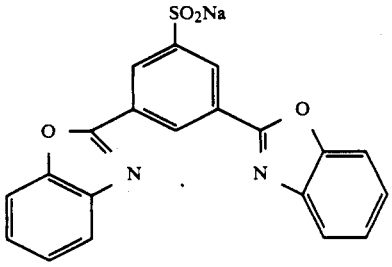
(VI-11)
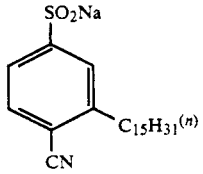
(VI-12)
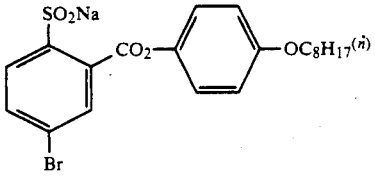
(VI-13)
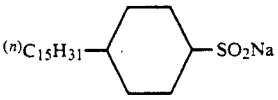
(VI-14)
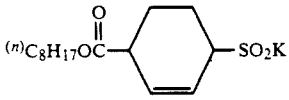
(VI-15)
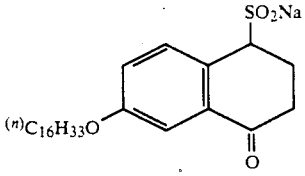
(VI-16)
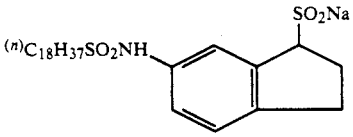
(VI-17)
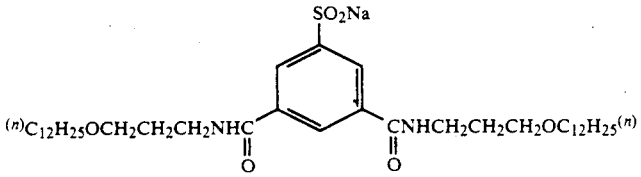
(VI-18)
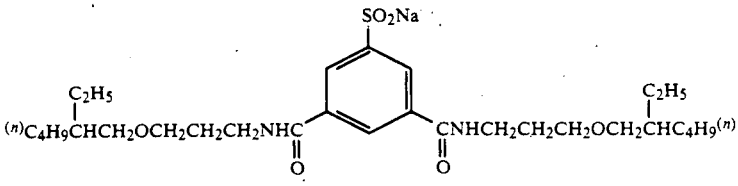
(VI-19)
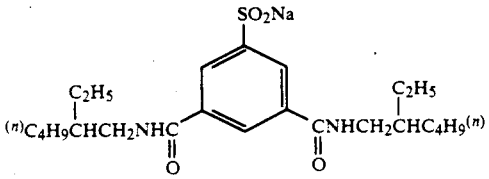
(VI-20)
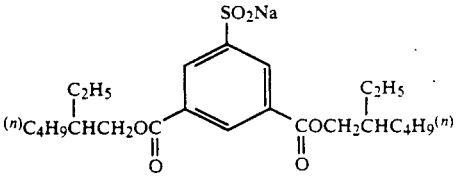

-continued
(VI-22)
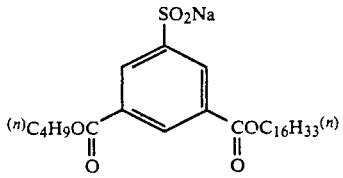
(VI-23)
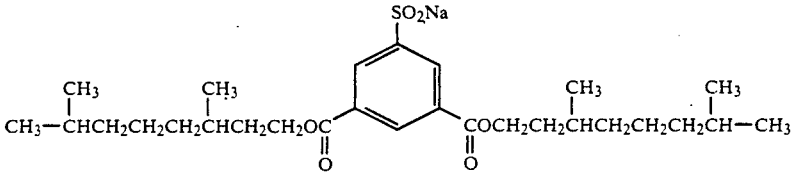
(VI-24)
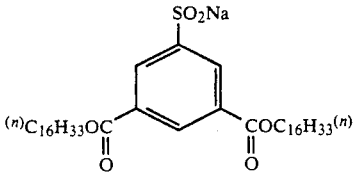
(VI-25)
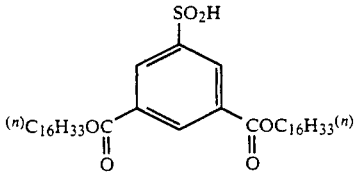
(VI-26)
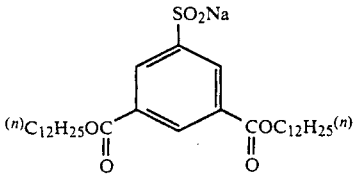
(VI-27)
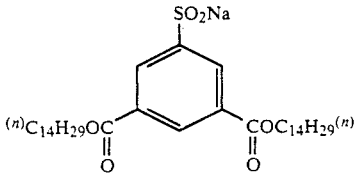
(VI-28)
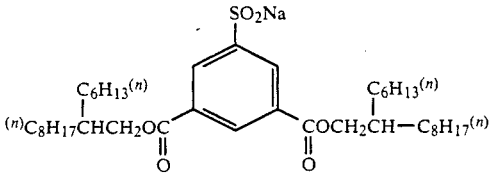
(VI-29)
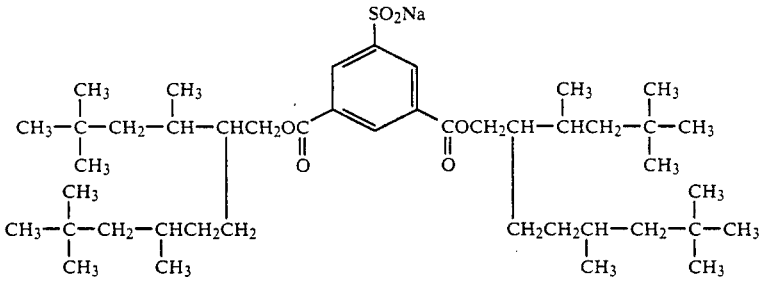
(VI-30)
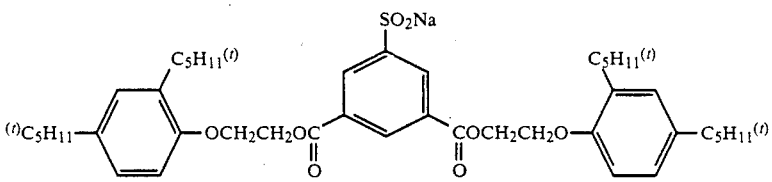
(VI-31)
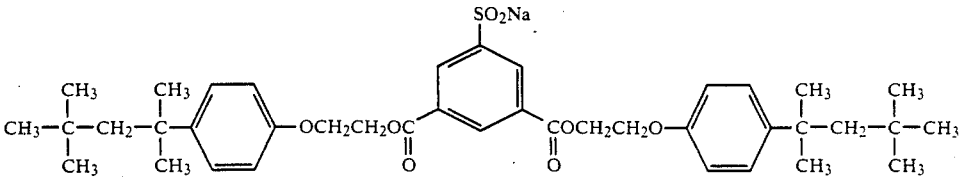

-continued
(VI-32)
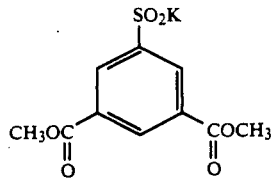
(VI-33)
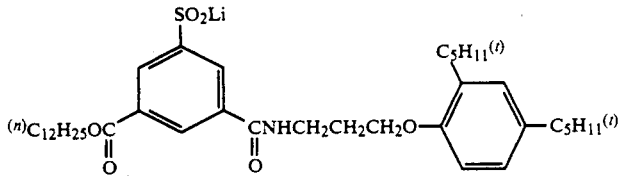
(VI-34)
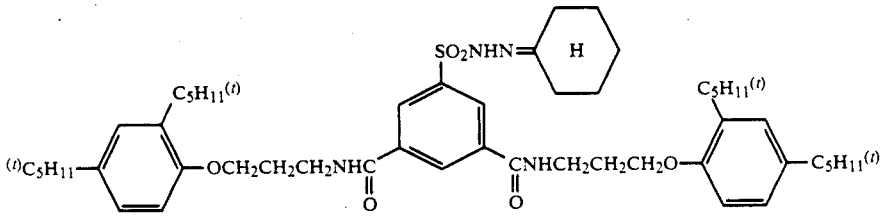
(VI-35)
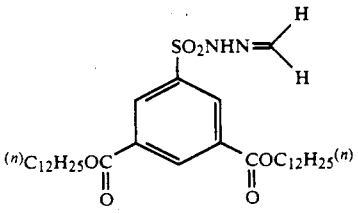
(VI-36)
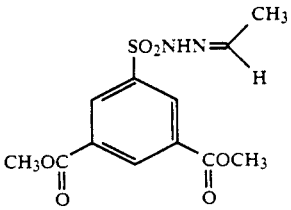
(VI-37)
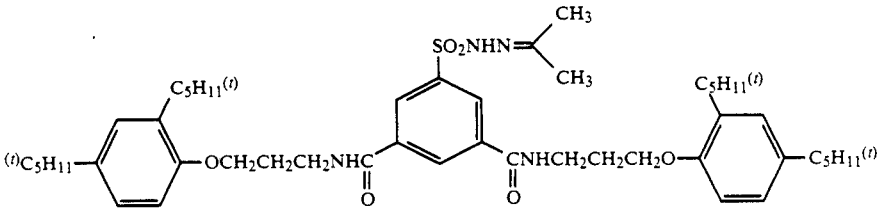
(VI-38)
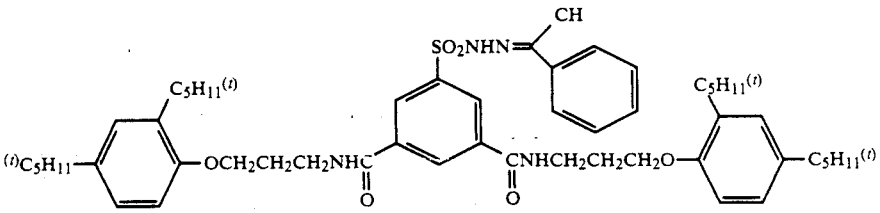
(VI-39).
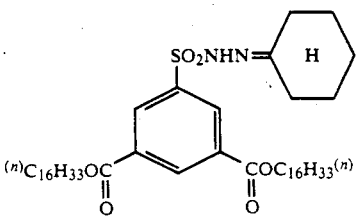

-continued
(VI-40)
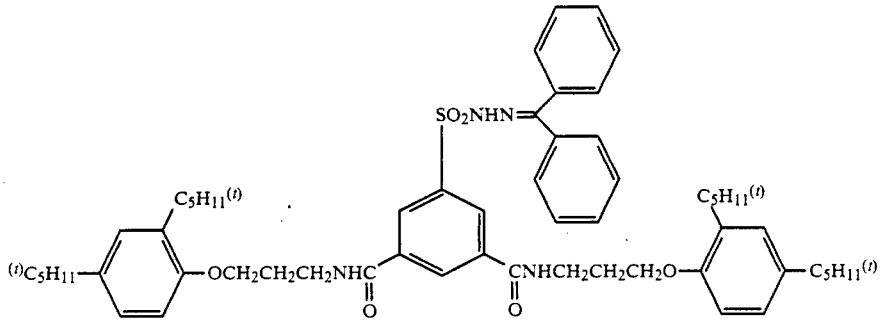
(VI-41)
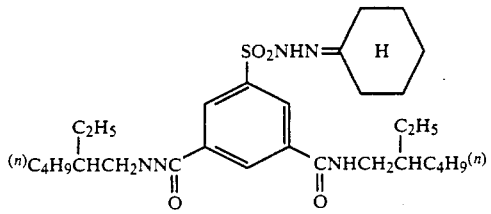
(VI-42)
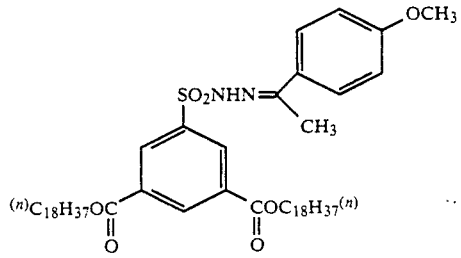
(VI-43)
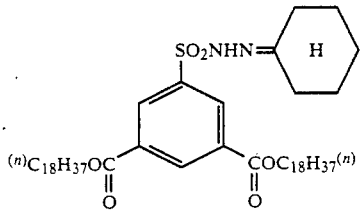
(VI-44)
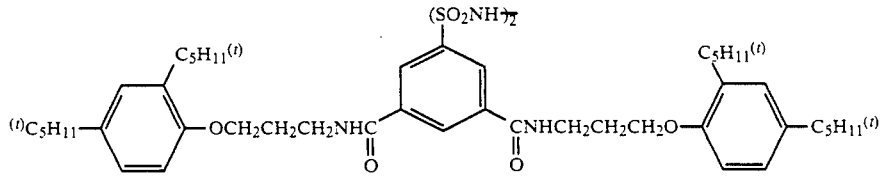
(VI-45)
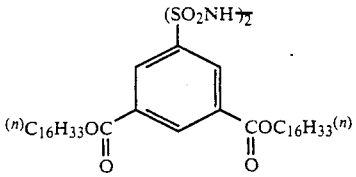
(VI-46)
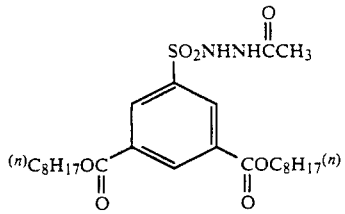
(VI-47)
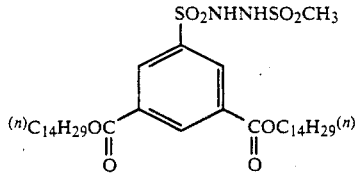
(VI-48)
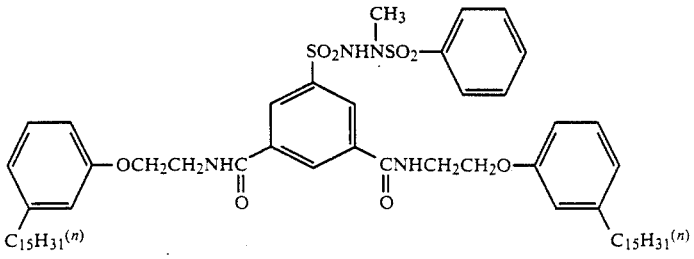

-continued
(VI-49)
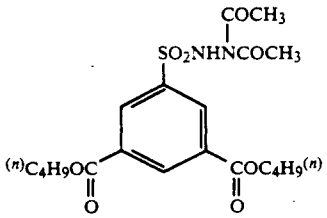
(VI-50)
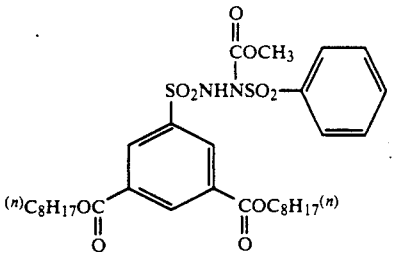
(VI-51)
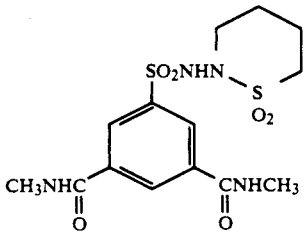
(VI-52)
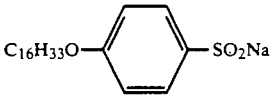
(VI-53)
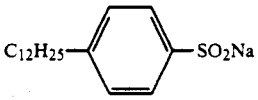
(VI-54)
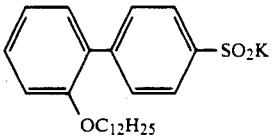
(VI-55)
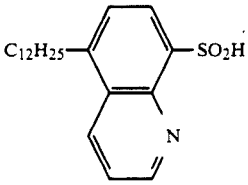
(VI-56)
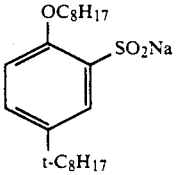
(VI-57)
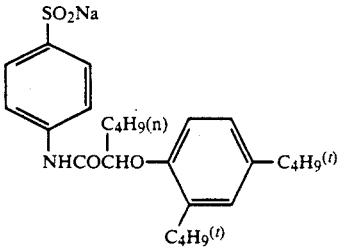
(VI-58)
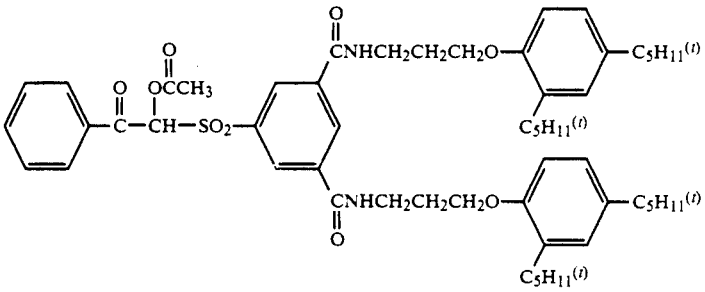
(VI-59)
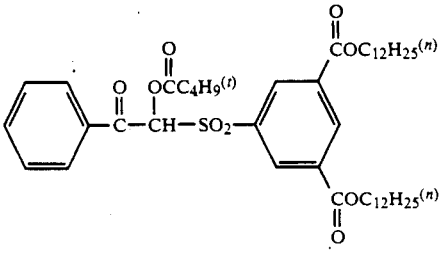
(VI-60)
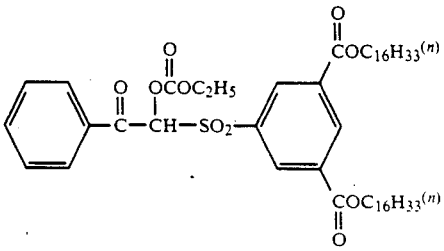

-continued (VI-61)

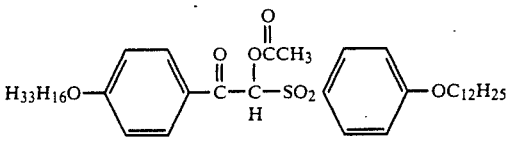

(VI-62)

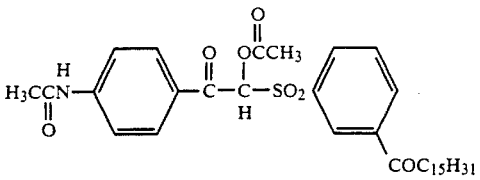

(VI-63)

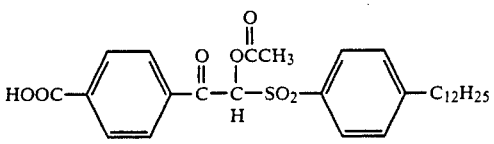

(VI-64)

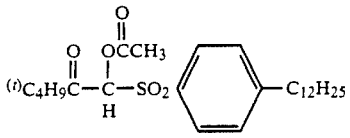

(VI-65)

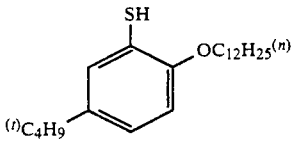

(VI-66)

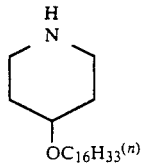

These above-illustrated compounds may be synthesized according to the processes described in EP 230048A$_2$ EP 255722A$_2$, EP 258662A$_2$, JP-A-62-229145 and Japanese Patent Application No. 61-23467 or analogous processes.

Examples of synthesis of typical compounds of the present invention are set forth below.

SYNTHESIS EXAMPLE 1

Synthesis of Compound IV-7

Synthesis of 2-ethylhexyl-4-dodecylbenzenethiocarbonate (above-mentioned Compound IV-7)

150 ml of chloroform and 9.9 mol (0.071 mol) of triethylamine were added and dissolved in 18 g (0.065 mol) of 4-dodecylbenzenethiol and stirred at 25° C. To this was dropwise added 13.3 g (0.068 mol) of 2-ethylhexyl chlorocarbonate. After stirring for 30 minutes, a cold aqueous hydrochloric acid solution was added to the reaction mixture for liquid separation, and the chloroform layer separated was washed three times and with cold water and dried with Glauber's salt. After the Glauber's salt was filtered out, the chloroform was distilled out and the remaining precipitate was purified by column chromatography. The product was oily. Yield: 17.2 g, 61.2%.

Result of elementary analysis ($C_{27}H_{46}O_2S_2$)

| | C | H | S |
|---|---|---|---|
| Measured data (%) | 74.34 | 10.66 | 14.91 |
| Calculated data (%) | 74.60 | 10.67 | 14.75 |

SYNTHESIS EXAMPLE 2

Synthesis of Compound IV-36

Acetonitrile (300 ml) was added to 11.3 g of 3,3',5,5'-tetrabromobiphenylsulfone and 6.1 ml of triethylamine with stirring. To the mixture, 12.3 g of palmitic acid chloride was added dropwise at room temperature. After continued stirring for 5 hours, the reaction mixture was poured into 500 ml of water. The resulting crystal was recovered by filtration, washed with water and dried. Recrystallization with a mixed solvent of chloroform and ethyl acetate produced a crystal of Compound IV-36. Yield: 17.5 g, 84.0%. Melting point: 125°-126° C.

Result of elementary analysis ($C_{44}H_{66}Br_4O_6S$)

| | C | H | Br | S |
|---|---|---|---|---|
| Measured data (%) | 50.60 | 6.21 | 30.39 | 3.11 |
| Calculated data (%) | 50.68 | 6.38 | 30.66 | 3.07 |

SYNTHESIS EXAMPLE 3

Synthesis of Compound IV-38

Acetonitrile (300 ml) was added to 14.0 g of 3.3',5,5'-chloro-4,4'-dihydroxybiphenylsulfone and 11.2 ml of triethylamine with stirring. To the mixture, 22.0 g of palmitic acid chloride was added dropwise at room temperature. After completion of the addition, the internal temperature of the reaction system was elevated to 65° to 70° C. and the mixture was stirred for 1 hour. After completion of the reaction, the reaction mixture was poured into 1,000 ml of water, and the resulting crystal was recovered by filtration, washed with water and dried. Recrystallization with a mixed solvent of chloroform and ethyl acetate produced a crystal of Compound IV-38. Yield: 19.7 g, 63.3%. Melting point 125°-126° C.

Result of elementary analysis ($C_{44}H_{66}Cl_4O_6S$)

| | C | H | Cl | S |
|---|---|---|---|---|
| Measured data (%) | 61.01 | 7.55 | 17.00 | 3.61 |
| Calculated data (%) | 61.10 | 7.69 | 16.40 | 3.71 |

SYNTHESIS EXAMPLE 4

Synthesis of Compound IV-41

10.3 ml (0.0739 mol) of triethylamine was added to a solution of 15.8 g (0.0672 mol) of ethyl 3,5-dichloro-4-hydroxybenzoate in 158 ml of acetonitrile. Under stirring at 0° C., 27.3 g (0.0739 mol) of chlorocarbonyl-2-ethyl-2-(2,4-di(1,1-dimethylpropyl)phenoxy)ethyl was added dropwise at room temperature and the mixture was stirred for one hour and a half. To the reaction mixture, 800 ml of ethyl acetate was added and the ethyl acetate layer was washed with a saturated aqueous solution of sodium chloride and dried with Glauber's salt. After the Glauber's salt was filtered off, the filtrate was concentrated under vacuum to obtain 42.1 g of Compound IV-41 in a crude form. The crude product was purified by column chromatography on silica gel (800 g) using a hexane/ethyl acetate mixture as an eluting solvent under varying concentrations of 100/1 to 20/1. Compound IV-41 was obtained as a colorless oil. Yield: 35.8 g, 94%.

Result of elementary analysis ($C_{30}H_{40}Cl_2O_6$)

| | C | H | Cl |
|---|---|---|---|
| Measured data (%) | 63.68 | 7.06 | 12.23 |
| Calculated data (%) | 63.49 | 7.10 | 12.49 |

SYNTHESIS EXAMPLE 5

Synthesis of Compound IV-1 i) Synthesis of 3,5-di-(2,4-di-tert-acylphenoxypropylcarbamoyl)benzenesulfonyl chloride To 10 g (0.034 mol) of 5-sulfoisophthalic acid dimethyl ester sodium salt were added 100 ml of toluene, 16 ml (0.080 mol) of a methanol solution containing 28% sodium methylate, and 24.7 g (0.085 mol) of 2,4-di-tert-amylphenoxypropylamine and the mixture was heated to 100° C. The mixture was heated for 3 hours while distilling off methanol therefrom and, after cooling the reaction mixture, cold water was added thereto. The toluene layer formed was recovered, washed twice with cold water, and then dried using Glauber's salt. Then the Glauber's salt was filtrated away, the filtrate was concentrated to dryness, dissolved in 100 ml of N,N-dimethylacetamide and 50 ml of acetonitrile and the solution was stirred at room temperature. To the solution was added 30 ml (0.326 mol) of phosphorus oxychloride and the mixture was heated to 50° C. to 60° C. for one hour. The reaction mixture was added to ice water, extracted with 300 ml of ethyl acetate, and the ethyl acetate layer formed was recovered, washed thrice with ice water, and dried over Glauber's salt. After filtrating away the Glauber's salt, ethyl acetate was distilled off from the filtrate, and the residue was purified by column chromatography to provide 11.5 g (yield of 41.9%) of the desired product.

ii) Synthesis of sodium 3,5-di-(2,4-di-tert-amylphenoxypropylcarbamoyl)benzenesulfinate (Compound VI-1)

To 2 g (0.016 mol) of sodium sulfite and 2.4 g (0.029 mol) of sodium hydrogen carbonate were added 100 ml of water and 20 ml of acetonitrile and the mixture was stirred at 30° C. To the mixture was added dropwise a solution of 10.5 g (0.013 mol) of 3,5-di-(2,4-di-tert-amylphenoxypropylcarbamoyl)benzenesulfonyl chloride obtained in the aforesaid step dissolved in 100 ml of acetonitrile. After stirring the resultant mixture for one hour, the reaction mixture was poured onto ice water and extracted with 150 ml of ethyl acetate. The ethyl acetate layer was washed thrice with cold water and dried over Glauber's salt. After filtrating away the Glauber's salt, the residue was concentrated to dryness to provide 8.6 g (yield of 82.8%) of a solid product.

Elemental Analysis for $C_{46}H_{67}N_2O_6SNa$:

| | C | H | N | S |
|---|---|---|---|---|
| Found: | 68.75% | 8.39% | 3.32% | 3.92% |
| Calculated: | 69.14% | 8.45% | 3.51% | 4.01% |

SYNTHESIS EXAMPLE 6

Synthesis of Compound VI-25 i) Synthesis of sodium 3,5-dihexadecyloxycarbonylbenzenesulfonate 210 ml of toluene, 4.57 ml (0.0705 mol) of methanesulfonic acid, and 68.3 g (0.282 mol) of hexadecanol were added to 20.8 g (0.0705 mol) of sodium 3,5-dimethyloxycarbonylbenzenesulfonate, and the mixture was heated for 19 hours while heating, refluxing, and distilling away the vaporizable component. After 500 ml of ethyl acetate was added thereto, the mixture was poured into 500 ml of water, and the precipitate was filtered off. The precipitate was then washed with acetonitrile and isopropanol to obtain a white solid containing sodium 3,5-dihexadecyloxycarbonylbenzenesulfonate. (Yield: 55 g, m.p.: 85°-95° C.)

ii) Synthesis of 3,5-dihexadecyloxycarbonylbenzenesulfonyl chloride 220 ml of ethyl acetate and 22 ml of DMAC were added to 36.6 g of white solid containing sodium 3,5-dihexadecyloxycarbonylbenzenesulfonate. 28.1 ml (0.306 mol) of phosphorus oxychloride was added dropwise thereto over 14 minutes while heated to 40° C. and stirring, and the mixture was further stirred for 3 hours and 30 minutes at 40° C. and for 2 hours at 55° C. The reaction mixture was poured into 300 ml of ice water with stirring, and was twice extracted with 1 l of chloroform, followed by drying with Glauber's salt. After filtering off Glauber's salt, the solution was concentrated under reduced pressure. The residue thus obtained was recrystallized from chlorform/acetonitrile to obtain a white solid containing 3,5-dihexadecyloxycarbonylbenzenesulfonyl chloride. (Yield: 31.0 g, m.p.: 48°-50° C.)

iii) Synthesis of 3,5-dihexadecyloxycarbonylbenzenesulfinic acid (Compound VI-25)

87 ml of water and 18.2 ml (0.218 mol) of 12N-HCl were added to the solution of 87 ml of chloroform and 8.65 g (0.0121 mol) of the white solid containing 3,5-dihexadecyloxycarbonylbenzenesulfonyl chloride, and then 7.93 g of zinc was added thereto at 5° C. followed by stirring for 4 hours and 30 minutes. After the insoluble component was removed therefrom, the solution was extracted with 100 ml of chloroform, washed with saturated brine, and dried with Glauber's salt. After removing Glauber's salt, the solution was concentrated under reduced pressure, and the residue was recrystallized from hot hexane to obtain a colorless crystal of 3,5-dihexadecyloxycarbonylbenzenesulfinic acid. (Yield: 4.43 g, 48% (based on sodium 3,5-dimethyloxycarbonylbenzenesulfonate), m.p.: 63°-65° C.)

SYNTHESIS EXAMPLE 7

Synthesis of Compound VI-24

The same procedures of Synthesis Example 6 were repeated, and 500 ml of a saturated aqueous solution of sodium carbonate was added to the thus obtained 300 ml of a chloroform solution of Compound (VI-24). The precipitate was collected and washed with water to obtain a colorless crystal of sodium 3,5-dihexadecyloxycarbonylbenzenesulfinate. (Yield: 32%) based on sodium 3,5-dihexadecyloxycarbonylbenzenesulfonate), m.p.: 229°–231° C.)

SYNTHESIS EXAMPLE 8

Synthesis of Compound VI-39 i) Synthesis of 3,5-dihexadecyloxycarbonylbenzenesulfonyl hydrazide

A solution of 26 ml of chloroform and 5.20 g of a white solid containing 3,5-dihexadecyloxycarbonylbenzenesulfonyl chloride was added dropwise to 2.28 g (0.0364 mol) of 80% hydrazine hydrate, followed by stirring for 2 hours. Then, 200 ml of ethyl acetate was added thereto, and the mixture was washed with saturated brine and dried with Glauber's salt. After removing Glauber's salt, the solution was concentrated under reduced pressure, and the residue was recrystallized from hot ethyl acetate to obtain a white solid containing 3,5-dihexadecyloxycarbonylbenzenesulfonyl hydrazide. (Yield: 3.66 g, m.p.: 83°–88° C.)

ii) Synthesis of cyclohexane 2-(3,5-bis(hexadecyloxycarbonyl)benzenesulfonyl)hydrazone 100 ml of methanol and 0.81 mol (0.00780 mol) of cyclohexanone were added to 5.03 g (0.00709 mol) of 3,5-dihexadecyloxycarbonylbenzenesulfonyl hydrazide, and the mixture was stirred for 1 hour and 30 minutes while heating and refluxing, followed by cooled to room temperature. The precipitate was collected and recrystallized from a mixed solvent (hexane/ethyl acetate:50/1) to obtain a white solid containing Compound (VI-39). (Yield: 3.22 g, m.p.: 87°–88° C.)

SYNTHESIS EXAMPLE 9

Synthesis of Compound VI-45

5 ml of dimethylacetamide and 15 ml of ethyl acetate were added to 1.0 g of 3,5-dihexadecyloxycarbonylbenzenesulfonyl hydrazide, and 1.01 g of crystals of 3,5-dihexadecyloxycarbonylbenzenesulfonyl chloride was further added thereto while stirring. After stirring for 30 minutes at room temperature, 0.2 ml of pyridine was added dropwise thereto, and stirred further for 5 hours. After the completion of reaction, the reaction mixture was poured into 100 ml of water, and crystals thus-precipitated was collected and dried. The crystals were purified with a silica gel column chromatography to obtain crystals of Compound (VI-45). (Yield: 0.4 g (20.5%), m.p.: 148°–150° C.)

Of the preservability-improving compounds of the present invention, low molecular weight ones or easily water-soluble ones may be added to a processing solution to thereby introduce them into a light-sensitive materials in the step of development processing. Preferably, however, they are added to a light-sensitive materials in the step of preparing light-sensitive materials. In the latter process, the compounds are usually dissolved in a high-boiling solvent (or oil) having a boiling point of 170° C. or above under atmospheric pressure, a low-boiling organic solvent or a mixed solvent of said oil and said low-boiling organic solvent, and the resulting solution is then emulsified and dispersed in a hydrophilic colloidal aqueous solution such as gelatin. The compounds of the present invention are preferably soluble in high-boiling organic solvents. Particles in the emulsion dispersion are not particularly limited as to particle size, but the particle size is preferably 0.05 μm to 0.5 μm, particularly preferably 0.1 μm to 0.3 μm. In view of the advantage of the present invention, the compounds of the present invention are preferably co-emulsified with couplers.

Amounts of the compounds to be used are $1\times10^{-2}$ to 10 mols, preferably $3\times10^{-2}$ mol to 5 mols, per mol of couplers.

The compounds represented by Formulae (I), (II) and (III) are described in detail below. X and X' each represents a divalent to hexavalent polyvalent group (for example, alkylene, alkenylene, alkylidene, alkanetriyl, alkenetriyl, alkanetetrayl, alkenetetrayl, alkanepentayl, alkenepentayl, cycloalkylene or bicycloalkylene). Of these, those derived from an aliphatic acid are preferable as X, and those derived from an aliphatic acid are preferable as X, and those derived from an aliphatic alcohol and preferable as X'. n and m each represents an integer of 2 to 6. The aliphatic group mentioned with respect to R, R', and $R_{1-4}$ and the aromatic group mentioned with respect to R' and $R_1$ to $R_4$ are the same as defined with respect to Formulae (IV) and (V). $R_1$, $R_2$ and $R_3$, which may be the same or different, each represents a hydrogen atom, an aliphatic group, an aromatic group, an aliphatic oxycarbonyl group (for example, dodecyloxycarbonyl or allyloxycarbonyl), and aromatic oxycarbonyl group (for example, phenoxycarbonyl) or a carbamoyl group (for example, tetradecylcarbamoyl or phenylmethylcarbamoyl), provided that the sum of the carbon atoms of $R_1$ to $R_4$ is 8 or more, preferably 8 to 60.

$R_1$ and $R_2$, or $R_1$ and $R_3$, may be bound to each other to form a 5- to 7-membered ring.

Specific examples of the compounds represented by Formulae (I), (II) and (III) are illustrated below. However, the present invention is not to be construed as being limited thereto.

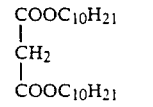
(SI-1)

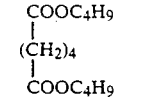
(SI-2)

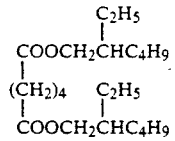
(SI-3)

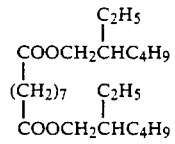
(SI-4)

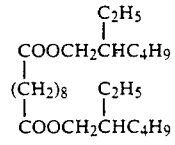
(SI-5)

-continued
(SI-6)
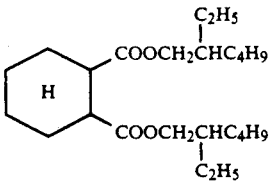
(SI-7)
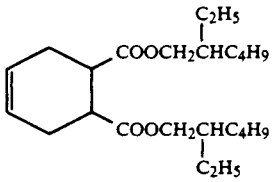
(SI-8)
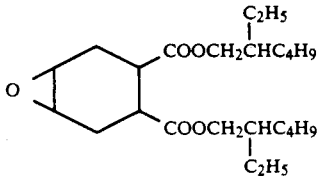
(SI-9)
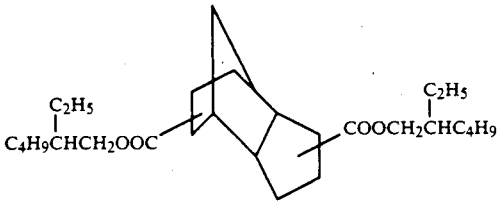
(SI-10)
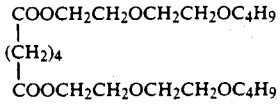
(SI-11)
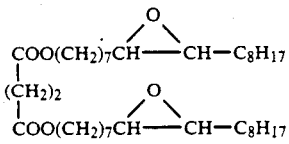
(SI-12)
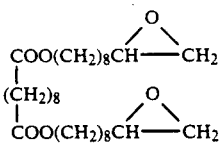
(SI-13)
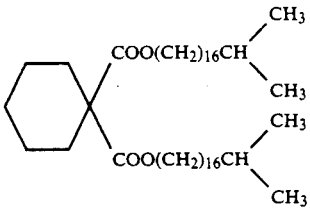
(SI-14)
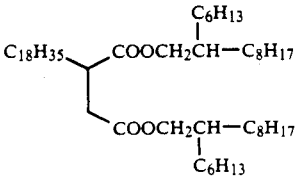
-continued
(SI-15)
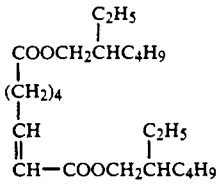
(SI-16)
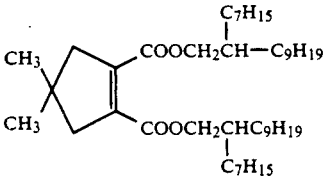
(SI-17)
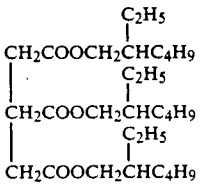
(SI-18)
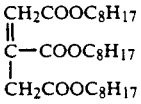
(SI-19)
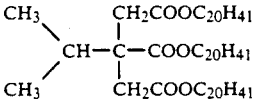
(SI-20)
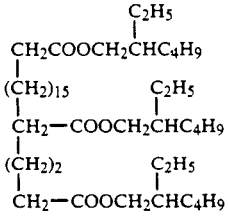
(SI-21)
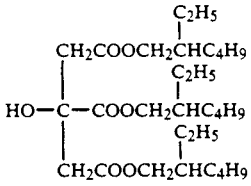
(SI-22)
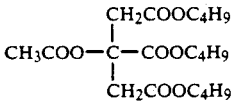
(SI-23)
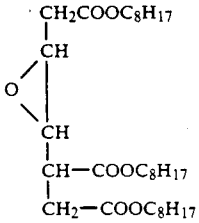

-continued
(SI-24)
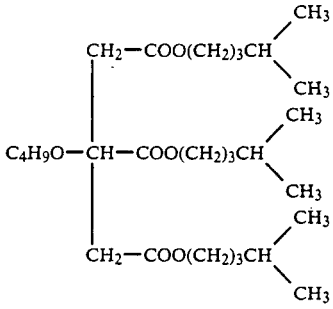
(SI-25)
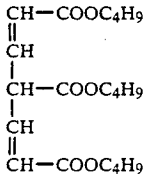
(SI-26)
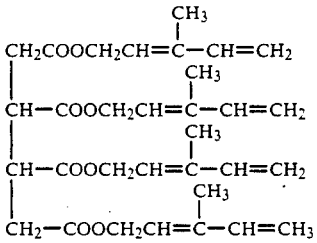
(SI-27)
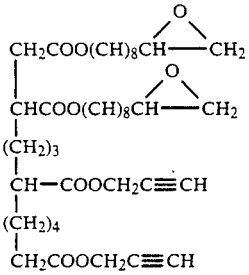
(SI-28)
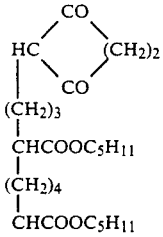
(SI-29)
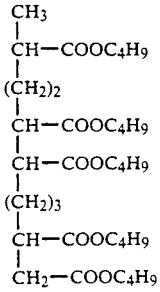
-continued
(SI-30)
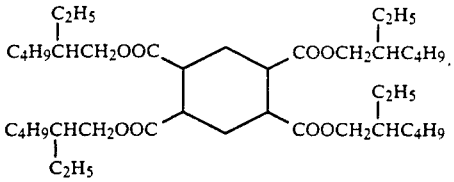
(SII-1)
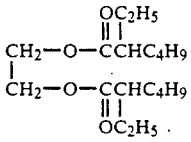
(SII-2)
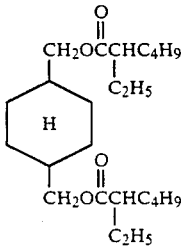
(SII-3)
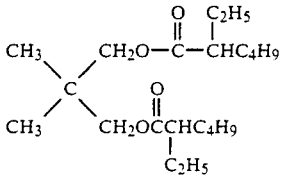
(SII-4)
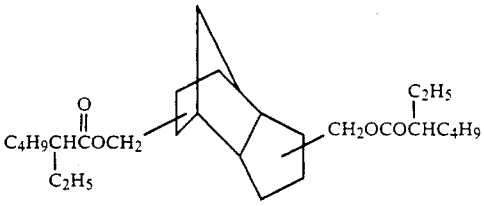
(SII-5)
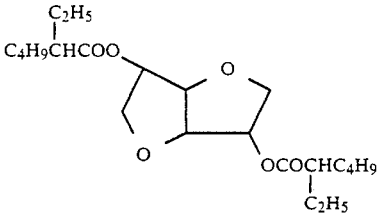
(SII-6)
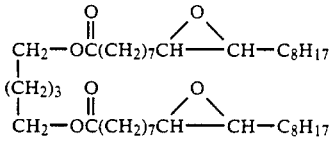
(SII-7)
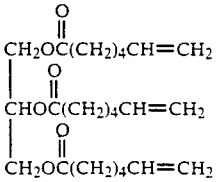

-continued
(SII-8)
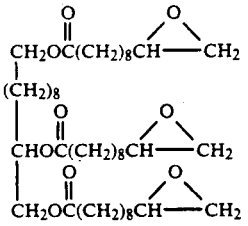
(SII-9)
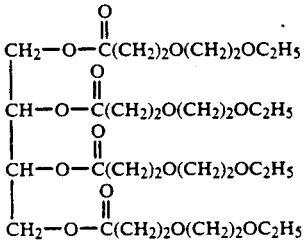
(SII-10)
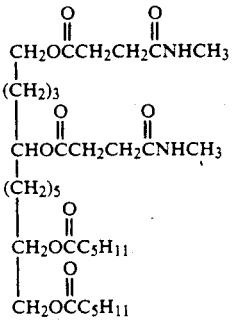
(SII-11)
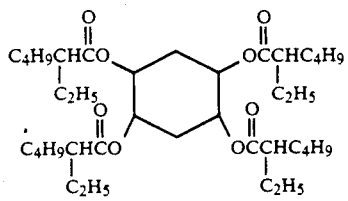
(SII-12)
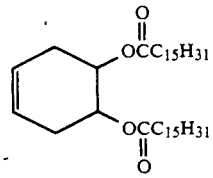
(SII-13)
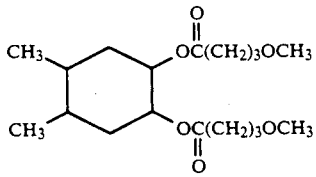
(SII-14)
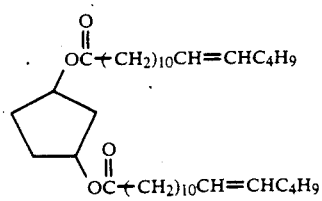
-continued
(SII-15)
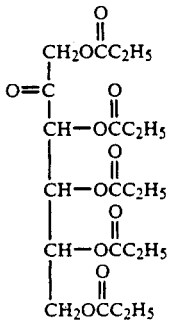
(SII-16)
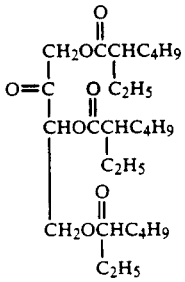
(SII-17)
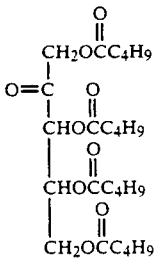
(SIII-1)
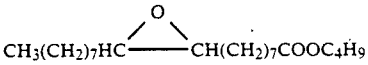
(SIII-2)
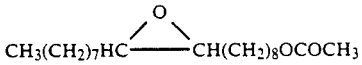
(SIII-3)
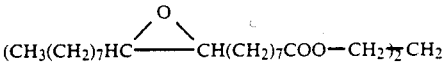
(SIII-4)
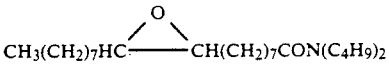
(SIII-5)
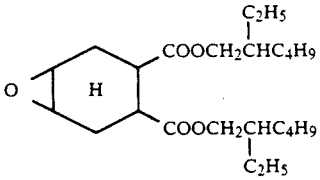
(SIII-6)
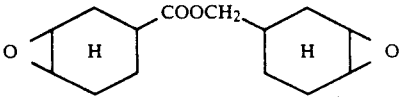
(SIII-7)
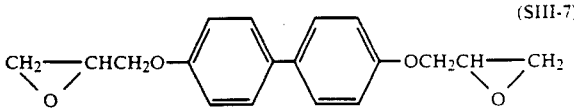

-continued (SIII-8)

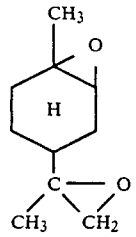

(SIII-9)

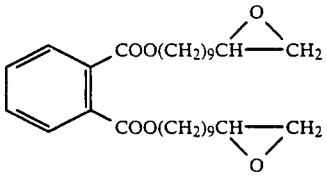

(SIII-10)

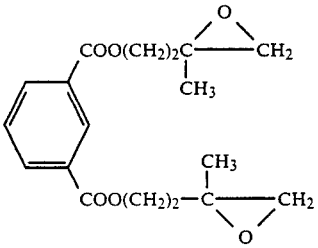

(SIII-11)

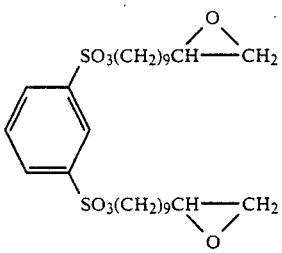

(SIII-12)

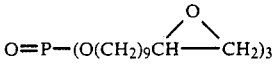

(SIII-13)

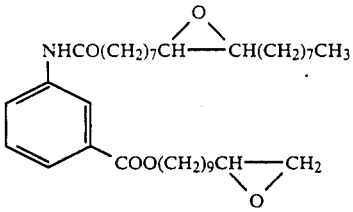

(SIII-14)

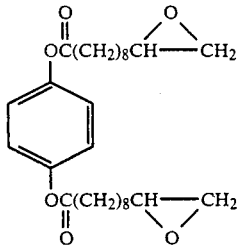

(SIII-15)

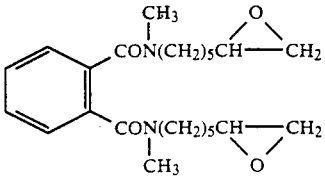

-continued (SIII-16)

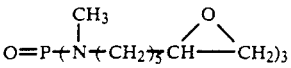

(SIII-17)

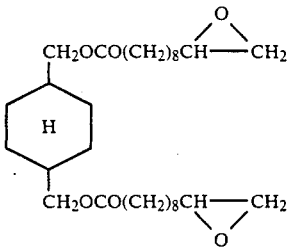

(SIII-18)

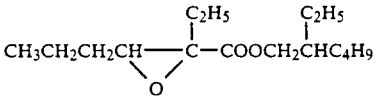

(SIII-19)

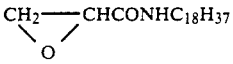

(SIII-20)

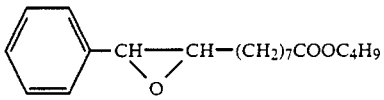

Compounds of the present invention represented by Formulae (I), (II) and (III) are preferably added in amounts of 5 wt % to 600 wt %, more preferably 10 wt % to 200 wt %, relative to the wt % of couplers.

In using the compounds of the present invention represented by Formulae (I), (II) and (TTT), they are dissolved in a high-boiling solvent which is usually used as coupler-dispersing oil. Alternatively, they may be used without using such high-boiling solvents, with the compounds themselves serving as the dispersing oils for couplers. The latter technique of using the compounds themselves as dispersing oils together with, for example, couplers is preferable in view of the advantage of the present invention.

The compound capable of chemically binding with an aromatic amine developing agent or its oxidation product may be incorporated in any hydrophilic colloidal layer of the photographic material, e.g., in a light-sensitive layer such as a blue-sensitive layer, a green-sensitive layer and a red-sensitive layer, or a non-light-sensitive layer such as an intermediate layer, an ultraviolet absorbent layer and a protective layer. The compound may be incorporated in at least one hydrophilic colloidal layer, preferably in both lightsensitive layer and non-lightsensitive layer and more preferably in all hydrophilic colloidal layers of the photographic material.

The compound represented by the formula (I), (II) or (III) may be also incorporated in any hydrophilic colloidal layer of the photographic material in the same way as the compound capable of chemically binding with an aromatic amine developing agent or its oxidation product.

The compound capable of chamically binding with an aromatic amine developing agent or its oxidation and the compound represented by the formulae (I), (II) or (III) both are preferably incorporated in the same layer, and more preferably in a green-sensitive layer.

The compounds of the present invention represented by Formulae (I), (II) and (III) may be used in combination with the following high-boiling solvent (oil) and, further, in combination with an auxiliary solvent to be described hereinafter.

As the specific examples of the aforementioned oils, there are illustrated alkyl phthalates (for example, dibutyl phthalate, dioctyl phthalate, diisodecyl phthalate or dimethoxyethyl phthalate), phosphates (for example, diphenyl phosphate, triphenyl phosphate, tricresyl phosphate, trioctyl phosphate, trinonyl phosphate, dioctylbutyl phosphate, or monophenyl-p-t-butylphenyl phosphate), citrates (for example, tributyl acetylcitrate), benzoates (for example, octyl benzoate), alkylamides (for example, diethyllaurylamide or dibutyllaurylamide), fatty acid esters (for example, dibutoxyethyl succinate or diethyl azelate), trimesic acid esters (for example, tributyl trimesate), phenols (for example,

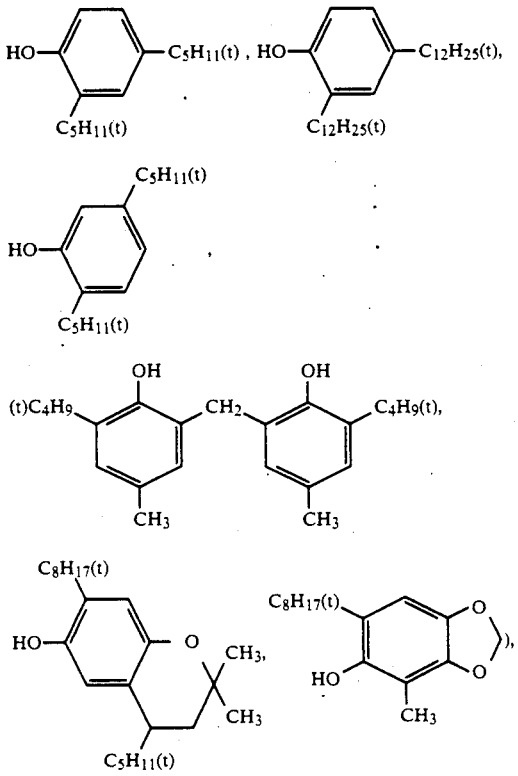

and ethers (for example, phenoxyethanol or diethyleneglycol monophenyl ether). As the auxiliary solvents, low-boiling organic solvents having a boiling point of about 30° to about 150° C. under atmospheric pressure are used. Specific examples thereof include lower alkyl acetates (for example, ethyl acetate, isopropyl acetate or butyl acetate), ethyl propionate, methanol, ethanol, sec-butyl alcohol, cyclohexanol, fluorinated alcohols, methyl isobutyl ketone, β-ethoxyethyl acetate, methylcellosolve acetate acetone, methylacetone, acetonitrile, dioxane, dimethylformamide, dimethylsulfoxide, chloroform or cyclohexane.

In addition, oily solvents for additives (for example, the compounds of the present invention and couplers including those which are solid at room temperature such as wax and those additives which themselves serving as oily solvents, for example, couplers, color mixing-preventative agents and ultraviolet ray-absorbing agents) and a polymer latex may be used in place of the high-boiling organic solvents.

In the present invention, yellow couplers, magenta couplers or cyan couplers may be used in combination with the compounds of the present invention.

The couplers to be used in combination may be of a 4-equivalent type or 2-equivalent type for silver ion, and may be in a polymer or oligomer form. Further, the couplers may be used independently or in combination of two or more.

Formulae of couplers to be preferably used in the present invention are illustrated below. However, the present invention is not to be construed as being limited thereto.

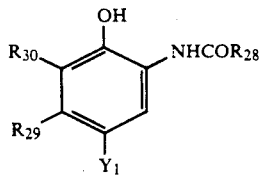

Formula (VII)

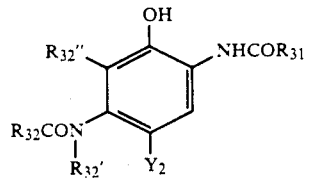

Formula (VIII)

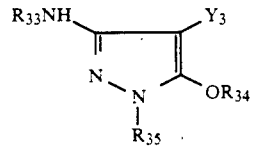

Formula (IX)

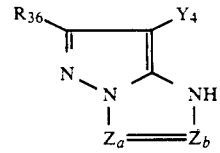

Formula (X)

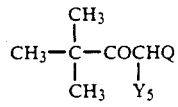

Formula (XI)

In the above formulae, $R_{28}$, $R_{31}$ and $R_{32}$ each represents an aliphatic group, an aromatic group, a heterocyclic group, an aromatic amino group or a heterocyclic amino group, $R_{29}$ represents an aliphatic group; $R_{30}$ and $R_{32}''$ each represents a hydrogen atom, a halogen atom, an aliphatic group, an aliphatic oxy group, or an acylamino group, $R_{32}'$ represents a hydrogen atom or is the same as defined for $R_{32}$; $R_{33}$ and $R_{35}$ each represents a substituted or unsubstituted phenyl group, $R_{34}$ represents a hydrogen atom, an aliphatic or aromatic acyl group, or an aliphatic or aromatic sulfonyl group, $R_{36}$ represents a hydrogen atom or a substituent, Q represents a substituted or unsubstituted N-phenylcarbamoyl group, $Z_a$ and $Z_b$ each represents methine, substituted methine or =N—, and $Y_1$, $Y_2$, $Y_3$, $Y_4$ and $Y_5$ each represents a hydrogen atom or a group capable of being eliminated upon reaction with an oxidation product of a developing agent (hereinafter abbreviated as coupling-off group).

In Formulae (VII) and (VIII), $R_{29}$ and $R_{30}$, and $R_{32}$ and $R_{32}''$ may be bound to each other to form a 5- to 6-membered ring.

In addition, polymers having a polymerization degree of 2 or more may be formed through $R_{28}$, $R_{29}$, $R_{30}$ or $Y_1$; $R_{31}$, $R_{32}$, $R_{32}''$ or $Y_2$; $R_{33}$, $R_{34}$, $R_{35}$ or $Y_3$; $R_{36}$, $Z_a$, $Z_b$ or $Y_4$; or Q or $Y_5$.

The term "aliphatic group" as used herein means a straight, branched or cyclic, alkyl, alkenyl or alkynyl group.

As phenolic cyan couplers represented by Formula (VII), there are illustrated those which have an acylamino group in the 2-position of the phenol nucleus and an alkyl group in 5-position (including polymer couplers), described in, for example, U.S. Pat. Nos. 2,369,929, 4,518,687, 4,511,647 and 3,772,002. Typical specific examples thereof are the compound described in Example 2 of Canadian Patent 625,822, compound (1) described in U.S. Pat. No. 3,722,002, compounds (I-4) and (I-5) described in U.S. Pat. No. 4,564,590, compounds (1), (2), (3) and (24) described in JP-A-61-39045, and compound (C-2) described in JP-A-62-70846.

As the phenolic cyan couplers represented by Formula (VIII), there are illustrated 2,5-diacylaminophenol type couplers described in, for example, U.S. Pat. Nos. 2,772,162, 2,895,826, 4,334,011 and 4,500,635, and JP-A-59-164555. Typical specific examples thereof are compound (V) described in U.S. Pat. No. 2,895,826, compound (17) described in U.S. Pat. No. 4,557,999, compounds (2) and (12) described in U.S. Pat. No. 4,565,777, compound (4) described in U.S. Pat. No. 4,124,396, and compound (I-19) described in U.S. Pat. No. 4,613,564.

As the phenolic cyan couplers represented by Formula (VIII), there are illustrated those wherein a nitrogen-containing hetero ring is fused with a phenol nucleus and which are described in U.S. Pat. Nos. 4,327,173, 4,564,586, 4,430,423, JP-A-61-390441 and JP-A-62-257158. Typical specific examples thereof are couplers (1) and (3) described in U.S. Pat. No. 4,327,173, compounds (3) and (16) described in U.S. Pat. No. 4,564,586, compounds (1) and (3) described in U.S. Pat. No. 4,430,423, and the following compounds.

PC-1

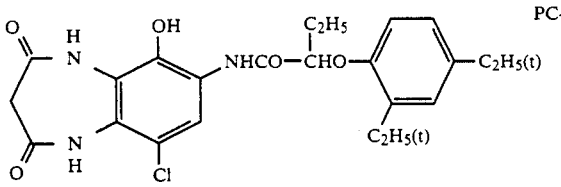

PC-2

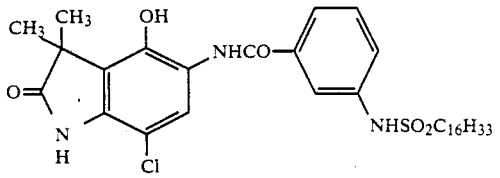

-continued

PC-3

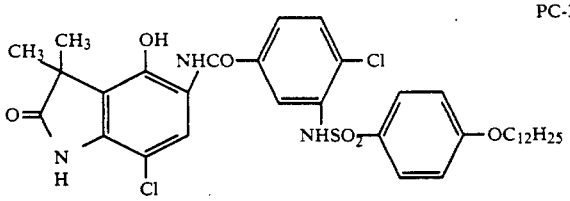

As the phenolic cyan couplers represented by Formulae (VII) and (VIII), there are further illustrated ureido couplers described in U.S. Pat. Nos. 4,333,999, 4,451,559, 4,444,872, 4,427,767 and 4,579,813, and EP 067,689B1. Typical specific examples thereof are coupler (7) described in U.S. Pat. No. 4,333,999, coupler (1) described in U.S. Pat. No. 4,451,559, coupler (14) described in U.S. Pat. No. 4,444,872, coupler (3) described in U.S. Pat. No. 4,427,767, couplers (6) and (24) described in U.S. Pat. No. 4,609,619, couplers (1) and (11) described in U.S. Pat. No. 4,579,813, couplers (45) and (50) described in EP 067,689B1, and coupler (3) described in JP-A-61-42658.

As the 5-pyrazolone couplers represented by Formula (IX), those couplers which are substituted by an arylamino group or an acylamino group in the 3-position are preferable with regard to the point of hue and coloration density of formed dyes. Typical examples thereof are described in, for example, U.S. Pat. Nos. 2,311,082, 2,343,703, 2,600,788, 2,908,573, 3,062,653, 3,152,896 and 3,936,015. As coupling-off groups for 2-equivalent 5-pyrazolone couplers, those nitrogen atom coupling-off groups which are described in U.S. Pat. No. 4,310,619 or arylthio groups described in U.S. Pat. No. 4,351,897 are preferable. 5-Pyrazolone couplers having a ballast group and being described in EP 73,636 give high coloration density are also usable.

Of the pyrazoloazole type couplers represented by Formula (X), imidazo(1,2-b)pyrazoles described in U.S. Pat. No. 4,500,630 are preferable in view of less yellow side absorption and light fastness of formed dyes, with pyrazolo(1,5-b)(1,2,4)triazoles described in U.S. Pat. No. 4,540,654 being particularly preferable.

In addition, the use of pyrazolotriazole couplers wherein a branched alkyl group is directly bound to the 2-, 3- or 6-position of the pyrazolotriazole ring as described in JP-A-61-65245, pyrazoloazole compounds containing a sulfonamido group within the molecule as described in JP-A-61-65246, pyrazoloazole couplers containing an alkoxyphenylsulfonamido ballast group as described in JP-A-61-147254, or pyrazolotriazole couplers having an alkoxy group in 6-position as described in EP-A-226,849 are preferable.

Specific examples of these couplers are illustrated below. However, the present invention is not to be construed as being limited thereto.

| Compound | $R_{37}$ | $R_{38}$ | $X_2$ |
|---|---|---|---|
| | | 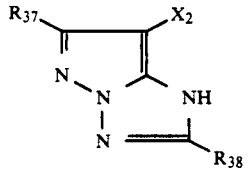 | |
| M-1 | $CH_3$— | 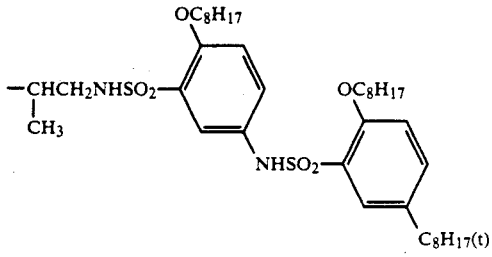 | Cl |
| M-2 | $CH_3$— | 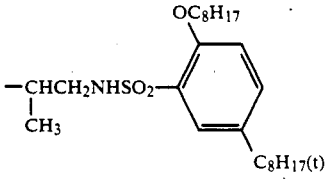 | Cl |
| M-3 | $CH_3$— | 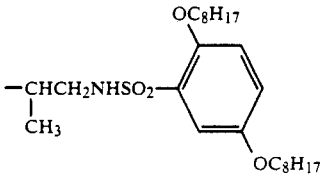 | 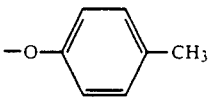 |
| M-4 | $CH_3$—NHCNH— (O) | 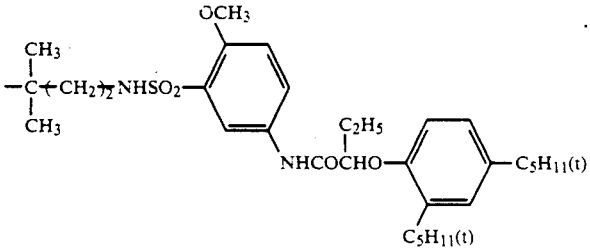 | 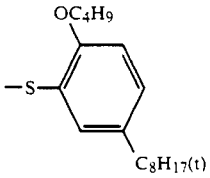 |
| M-5 | $CH_3$— | 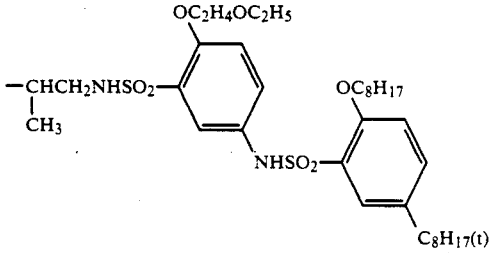 | Cl |
| M-6 | $CH_3$— | 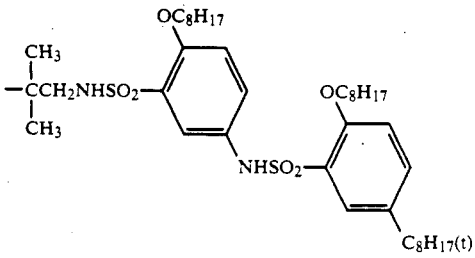 | Cl |

-continued
| Compound | $R_{37}$ | $R_{38}$ | $X_2$ |
|---|---|---|---|
| M-7 | 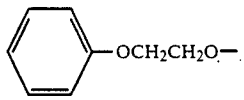 | 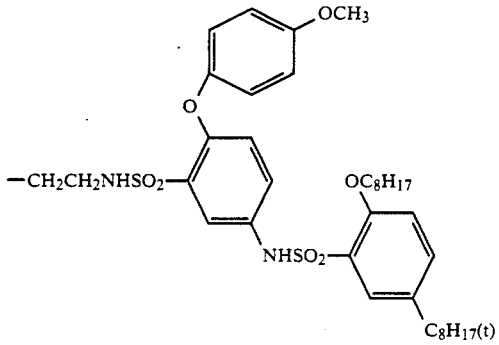 | 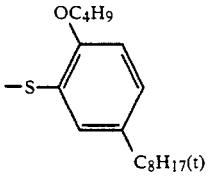 |
| M-8 | $CH_3CH_2O$— | 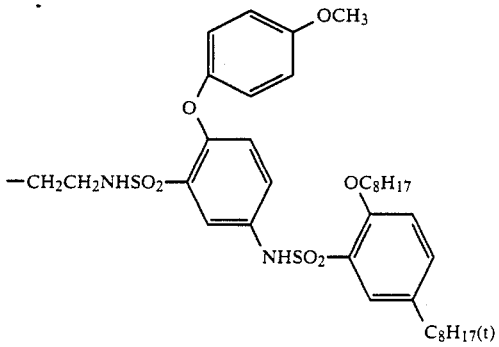 | 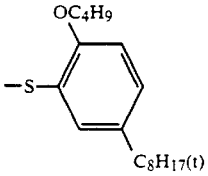 |
| M-9 | $CH_3CH_2O$— | 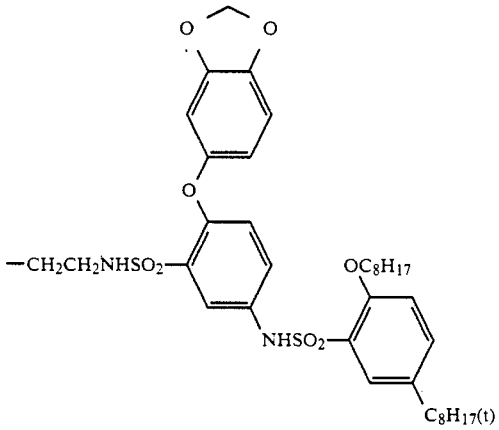 | 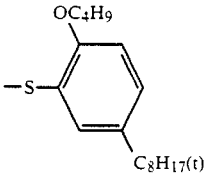 |
| M-10 | 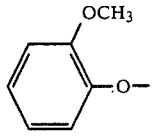 | 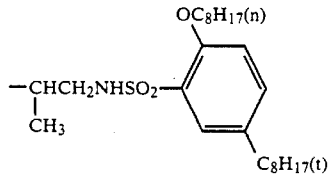 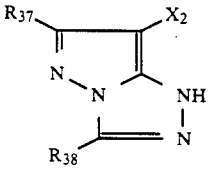 | Cl |
| M-11 | $CH_3$— | 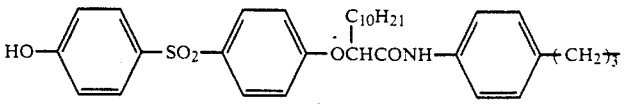 | Cl |

-continued

| Compound | $R_{37}$ | $R_{38}$ | $X_2$ |
|---|---|---|---|
| M-12 | $CH_3-$ | $(n)C_6H_{13}$ \ $CHCH_2SO_2\text{-}(CH_2)_2\text{-}$ / $(n)C_8H_{17}$ | Cl |
| M-13 | $CH_3$ \ $CH-$ / $CH_3$ | $OC_4H_9$; $-SO_2\text{-}(CH_2)_3\text{-}$; $C_8H_{17}(t)$ | Cl |
| M-14 | $\text{-}(CH-CH_2)_{50}\text{-}(CH_2-C)_{50}\text{-}$; $COOCH_2CH_2OCH_3$; $CH_3$; $CONH-$ | $CH_3-CH-$; $CH_2NHSO_2CH_3$ | Cl |
| M-15 | $OC_8H_{17}$; $-SO_2NH$; $C_8H_{17}(t)$; $OC_{10}H_{21}$; $-SO_2NHCH_2-CH$; $C_2H_5$; Cl; N; N; NH; N; N | | |

As specific examples of the pivaloylacetanilide type yellow couplers represented by Formula (XI), there are illustrated compound examples (Y-1) to (Y-39) described in U.S. Pat. No. 4,622,287, col. 37 to col. 54, with (Y-1), (Y-4), (Y-6), (Y-7), (Y-15), (Y-21), (Y-22), (Y-23), (Y-26), (Y-35), (Y-36), (Y-37), (Y 38), and (Y-39), being preferable.

In addition, there are illustrated compound examples (Y-1) to (Y-33) described in U.S. Pat. No. 4,623,616, col. 19 to col. 24, with (Y-2), (Y-7), (Y-8), (Y-12), (Y-20), (Y 21), (Y-23) and (Y-29) being preferable.

Further, there are illustrated, as preferable ones, typical example (34) described in U.S. Pat. No. 3,408,194, col. 6, compound examples (16) and (19) described in U.S. Pat. No. 3,933,501, col. 8, compound example (9) described in U.S. Pat. No. 4,046,575, col. 7 to col. 8, compound example (1) described in U.S. Pat. No. 4,133,958, col. 5 to col. 6, compound example 1 described in U.S. Pat. No. 4,401,752, col. 5, and the following compounds a) to g), the present invention not being limited thereto.

$(CH_3)_3C-C(=O)-CH(X)-C(=O)-NH-$ (phenyl ring with $R_{39}$ and Cl)

| Compound | $R_{39}$ | X |
|---|---|---|
| a | $-COOCH(CH_3)COOC_{12}H_{25}$ | 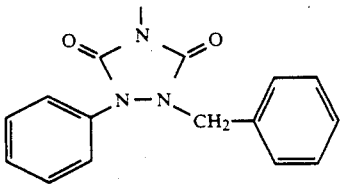 |
| b | $-COOCH(C_4H_9)COOC_{12}H_{25}$ | 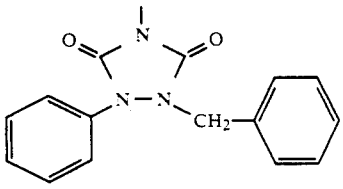 |

-continued

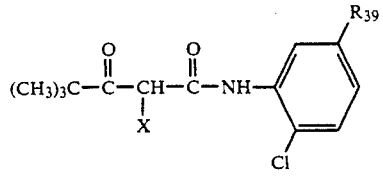

| Compound | $R_{39}$ | X |
|---|---|---|
| c | 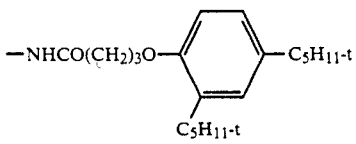 | 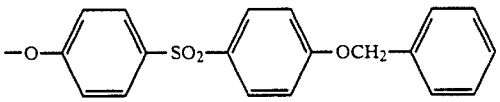 |
| d | 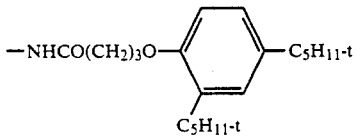 | 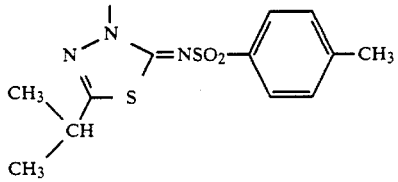 |
| e | 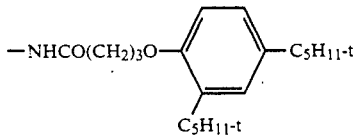 | 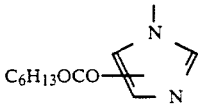 |
| f | $-NHSO_2C_{12}H_{25}$ | 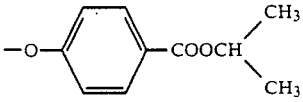 |
| g | $-NHSO_2C_{16}H_{33}$ | 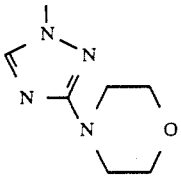 |

Literature describing other illustrative compounds of the couplers represented by Formulae (VII) to (VIII) and processes for their synthesis are referred to below.

Cyan couplers represented by Formulae (VII) and (VIII) may be synthesized according to known processes. For example, cyan couplers represented by Formula (VII) may be synthesized according to processes described in U.S. Pat. Nos. 2,423,730 and 3,772,002. Cyan couplers represented by Formula (VIII) may be synthesized according to processes described in U.S. Pat. Nos. 2,895,826, 4,333,999, and 4,327,173.

Magenta couplers represented by Formula (IX) may be synthesized according to processes described in, for example, JP-A-49-74027, JP-A-49-74028, JP-B-27930 and JP-B-53-33846 and U.S. Pat. No. 3,519,429. Magenta couplers represented by Formula (X) may be synthesized according to processes described in, for example, JP-A-59-162548, U.S. Pat. No. 3,725,067, JP-A-59-171956 and JP-A-60-33552.

Yellow couplers represented by Formula (XI) may be synthesized according to processes described in JP-A-54-48541, JP-B-58-10739, U.S. Pat. No. 4,326,024, and *Research Disclosure* (RD) No. 18053.

These couplers are generally added in amounts of $2\times10^{-3}$ mol to $5\times10^{-1}$ mol, preferably $1\times10^{-2}$ mol to $5\times10^{-1}$ mol, per mol of silver in an emulsion layer.

The compounds of the present invention may be used in combination with known anti-fading agents (color-fading preventing agent). Particularly preferably anti-fading agents are: (i) aromatic compounds represented by Formula (XII); (ii) amine compounds represented by Formula (XIII); and (iii) metal complexes having copper, cobalt, nickel, palladium or platinum as the central metal and containing at least one organic ligand having two or more coordinating sites.

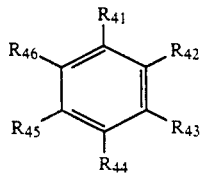

Formula (XII)

In the above formula, $R_{41}$ represents a hydrogen atom, an alkyl group, an alkenyl group, an aryl group, a heterocyclic group or

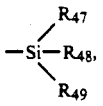

wherein $R_{47}$, $R_{48}$ and $R_{49}$, which may be the same or different from each other, each represents an alkyl group, an alkenyl group, an aryl group, an alkoxy group, an alkenoxy group or an aryloxy group, $R_{42}$, $R_{43}$, $R_{44}$, $R_{45}$ and $R_{46}$, which may be the same or different from each other, each represents a hydrogen atom, an alkyl group, an alkenyl group, an aryl group, an acylamino group, an alkylamino group, an alkylthio group, an arylthio group, an alkoxycarbonyl group, an aryloxycarbonyl group, halogen atom or —O—$R_{41}$' (wherein $R_{41}$' is the same as defined for $R_{41}$), $R_{41}$ and $R_{42}$ may be bound to each other to form a 5- or 6-membered ring or a spiro ring, and $R_{42}$ and $R_{43}$, or $R_{43}$ and $R_{44}$ may be bound to each other to form a 5- or 6-membered ring or a spiro ring.

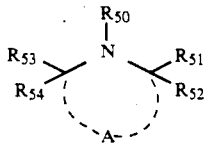

Formula (XIII)

In the above general formula, $R_{50}$ represents a hydrogen atom, an alkyl group, an alkenyl group, an alkynyl group, an acyl group, a sulfonyl group, a sulfinyl group, an oxy radical or a hydroxy group, $R_{51}$, $R_{52}$, $R_{53}$ and $R_{54}$, which may be the same or different, each represents a hydrogen atom or an alkyl group, and A represents non-metallic atoms necessary for forming a 5-, 6- or 7-membered ring.

Of the substituents in Formula (XII) and (XIII), those which contain, at least partly, an alkyl, aryl or heterocyclic moiety may further be substituted by a substituent or substituents.

As typical examples of these specific compounds, there are illustrated compounds A-1 to A-60 described in JP-A-62-92945, pp. 49 to 63 and the following compounds, the present invention not being limited thereto.

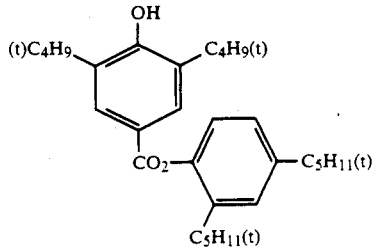

A-61

-continued

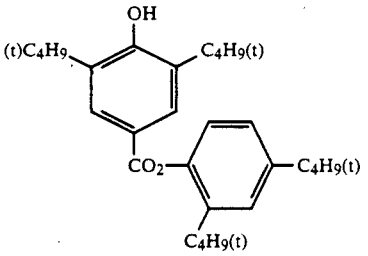

A-62

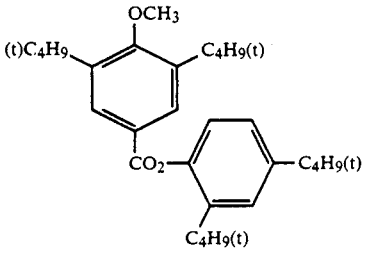

A-63

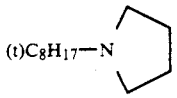

A-64

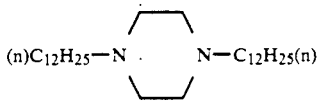

A-65

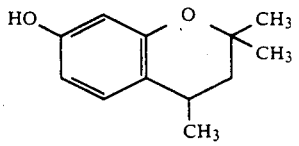

A-66

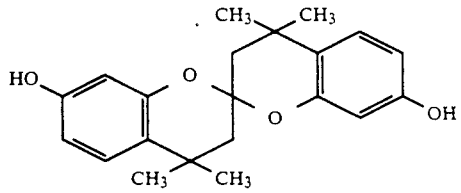

A-67

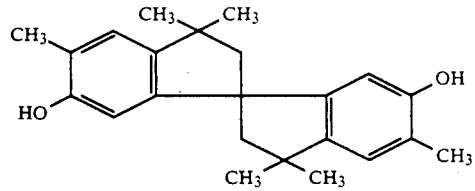

A-68

Also included as an anti-fogging agent is the following compound, which is not represented by Formulae (XII) and (XIII):

$CH_2{=}CH_2OC_{14}H_{29}(n)$ A-69

The above-described anti-fading agents are added in amounts of 10 to 400 mol %, preferably 30 to 300 mol %, based on couplers. On the other hand, metal complexes are added in amounts of 1 to 100 mol %, preferably 3 to 40 mol %, based on couplers.

The preservability-improving compound of the present invention capable of chemically bonding with a developing agent or its oxidation product remaining in light-sensitive materials after development processing and the compound represented by Formulae (I), (II), (III) may be added to one and the same layer or to different layers.

That is, the compound represented by Formulae (I), (II) or (III) is preferably incorporated in a hydrophilic colloidal layer conventionally containing oil droplets of high-boiling organic solvent, such as a light-sensitive silver halide emulsion layer, an interlayer, an ultraviolet ray-absorbing layer or a protective layer, in place of said organic solvent, whereas the preservability-improving compound may be incorporated in any hydrophilic colloidal layer.

With the compounds represented by Formulae (I) to (III), the preferable degree of combination with a coupler increases in the order of a magenta coupler, a yellow coupler, and a cyan coupler, whereas with the preservability-improving compounds capable of reacting with an aromatic amine developing agent or its oxidation product, preferable degree of the combination increases in the order of a yellow coupler, a cyan coupler, and a magenta coupler.

Therefore, the compounds represented by the general formulae (I) to (III) preferably constitute an oil droplets dispersion together with a cyan coupler in a red-sensitive silver halide emulsion layer, whereas the preservability-improving compounds are preferably allowed to exist in the same, droplets as a magenta coupler contained in a green-sensitive silver halide emulsion layer.

In the present invention, a water-insoluble and organic solvent-soluble homo- or copolymer may be incorporated in any hydrophilic colloidal layer. As the hydrophilic colloidal layer in which the polymer is incorporated, a red-sensitive silver halide layer is preferable. As the polymers, those which contain groups of

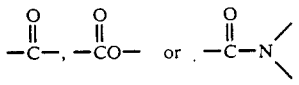

in the main chain or side chains are preferable.

Specific examples of preferable oil-soluble polymers are illustrated below, the present invention not being limited thereto.

| Specific Example | Kind or Polymer | Tg* (°C.) |
|---|---|---|
| (P-1) | Polyvinyl acetate | 32 |
| (P-2) | Polyvinyl propionate | 20 |
| (P-3) | Polymethyl methacrylate | 105 |
| (P-4) | Polyethyl methacrylate | 65 |
| (P-5) | Polyethyl acrylate | −24 |
| (P-6) | Vinyl acetate-vinyl alcohol copolymer (95:5) (molar ratio) | (32) |
| (P-7) | Poly-n-butyl acrylate | −54 |
| (P-8) | Poly-n-butyl methacrylate | 20 |
| (P-9) | Polyisobutyl methacrylate | 53 |
| (P-10) | Polyisopropyl methacrylate | 81 |
| (P-11) | Polydecyl methacrylate | −70 |
| (P-12) | n-Butyl acrylate-acrylamide copolymer (95:5) | (−54) |
| (P-13) | Polymethyl chloroacrylate | 140 |
| (P-14) | 1,4-Butanediol-adipic acid polyester | −68 |
| (P-15) | Ethylene glycol-sebacic acid polyester | — |
| (P-16) | Polycaprolactone | — |
| (P-17) | Poly(2-tert-butylphenyl acrylate) | 72 |
| (P-18) | Poly(4-tert-butylphenyl acrylate) | 71 |

-continued

| Specific Example | Kind or Polymer | Tg* (°C.) |
|---|---|---|
| (P-19) | n-Butyl methacrylate-N-vinyl-2-pyrrolidone copolymer (90:10) | (20) |
| (P-20) | Methyl methacrylate-vinyl chloride copolymer (70:30) | (105) |
| (P-21) | Methyl methacrylate-styrene copolymer (90:10) | (105) |
| (P-22) | Methyl methacrylate-ethyl acrylate copolymer (50:50) | (105, −24) |
| (P-23) | n-Butyl methacrylate-methyl methacrylate-styrene copolymer (50:30:20) | (20) |
| (P-24) | Vinyl acetate-acrylamide copolymer (85:15) | (32) |
| (P-25) | Vinyl chloride-vinyl acetate copolymer (65:35) | (81) |
| (P-26) | Methyl methacrylate-acrylonitrile copolymer (65:35) | (105) |
| (P-27) | Diacetoneacrylamide-methyl methacrylate copolymer (50:50) | (60, 105) |
| (P-28) | Vinyl methyl ketone-isobutyl methacrylate copolymer (55:45) | (—, 53) |
| (P-29) | Ethyl methacrylate-n-butyl acrylate copolymer (70:30) | (65) |
| (P-30) | Diacetoneacrylamide-n-butyl acrylate copolymer (60:40) | (60, −54) |
| (P-31) | Methyl methacrylate-cyclohexyl methacrylate copolymer (50:50) | (105, 104) |
| (P-32) | n-Butyl acrylate-styrene methacrylate-diacetoneacrylamide copolymer (70:20:10) | (−54) |
| (P-33) | N-tert-Butylmethacrylamide-methyl methacrylate-acrylic acid copolymer (60:30:10) | (160, 105) |
| (P-34) | Methyl methacrylate-styrene-vinyl sulfonamide copolymer (70:20:10) | (105) |
| (P-35) | Methyl methacrylate-phenyl vinyl ketone copolymer (70:30) | (105) |
| (P-36) | n-Butyl acrylate-methyl methacrylate-n-butyl methacrylate copolymer (35:35:30) | (−54, 105) |
| (P-37) | n-Butyl methacrylate-pentyl methacrylate-N-vinyl-2-pyrrolidone copolymer (38:38:24) | (20, −5) |
| (P-38) | Methyl methacrylate-n-butyl methacrylate-isobutyl methacrylate-acrylic acid copolymer (37:29:25:9) | (105) |
| (P-39) | n-Butyl methacrylate-acrylic acid copolymer (95:5) | (20) |
| (P-40) | Methyl methacrylate acrylic acid copolymer (95:5) | (105) |
| (P-41) | Benzyl methacrylate-acrylic acid copolymer (90:10) | (54) |
| (P-42) | n-Butyl methacrylate-methyl methacrylate-benzyl methacrylate acrylic acid copolymer (35:35:25:5) | (20, 105) |
| (P-43) | n-Butyl methacrylate-methyl methacrylate-benzyl methacrylate copolymer (35:35:30) | (20) |
| (P-44) | Poly-3-pentyl acrylate | (−6) |
| (P-45) | Cyclohexyl methacrylate-methyl-n-propyl methacrylate copolymer (37:29:34) | (104) |
| (P-46) | Polypentyl methacrylate | −5 |
| (P-47) | Methyl methacrylate-n-butyl methacrylate copolymer (65:35) | (105, 20) |
| (P-48) | Vinyl acetate-vinyl propionate copolymer (75:25) | (32) |
| (P-49) | n-Butyl methacrylate-3-acryloxybutane-1-sulfonic acid sodium salt copolymer (97:3) | (20) |
| (P-50) | n-Butyl methacrylate-methyl methacrylate-acrylamide copolymer (35:35:30) | (20, 105) |
| (P-51) | n-Butyl methacrylate-methyl methacrylate-vinyl chloride copolymer (37:36:27) | (20, 105) |
| (P-52) | n-Butyl methacrylate-styrene | (20) |

-continued

| Specific Example | Kind or Polymer | Tg* (°C.) |
|---|---|---|
| | copolymer (90:10) | |
| (P-53) | Methyl methacrylate-N-vinyl-2-pyrrolidone copolymer (90:10) | (105) |
| (P-54) | n-Butyl methacrylate-vinyl chloride copolymer (90:10) | (20) |
| (P-55) | n-Butyl methacrylate-styrene copolymer (70:30) | (20) |
| (P-56) | Poly(N-sec-butylacrylamide) | 117 |
| (P-57) | Poly(N-tert-butylacrylamide) | 128 |
| (P-58) | Diacetoneacrylamide-methyl methacrylate copolymer (62:38) | (60, 105) |
| (P-59) | Polycyclohexyl methacrylate-methyl methacrylate copolymer (60:40) | (104, 105) |
| (P-60) | N-tert-Butylacrylamide-methyl methacrylate copolymer (40:60) | (128, 105) |
| (P-61) | Poly(N-n-butylacrylamide) | 46 |
| (P-62) | Poly(tert-butyl methacrylae)-N-tert-butylacrylamide copolymer (50:50) | (118, 128) |
| (P-63) | tert-Butyl methacrylate-methyl methacrylate copolymer (70:30) | (118) |
| (P-64) | Poly(N-tert-butylmethacrylamide) | 160 |
| (P-65) | N-tert-Butylacrylamide-methyl methacrylate copolymer (60:40) | (128, 105) |
| (P-66) | Methyl methacrylate-acrylonitrile copolymer (70:30) | (105) |
| (P-67) | Methyl methacrylate-vinyl methyl ketone copolymer (28:72) | (105, —) |
| (P-68) | Methyl methacrylate-styrene copolymer (75:25) | (105) |
| (P-69) | Methyl methacrylate-hexyl methacrylate copolymer (70:30) | (105) |
| (P-70) | Poly(benzyl acrylate) | 6 |
| (P-71) | Poly(4-biphenyl acrylate) | 110 |
| (P-72) | Poly(4-butoxycarbonylphenyl acrylate) | 13 |
| (P-73) | Poly(sec-butyl acrylate) | −22 |
| (P-74) | Poly(tert-butyl acrylate) | 43 |
| (P-75) | Poly(3-chloro-2,2-bis(chloro-methyl)propyl acrylate) | 46 |
| (P-76) | Poly(2-chlorophenyl acrylate) | 53 |
| (P-77) | Poly(4-chlorophenyl acrylate) | 58 |
| (P-78) | Poly(pentachlorophenyl acrylate) | 147 |
| (P-79) | Poly(4-cyanobenzyl acrylate) | 44 |
| (P-80) | Poly(cyanoethyl acrylate) | 4 |
| (P-81) | Poly(4-cyanophenyl acrylate) | 90 |
| (P-82) | Poly(4-cyano-3-thiabutyl acrylate) | −24 |
| (P-83) | Poly(cyclohexyl acrylate) | 19 |
| (P-84) | Poly(2-ethoxycarbonylphenyl acrylate) | 30 |
| (P-85) | Poly(3-ethoxycarbonyl phenyl acrylate) | 24 |
| (P-86) | Poly(4-ethoxycarbonylphenyl acrylate) | 37 |
| (P-87) | Poly(2-ethoxyethyl acrylate) | −50 |
| (P-88) | Poly(3-ethoxypropyl acrylate) | −55 |
| (P-89) | Poly(1H,1H,5H-octafluoropentyl acrylate) | −35 |
| (P-90) | Poly(heptyl acrylate) | −60 |
| (P-91) | Poly(hexadecyl acrylate) | 35 |
| (P-92) | Poly(hexyl acrylte) | −57 |
| (P-93) | Poly(isobutyl acrylate) | −24 |
| (P-94) | Poly(isopropyl acrylate) | −5 |
| (P-95) | Poly(3-methoxybutyl acrylate) | −56 |
| (P-96) | Poly(2-methoxycarbonylphenyl acrylate) | −46 |
| (P-97) | Poly(3-methoxycarbonylphenyl acrylate) | 38 |
| (P-98) | Poly(4-methoxycarbonylphenyl acrylate) | 67 |
| (P-99) | Poly(2-methoxyethyl acrylate) | −50 |
| (P-100) | Poly(4-methoxyphenyl acrylate) | 51 |
| (P-101) | Poly(3-methoxypropyl acrylate) | −75 |
| (P-102) | Poly(3,5-dimethyladamantyl acrylate) | 106 |
| (P-103) | Poly(3-dimethylaminophenyl acrylate) | 47 |
| (P-104) | Poly(tert-butyl acrylate) | 86 |
| (P-105) | Poly(2-methylbutyl acrylate) | −32 |

-continued

| Specific Example | Kind or Polymer | Tg* (°C.) |
|---|---|---|
| (P-106) | Poly(3-methylbutyl acrylate) | −45 |
| (P-107) | Poly(1,3-dimethylbutyl acrylate) | −15 |
| (P-108) | Poly(2-methylpentyl acrylate) | −38 |
| (P-109) | Poly(2-naphthyl acrylate) | 85 |
| (P-110) | Poly(phenyl acrylate) | 57 |
| (P-111) | Poly(propyl acrylate) | −37 |
| (P-112) | Poly(m-tolyl acrylate) | 25 |
| (P-113) | Poly(o-tolyl acrylate) | 52 |
| (P-114) | Poly(p-tolyl acrylate) | 43 |
| (P-115) | Poly(N,N-dibutylacrylamide) | 60 |
| (P-116) | Poly(isohexylacrylamide) | 71 |
| (P-117) | Poly(isooctylacrylamide) | 66 |
| (P-118) | Poly(N-methyl-N-phenylacrylamide) | 180 |
| (P-119) | Poly(adamantyl methacrylate) | 141 |
| (P-120) | Poly(benzyl methacrylate) | 54 |
| (P-121) | Poly(2-bromoethyl methacrylate) | 52 |
| (P-122) | Poly(2-N-tert-butylaminoethyl methacrylate) | 33 |
| (P-123) | Poly(sec-butyl methacrylate) | 60 |
| (P-124) | Poly(tert-butyl methacrylate) | 118 |
| (P-125) | Poly(2-chloroethyl methacrylate) | 92 |
| (P-126) | Poly(2-cyanoethyl methacrylate) | 91 |
| (P-127) | Poly(2-cyanomethylphenyl methacrylate) | 128 |
| (P-128) | Poly(4-cyanophenyl methacrylate) | 155 |
| (P-129) | Poly(cyclohexyl methacrylate) | 104 |
| (P-130) | Poly(dodecyl methacrylate) | −65 |
| (P-131) | Poly(diethylaminoethyl methacrylate) | −20 |
| (P-132) | Poly(2-ethylsulfinylethyl metharylate) | 25 |
| (P-133) | Poly(hexadecyl methacrylate) | 15 |
| (P-134) | Poly(hexyl methacrylate) | −5 |
| (P-135) | Poly(2-hydroxypropyl methacrylate) | 76 |
| (P-136) | Poly(4-methoxycarbonylphenyl metharylate) | 106 |
| (P-137) | Poly(3,5-dimethyladamantyl metharylate) | 196 |
| (P-138) | Poly(dimethylaminoethyl metharylate) | 20 |
| (P-139) | Poly(3,3-dimethylbutyl methacrylate) | 45 |
| (P-140) | Poly(3,3-dimethyl-2-butyl methacrylate) | 108 |
| (P-141) | Poly(3,5,5-trimethylhexyl methacrylate) | 1 |
| (P-142) | Poly(octadecyl methacrylate) | −100 |
| (P-143) | Poly(tetradecyl methacrylate) | 80 |
| (P-144) | Poly(4-butoxycarbonylphenyl-methacrylamide) | 128 |
| (P-145) | Poly(4-carboxyphenylmethacryl-amide) | 200 |
| (P-146) | Poly(4-ethoxycarbonylphenyl-methacrylamide) | 168 |
| (P-147) | Poly(4-methoxycarbonylphenyl-methacrylamide) | 180 |
| (P-148) | Poly(butylbutoxycarbonyl methacrylamide) | 25 |
| (P-149) | Poly(butyl chloroacrylate) | 57 |
| (P-150) | Poly(butyl cyanoacrylate) | 85 |
| (P-151) | Poly(cyclohexyl chloroacrylate) | 114 |
| (P-152) | Poly(ethyl chloroacrylate) | 93 |
| (P-153) | Poly(ethyl ethoxycarbonyl-methacrylate) | 52 |
| (P-154) | Poly(ethyl methacrylate) | 27 |
| (P-155) | Poly(ethyl fluoromethacrylate) | 43 |
| (P-156) | Poly(hexyl hexyloxycarbonyl-methacrylate) | −4 |
| (P-157) | Poly(isobutyl chloroacrylate) | 90 |
| (P-158) | Poly(isopropyl chloroacrylate) | 90 |

Note) Tg means a glass transition point, and a parenthesized numeral in this column means a glass transition point of a homopolymer of copolymer-constituting monomer component, whichever is contained in greater amount.

The light-sensitive material to be prepared according to the present invention preferably contains an ultraviolet ray absorbent in hydrophilic layers. For example, aryl-substituted benzotriazole compounds (for example, those described in U.S. Pat. No. 3,533,794), 4-thiazolidone compounds (for example, those described in U.S. Pat. Nos. 3,314,794 and 3,532,681), Benzophenone compounds (for example, those described in JP-A-46-2784), cinnamic acid ester compounds (for example, those described in U.S. Pat. Nos. 3,705,805 and 3,707,375), butadiene compounds (for example, those described in U.S. Pat. No. 4,045,229) or benzoxydol compounds (for example, those described in U.S. Pat. No. 3,700,455) may be used. Ultraviolet ray-absorbing couplers (for example, α-naphtholic cyan dye-forming couplers) and ultraviolet ray-absorbing polymers may also be used. These ultraviolet ray-absorbing agents may be mordanted to a particular layer.

Preferable ultraviolet ray-absorbing agents may be represented by the following Formulae (U-I) and (U-II):

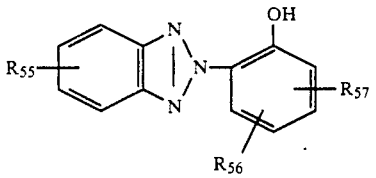

(U-I)

In Formula (U-I), $R_{55}$, $R_{56}$ and $R_{57}$ each represents a hydrogen atom, a halogen atom, a nitro group, a hydroxy group, a substituted or unsubstituted, alkyl, alkoxy, aryl, aryloxy or acylamino group.

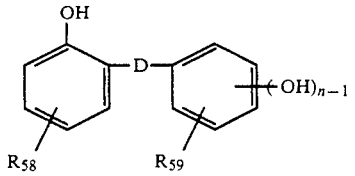

(U-II)

In Formula (U-2), $R_{58}$ and $R_{59}$ each represents a hydrogen atom or a substituted or unsubstituted, alkyl, alkoxy or acyl group, D represents —CO— or —COO—, and n represents an integer of 1 to 4.

Typical examples thereof are illustrated below, the present invention not being limited thereto.

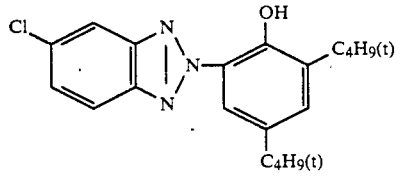

(U-1)

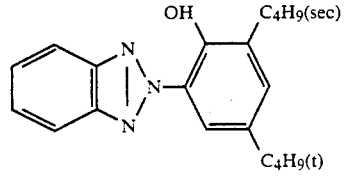

(U-2)

-continued

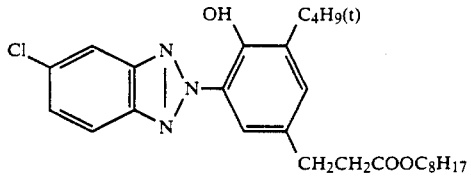

(U-3)

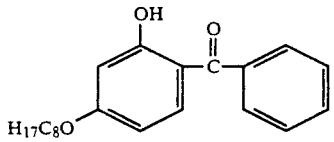

(U-4)

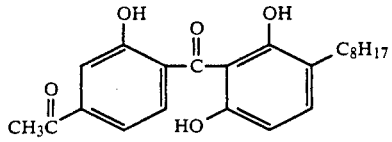

(U-5)

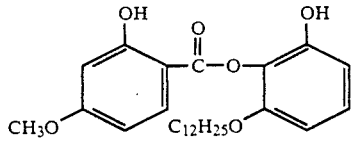

(U-6)

Silver halides to be used in the silver halide emulsion in accordance with the present invention include all of those which are used in ordinary silver halide emulsions, such as silver chloride, silver bromoiodide, silver bromide, silver chlorobromide, and silver chlorobromoiodide. These silver halide grains may be coarse or fine, and may have a narrow or broad grain size distribution. However, the use of a monodisperse emulsion of up to 15%, more preferably up to 10%, in variation coefficient is preferable.

Crystals of these silver halide grains may be in a regular form or in an irregular crystal form such as a spherical form, platy form or twin form. Proportion of (1 0 0) crystal face to (1 1 1) crystal face may be arbitrary. Further, crystal structure of these silver halide grains may be uniform from the inner portion to the outer portion or of a layered structure wherein the inner portion and the outer portion are different from each other. In addition, these silver halides may be of the type forming a latent image mainly on the grain surface or of the type forming a latent image within the grains. The latter type of forming a latent image within grains are particularly advantageous for forming direct positive images. Further, any of silver halides prepared by a neutral process, an ammoniacal process and an acidic process may be used, and silver halide grains prepared by any of a simultaneous mixing process, a normal mixing process, a reverse mixing process, or a conversion process may be employed.

Two or more separately prepared silver halide emulsions may be mixed to use.

A silver halide photographic emulsion wherein silver halide grains are dispersed in a binder solution may be sensitized with a chemical sensitizing agent. Chemical sensitizing agents to be advantageously used in the present invention are noble metal sensitizing agents, sulfur sensitizing agents, selenium sensitizing agents, and reductive sensitizing agents.

As the noble metal sensitizing agents, gold compounds and compounds of, for example, ruthenium, rhodium, palladium, iridium and platinum may be used.

Additionally, in the case of using the gold compounds, ammonium thiocyanate or sodium thiocyanate may be used in combination.

As the sulfur sensitizing agents, sulfur compounds may be used as well as active gelatin.

As the selenium sensitizing agents, active or inert selenium compounds may be used.

The reductive sensitizing agents include stannous salts, polyamines, bisalkylaminosulfides, silane compounds, iminoaminomethanesulfinic acids, hydrazinium salts, and hydrazine derivatives.

In the light-sensitive material of the present invention, auxiliary layers such as a protective layer, an interlayer, a filter layer, an anti-halation layer, and a backing layer are preferably provided in addition to the silver halide emulsion layers.

As a binder or protective colloid to be used in the emulsion layer or the interlayer of the light-sensitive material of the present invention, gelatin is advantageously used. However, other hydrophilic colloids may be used as well.

For example, proteins such as gelatin derivatives, graft polymers between gelatin and other high polymer, albumin, and casein; cellulose derivatives such as hydroxyethylcellulose, carboxymethylcellulose, and cellulose sulfuric acid esters; sugar derivatives such as sodium alginate, and starch derivatives; and various synthetic hydrophilic macromolecular substances such as homopolymers or copolymers (e.g., polyvinyl alcohol, partically acetallized polyvinyl alcohol, poly-N-vinylpyrrolidone, polyacrylic acid, polymethacrylic acid, polyacrylamide, polyvinylimidazole and polyvinylpyrazole) may be used.

As gelatin, acid-processed gelatin or enzyme-processed gelatin as described in Bull. Soc. Sci. Phot. Japan, No. 16, p. 30 (1966) may be used as well as lime-processed gelatin, and a gelatin hydrolyzate or an enzyme-decomposed product may also be used.

Various other photographic additives may be incorporated in the emulsion layers and the auxiliary layers of light-sensitive material of the present invention. For example, antifoggants, dye image fading-preventing agents, color stain-preventing agents, fluorescent brightening agents, antistatic agents, hardeners, surfactants, plasticizers, wetting agents, ultraviolet ray absorbents, etc. may properly be used.

The silver halide photographic material of the present invention may be prepared by providing respective constituting layers such as emulsion layers and auxiliary layers containing, if necessary, various photographic additives as described above on a support having been subjected to corona discharge treatment, flame treatment or ultraviolet ray irradiation treatment directly or via a subbing layer or an interlayer.

As the support to be used, there are illustrated baryta paper, polyethylene-coated paper, polypropylene synthetic paper, and transparent support having a reflective layer or using a reflective body such as glass plate, cellulose acetate film, cellulose nitrate film, polyester film (for example, polyethylene terephthalate film), polyamide film, polycarbonate film, polystyrene film, and polychlorinated resin. A proper support is selected from these supports according to the end-use.

Various coating processes such as a dip-coating process, an air doctor-coating process, a curtain coating process and a hopper coating process may be employed for providing the emulsion layers and constituting layers to be used in the present invention. In addition, the technique of coating two or more layers at the same time according to the process described in U.S. Pat. Nos. 2,761,791 and 2,941,898 may also be employed.

In the present invention, the position of each emulsion layer may be freely selected. For example, the layers may be provided in the order of a blue-sensitive emulsion layer, a green-sensitive emulsion layer and a red-sensitive emulsion layer or in the order of a red-sensitive emulsion layer, a green-sensitive emulsion layer and a blue-sensitive emulsion layer from the support side.

In addition, an ultraviolet ray absorbent layer may be provided as an adjacent layer to the farthest emulsion layer from the support and, if necessary, on the opposite side of the support. Particularly in the latter case, a protective layer composed of substantially gelatin alone is preferably provided as the uppermost layer.

The color developer to be used for development processing of light-sensitive materials of the present invention is preferably an alkaline aqueous solution containing an aromatic primary amine color developing agent as a major component. As the color developing agents, p phenylenediamine type compounds are preferably used, though aminophenol type compounds are also useful. Typical examples of the p-phenylenediamine compounds include 3-methyl-4-amino-N,N-diethylaniline, 3 methyl-4-amino-N-ethyl-N-$\beta$-hydroxyethylaniline, 3-methyl-4-amino -N-ethyl-N-$\beta$-methanesulfonamidoethylaniline, 3-methyl-4-amino-N-ethyl-N-$\beta$-methoxyethylaniline, and sulfates, hydrochlorides, or p-toluenesulfonates of these compounds. These may be used as a combination of two or more as the occasion demands.

The color developer generally contains a pH buffer such as a carbonate, borate or phosphate of an alkali metal and a development inhibitor or anti-foggant such as a bromide, an iodide, a benzimidazole compound, a benzothiazole compound or a mercapto compound. If necessary, various preservatives such as hydroxylamine, diethylhydroxylamine, hydrazine sulfite, phenylsemicarbazide, triethanolamine, catecholsulfonic acid, triethylenediamine(1,4-diazabicyclo(2,2,2)octane), etc.; organic solvents such as ethylene glycol and diethylene glycol; development accelerators such as benzyl alcohol, polyethylene glycol, quaternary ammonium salts, and amines; dye-forming couplers, competitive couplers; fogging agents such as sodium borohydride; auxiliary developing agents such as 1 phenyl-3-pyrazolidone; viscosity-imparting agents, and various chelating agents represented by aminopolycarboxylic acids, aminopolyphosphonic acids, alkylphosphonic acids, and phosphonocarboxylic acids (for example, ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphoric acid, ethylenediamine N,N,N',N'-tetramethylenephosphonic acid, ethylenediamine-di(o-hydroxyphenylacetic acid), and salts thereof) may also be incorporated.

Of the above-described development acceleratros, benzyl alcohol is preferably used in a minimized amount, most preferably in no amounts, in view of preventing environmental pollution and preventing poor recoloration.

In conducting reversal processing, black-and-white development is usually conducted before color development. In this black-and-white developer may be used known black-and-white developing agents such as dihydroxybenzenes (for example, hydroquinone), 3-pyrazolidones (for example, 1-phenyl-3-pyrazolidone) or aminophenols (for example, N-methyl-p-aminophenol) alone or in combination.

In addition, direct positive images may be obtained without the reversal processing, by using the aforementioned internal latent image-forming silver halide emulsion. In this case, fogging processing is conducted simultaneously with, or prior to, the color development using light or a nucleating agent.

The color developer and the black-and-white developer generally have a pH of 9 to 12. These developers are replenished generally in amounts of up to 3 liters per $m^2$ of light-sensitive materials, depending upon the kind of color photographic light-sensitive material to be processed. The replenishing amount may be reduced to not more than 500 ml by decreasing the bromide ion concentration in the replenisher. In the case of decreasing the replenishing amount, any contact area between the solution and the air within the processing tank should preferably be minimized to prevent vaporization and air oxidation of the solution. In addition, the replenishing amount may also be decreased by employing means of depressing accumulation of bromide ion in the developer.

Color-developed photographic emulsion layers are usually bleached. Bleaching may be conducted independently or simultaneously with fixing (bleach-fixing). In order to promote the processing, bleach-fixing may be conducted after bleaching. Further, bleach-fixing may also be freely conducted by using two continuous bleach-fixing baths, to fix before bleach-fixing or to bleach-fix after bleach fixing. As the bleaching agents, compounds of polyvalent metals such as iron(III), cobalt(III), chromium(VI), copper(II), etc., peracids, quinones, nitro compounds, etc. are used. As typical bleaching agents, ferricyanides; dichromates; organic complex salts of iron(III) or cobalt(III), for example, complex salts of aminopolycarboxylic acids such as ethylenediaminetetraacetic acid, diethylenetriaminepentaacetic acid, cyclohexanediaminetetraacetic acid, methyliminodiacetic acid, 1,3-diaminopropanetetraacetic acid, glycol ether diaminetetraacetic acid, etc. or of organic acids such as citric acid, tartaric acid, malic acid, etc.; persulfates; bromates; permanganates; nitrobenzenes; etc. may be used. Of these, iron(III) aminopolycarboxylates including iron(III) ethylenediaminetetraacetate and persulfates are preferable in view of rapid processing and prevention of environmental pollution. Further, iron(III) aminopolycarboxylate complex salts and particularly useful in both independent bleaching solution and a bleach-fixing solution. These bleaching or bleach-fixing solutions containing the iron(III) aminopolycarboxylates usually have a pH of 5.5 to 8, but may have a lower pH in order to accelerate the processing.

The bleaching solution, bleach-fixing solution, and pre-baths thereof may contain, if necessary, various bleach-accelerating agents. Specific examples of useful bleaching accelerators are described below. That is, mercapto group- or disulfide group-containing compounds described in, for example, U.S. Pat. No. 3,893,858, West German Patents 1,290,812 and 2,059,988, JP-A-53-32736, JP-A-53-57831, JP-A-53-37418, JP-A-53-72623, JP-A-53-95630, JP-A-53-95631, JP-A-53-124424, JP-A-53-141623, and JP-A-53-28426, and *Research Disclosure* No. 17129 (July, 1978); thiazolidine derivatives described in JP-A-50-140129; thiourea derivatives described in JP-B-45-8506, JP-A-52-20832, JP-A-53-32735 and U.S. Pat. No. 3,706,561; iodides described in West German Patent 1,127,715 and JP-A-58-16235; polyoxyethylene compounds described in West German Patents 966,410 and 2,748,430; polyamine compounds described in JP-B-45-8836; compounds described in JP-A-49-42434, JP A 49-59644, JP-A-53-94927, JP-A-54-35727, JP-A-55-26506 and JP-A-58-163940; and bromide ion may be used. Above all, mercapto group-or disulfido group-containing compounds are preferable due to their large accelerating effect, with compounds described in U.S. Pat. No. 3,893,858, West German Patent 1,290,812 and JP-A-53-95630 being particularly preferable. In addition, those compounds which are described in U.S. Pat. No. 4,552,834 are also preferable. These bleaching accelerators may be added to light-sensitive materials.

As fixing agents, there are illustrated thiosulfates, thiocyanates, thioether compounds, thioureas, various iodide salts, etc., with the use of thiosulfates being polular. Ammonium thiosulfate is most widely used. As preservatives for the bleach-fixing solution, sulfites, bisulfites or carbonyl-bisulfurous acid adducts are preferable.

After removal of silver, the silver halide color photographic material of the present invention is generally subjected to a water-washing step and/or a stabilizing step. The amount of water to be used in the water-washing step may be selected from a wide range depending upon the characteristics of light-sensitive materials (resulting from, for example, used materials such as couplers), end-use, temperature of washing water, number (step number) of washing tanks, manner of replenishment (countercurrent manner or direct current manner), and other various conditions. Of these conditions, the number of water-washing tanks and the amount of washing water can be determined according to the method described in *Journal of the Society of Motion Picture and Television Engineers*, vol. 64, pp. 248 to 253 (May, 1955).

The multi-stage countercurrent manner described in the above-described literature provides for a marked reduction in the amount of washing water, but since the residence time of water within tank is prolonged, there arises a problem of adhesion of suspended matter produced as a result of growth of bacteria onto light-sensitive materials. In processing the color light-sensitive materials of the present invention, the technique of reducing concentration of calcium ion and magnesium ion described in Japanese Patent Application No. 61-131632 may be extremely effectively employed for solving the problem. In addition, isothiazolone compounds and benzoisothiazole described in JP-A-57-8542, chlorine-containing bactericides such as sodium salt of chlorinated isocyanurate, and those bactericides which are described in Hiroshi Horiguchi; "Bokin Bobaizai no Kagaku (Chemistry of bactericides and fungicides)", Eisei Gijutsukai; "Biseibutsu no Mekkin, Sakkin, Bobai Gijutsu (Techniques of sterilization, pasteurization, and fungicides for micro-organisms)" and Nippon Bobai Gakkai; "Bokin Bobaizai Jiten (Book of Bactericides and Fungicides)", such as benzotriazoles may be used.

The washing water to be used for processing the light-sensitive material of the present invention has a pH of 4 to 9, preferably 5 to 8. Washing temperature and washing time may be variously selected depending upon the characteristics and end-use of the light-sensitive material but, as a general guide, a washing temperature of 15 to 45° C. and a washing time of 20 seconds to 10 minutes are selected, with a washing temperature of 25 to 40° C. and a washing time of 30 seconds to 5 minutes being preferable. Further, the light-sensitive material of the present invention may be directly processed with a stabilizing solution in place of the above-described washing with water. In such stabilizing processing, all of known techniques described in JP-A-57-8543, JP-A-58-14834 and JP-A-60-220345 may be employed.

In addition, the stabilizing processing may be conducted subsequent to the above-described water-washing step.

An over flow solution produced as a result of replenishment of the washing water and/or stabilizing solution may be re-used in other steps such as the silver-removing step.

The color developing agent may be incorporated in the silver halide color photographic material of the present invention for the purpose of simplifying and accelerating the processing. As the color developing agents to be incorporated, various precursors of them are preferably used. For example, there are illustrated indoaniline compounds described in U.S. Pat. No. 3,342,597, Schiff base type compounds described in U.S. Pat. No. 3,342,599, *Research Disclosure*, vol. 148, 14850 and Research Disclosure, Vbl. 151, 15159, metal salt complexes described in U.S. Pat. No. 3,719,492, aldol compound described in Research Disclosure, Vol.139, 13,924 and urethane compound described in JP-A-53-135628.

The silver halide color photographic material of the present invention may contain, if necessary, various 1-phenyl-3-pyrazolidones for the purpose of accelerating color development. Typical compounds are described in, for example, JP-A-56-64339, JP-A-57-14454, and JP-A-58-115438.

Various processing solutions in the present invention are used at temperatures of 10° C. to 50° C. Temperatures of 33° C. to 38° C. are standard, but higher temperatures may be employed for accelerating processing and shortening processing time, or lower temperatures may be employed to improve image quality or stability of processing solutions. In addition, processing using cobalt intensification or hydrogen peroxide intensification described in West German Patent 2,226,770 or U.S. Pat. No. 3,674,499 may be conducted for saving silver of light-sensitive materials.

The present invention is now illustrated in greater detail by reference to the following examples which, however, are not to be construed as limiting the present invention in any way.

EXAMPLE 1

A multi-layer color photographic printing paper (light-sensitive material C) comprising a paper, which was laminated by polyehtyele on both sides of the support, having provided thereon the stratum structure shown in Table 1 was prepared.

Coating solutions were prepared as follows.

27.2 ml of ethyl acetate and 10.9 g of solvent (c) were added to 19.1 g of yellow coupler (a) and 4.4 g of color image-stabilizing agent (b) to prepare a solution. This solution was then added to 185 ml of a 10% gelatin aqueous solution containing 16 ml of 10% sodium dodecylbenzenesulfonate, and the resulting mixture was emulsified and dispersed in a homogenizer to prepare an emulsion dispersion.

Separately, 90 g of a blue-sensitive emulsion was prepared by adding to a silver chlorobromide emulsion (containing 80 wt% of silver bromide and 70 g/kg of silver) a blue-sensitive sensitizing dye shown below in an amount of $7.0\times10^{-4}$ mol per mol of silver chlorobromide.

The emulsion dispersion and the emulsion were mixed with each other, and gelatin concentration was adjusted so as to attain the composition described in Table 1 to obtain a coating solution for forming a first layer.

Coating solutions for the second to seventh layers are also prepared in the same manner as the coating solution for first layer.

As a gelatin hardener for each layer, 1-hydroxy -3,5-dichloro-s-triazine sodium salt was used.

As spectrally sensitizing agents for respective emulsions, the following ones were used.

Blue-sensitive emulsion layer

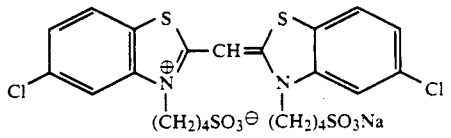

(added in an amount of $7.0\times10^{-4}$ mol per mol of silver halide)

Red-sensitive emulsion layer

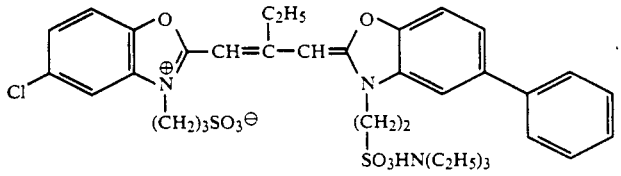

(added in an amount of $4.0\times10^{-4}$ mol per mol of silver halide)

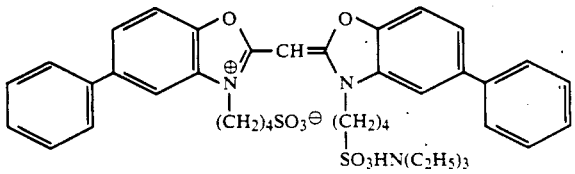

(added in an amount of $7.0\times10^{-4}$ mol per mol of silver halide)

Red-sensitive emulsion layer

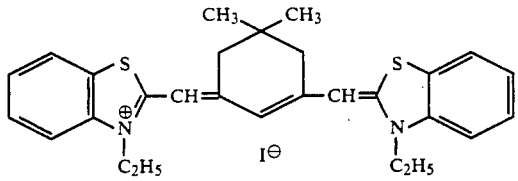

(added in an amount of $1.0\times10^{-4}$ mol per mol of silver halide)

As irradiation-preventing agents for respective layers, the following dyes were used.

Green-sensitive emulsion layer

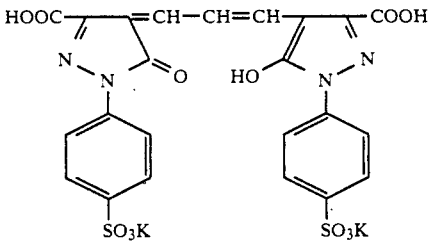

Red-sensitive emulsion layer

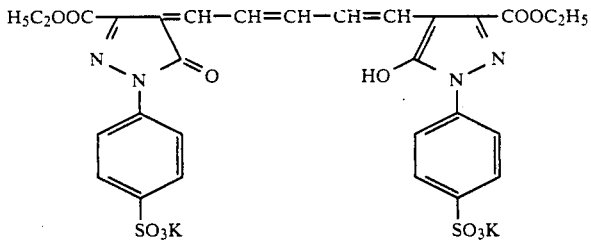

Structural formulae of the compounds used in this Example such as couplers are shown below.

(a) Yellow coupler

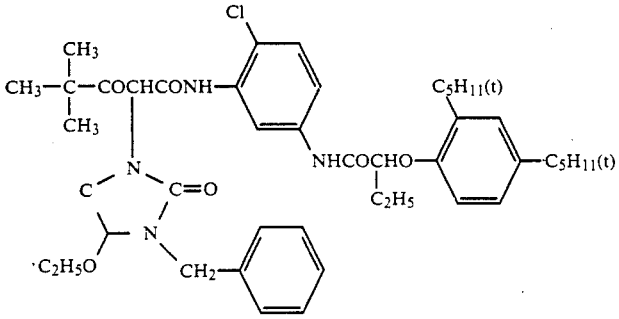

Y-1

(b) Color image-stabilizing agent

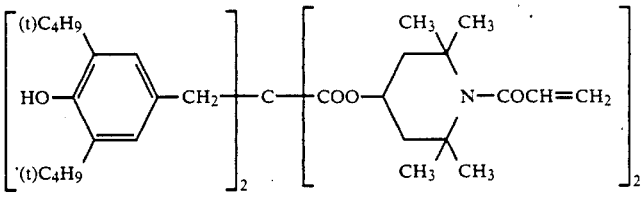

(c) Solvent

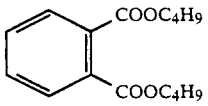

(d) Color mixing-preventing agent

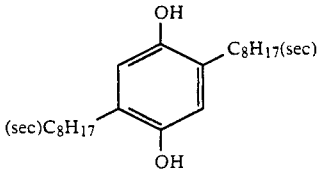

(e) Magenta coupler

Aforementioned illustrative magenta coupler M-5

(f) Color image-stabilizing agent

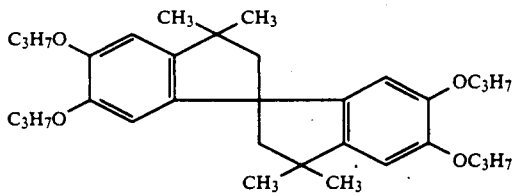

(g) Solvent

A 2:1 (by weight) mixture of

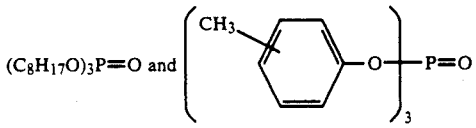

(h) Ultraviolet ray absorbent

A 1:5:3 (molar ratio) mixture of, respectively, H-1, H-2, and H-3

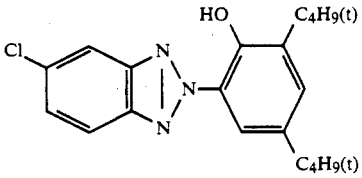

(H-1)

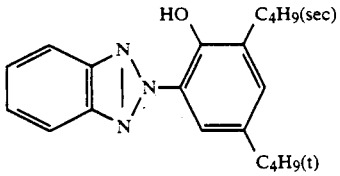

(H-2)

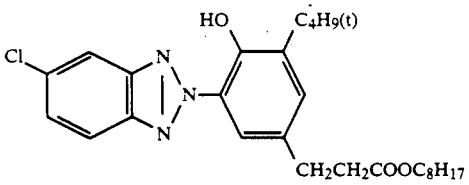

(H-3)

(i) Color mixing-preventing agent

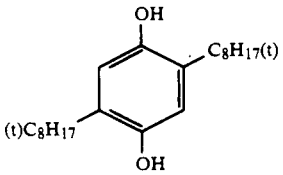

(j) Solvent $(isoC_9H_{19}O)_3P{=}O$ (k) Cyan coupler

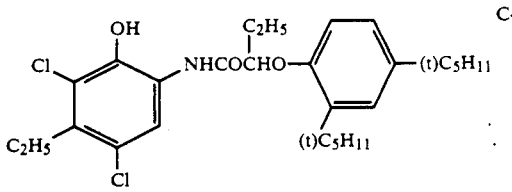

C-1

(l) Solvent

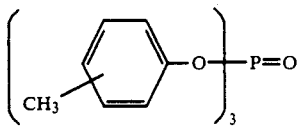

(m) Color image-stabilizing agent

A 1:3:3 (molor ratio) mixture of, respectively, M-1, M-2, and M-3

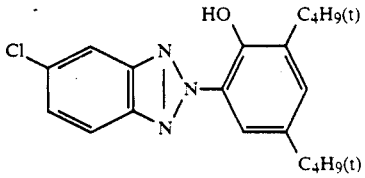

(M-1)

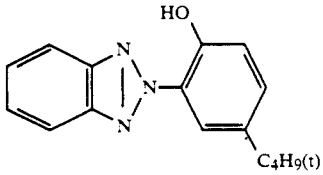

(M-2)

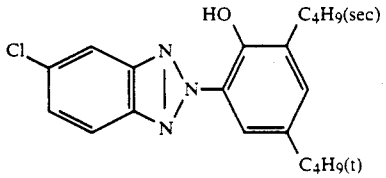

(M-3)

TABLE 1

| Layer | Main Formulation | Amount Used |
|---|---|---|
| 7th layer (protective layer) | Gelatin | 1.33 $g/m^2$ |
| | Acryl-modified copolymer of polyvinyl alcohol (modification degree: 17%) | 0.17 $g/m^2$ |
| 6th layer (UV ray-absorbing layer) | Gelatin | 0.54 $g/m^2$ |
| | UV ray absorbent (h) | 0.21 $g/m^2$ |
| | Solvent (j) | 0.09 $g/m^2$ |
| 5th layer (red-sensitive layer) | AgClBr emulsion (AgBr: 70 mol %; cubic grains; average grain diameter: 0.4μ; variation coefficient: 0.10) | 0.26 g $Ag/m^2$ |
| | Gelatin | 0.98 $g/m^2$ |
| | Cyan coupler (k) | (*1) 0.41 $g/m^2$ |
| | Color image-stabilizing agent (m) | 0.21 $g/m^2$ |
| | Solvent (l) | 0.20 $g/m^2$ |
| 4th layer (UV ray- | Gelatin | 1.60 $g/m^2$ |
| | UV ray absorbent (h) | 0.62 $g/m^2$ |

TABLE 1-continued

| Layer | Main Formulation | Amount Used |
|---|---|---|
| absorbing layer) | Color mixing-preventing agent (i) | 0.05 g/m$^2$ |
| | Solvent (j) | 0.22 g/m$^2$ |
| 3rd layer (green-sensitive layer) | AgClBr emulsion (AgBr: 75 mol %; cubic grains; average grain diameter: 0.5μ; variation coefficient: 0.09) | 0.16 g Ag/m$^2$ |
| | Gelatin | 1.80 g/m$^2$ |
| | Magenta coupler (e) | 0.34 g/m$^2$ |
| | Color image-stabilizing agent (f) | 0.20 g/m$^2$ |
| | Solvent (g) | 0.60 g/m$^2$ |
| 2nd layer (color mixing-preventing layer) | Gelatin | 0.99 g/m$^2$ |
| | Color mixing-preventing agent (d) | 0.08 g/m$^2$ |
| 1st layer (blue-sensitive layer) | AgClBr emulsion (AgBr: 80 mol %; cubic grains; average grain diameter: 1.0μ; variation coefficient: 0.08) (*2) | 0.30 g Ag/m$^2$ |
| | Gelatin | 1.86 g/m$^2$ |
| | Yellow coupler (a) | 0.82 g/m$^2$ |
| | Color image-stabilizing agent (b) | 0.19 g/m$^2$ |
| | Solvent (c) | 0.47 g/m$^2$ |
| Support | Polyethylene-laminated paper (containing a white pigment ($TiO_2$) and a bluing dye (ultramarine) in polyethylene on the first layer side). | |

(*1) 0.80 mmol/m$^2$
(*2) Presented in terms of the ratio of statistic standard deviation (s) to average grain diameter (*d*), *or* (*s/d*)

A sample of the above-described stratum structure not containing the yellow coupler and the magenta coupler in the first and the third layers, respectively, was prepared and referred to as sample A. Other samples $A_1$ to $A_{28}$ were prepared in the same manner as sample A except for changing the additives including the cyan coupler and the compound of the present invention contained in sample A as shown in Table 2. Additionally, all of the thus prepared samples had a pH of about 6.

These samples were exposed through an optical wedge, then subjected to color development processing according to the following processing manner, provided that the following processing was designed so that the developing agent and other processing solution components were liable to remain to cause stain for the purpose of demonstrating the advantage of the present invention.

| Processing step | Temperature | Time |
|---|---|---|
| Color development | 33° C. | 3 min and 40 sec |
| Bleach-fixing | 33° C. | 1 min and 30 sec |
| Washing with water | 20 to 25° C. (not stirring) | 1 min |
| Drying | 50 to 80° C. | 2 min |

Components contained in respective processing solution were as follows.

| | Amount |
|---|---|
| Color developer: | |
| Trisodium nitrilotriacetate | 2.0 g |
| Benzyl alcohol | 15 ml |
| Diethylene glycol | 10 ml |
| Diethylenetriamine pentaacetic acid | 1.0 g |
| Sodium sulfite | 0.2 g |
| Potassium bromide | 0.5 g |
| Hydroxylamine sulfate | 3.0 g |
| 4-Amino-3-methyl-N-ethyl-N-(β-(methanesulfonamido)ethyl)-p-phenylenediamine sulfate | 6.5 g |
| Sodium carbonate (monohydrate) | 30 g |
| Water to make | 1000 ml (pH 10.1) |
| Bleach-fixing solution: | |
| Color developer described above | 400 ml |
| Ammonium thiosulfate (70 wt %) | 150 ml |
| Sodium sulfite | 12 g |
| Iron sodium ethylenediaminetetraacetate | 36 g |
| Disodiumethylenediaminetetraacetate | 4 g |
| Water to make | 1000 ml |
| (pH: adjusted to 7.0 with 1 N sulfuric acid) | |

The above-described solution was used after aeration for one hour.

Note) The above-described bleach-fixing solution is designed to have a deteriorated formulation by a supposed cause such as a large amount of color developer entrained with light-sensitive materials in a running state.

After being processed, these samples were subjected to measurement of cyan reflection density in non-image areas using a red light by means of Fuji-type self-recording densitometer. The cyan reflection density in non-image area was again measured after leaving the samples for 20 days at 60° C. and under 70% RH or for 20 days under dry conditions (10 to 15% RH; 30° C.).

Results thus obtained are tabulated in Table 2.

(C-2)

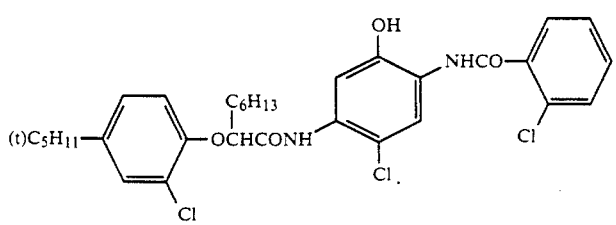

-continued (C-3)

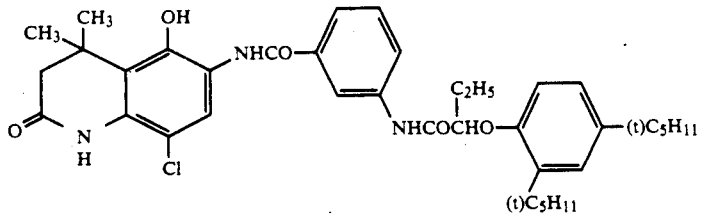

(C-4)

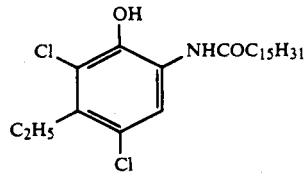

TABLE 2

| Light sensitive material | Coupler Kind | Coupler Amount (mmol/m²) | Additive Kind | Additive Amount (mol % based on coupler) | High-boiling Coupler Solvent Kind | High-boiling Coupler Solvent Amount (g/m²) | Increase in Cyan Density 60° C./70% (20 days) | Increase in Cyan Density 80° C. (20 days) | Note |
|---|---|---|---|---|---|---|---|---|---|
| A | C-1 | 0.80 | — | — | Comparative oil A | 0.20 | 0.37 | 0.24 | Comparative sample |
| $A_1$ | " | " | Comparative compound A | 30 | Comparative oil A | " | 0.36 | 0.24 | Comparative sample |
| $A_2$ | " | " | Comparative compound B | " | Comparative oil A | " | 0.37 | 0.23 | Comparative sample |
| $A_3$ | " | " | Comparative compound C | " | Comparative oil A | " | 0.36 | 0.24 | Comparative sample |
| $A_4$ | " | " | Comparative compound D | | Comparative oil A | " | 0.36 | 0.23 | Comparative sample |
| $A_5$ | " | " | IV-29 | " | Comparative oil A | " | 0.15 | 0.10 | Comparative sample |
| $A_6$ | " | " | IV-33 | " | Comparative oil B | " | 0.16 | 0.11 | Comparative sample |
| $A_7$ | " | " | IV-41 | " | Comparative oil C | " | 0.15 | 0.10 | Comparative sample |
| $A_8$ | " | " | IV-1 | " | Comparative oil D | " | 0.14 | 0.11 | Comparative sample |
| $A_9$ | " | " | Comparative compound A | " | SI-1 | " | 0.36 | 0.23 | Comparative sample |
| $A_{10}$ | C-1 | 0.80 | Comparative compound A | 30 | SII-1 | 0.20 | 0.36 | 0.24 | Comparative sample |
| $A_{11}$ | " | " | Comparative compound A | " | SII-15 | " | 0.35 | 0.24 | Comparative sample |
| $A_{12}$ | " | " | Comparative compound A | " | SIII-10 | " | 0.36 | 0.23 | Comparative sample |
| $A_{13}$ | " | " | IV-36 | " | SI-5 | " | 0.02 | 0.02 | Present invention |
| $A_{14}$ | " | " | IV-41 | " | SI-8 | " | 0.03 | 0.01 | Present invention |
| $A_{15}$ | " | " | IV-49 | " | SI-14 | " | 0.02 | 0.01 | Present invention |
| $A_{16}$ | " | " | V-1 | " | SIII-1 | " | 0.02 | 0.02 | Present invention |
| $A_{17}$ | " | " | VI-26 | " | SIII-5 | " | 0.03 | 0.02 | Present invention |
| $A_{18}$ | C-2 | " | — | — | Comparative oil A | " | 0.36 | 0.25 | Comparative sample |
| $A_{19}$ | " | " | IV-64 | 30 | Comparative oil E | " | 0.14 | 0.10 | Comparative sample |
| $A_{20}$ | " | " | V-3 | " | Comparative oil F | " | 0.16 | 0.11 | Comparative sample |
| $A_{21}$ | C-2 | 0.80 | VI-42 | 30 | Comparative oil G | 0.20 | 0.15 | 0.11 | Comparative sample |
| $A_{22}$ | " | " | IV-44 | " | SI-3 | " | 0.03 | 0.02 | Present invention |
| $A_{23}$ | " | " | IV-59/III-26 | 30/30 | SIII-6 | " | 0.01 | 0.01 | Present invention |
| $A_{24}$ | C-3 | " | IV-1 | " | Comparative oil A | " | 0.16 | 0.11 | Comparative sample |
| $A_{25}$ | " | " | V-72 | " | SI-1 | " | 0.03 | 0.01 | Present invention |
| $A_{26}$ | C-4 | " | IV-5 | " | Comparative oil D | " | 0.15 | 0.10 | Comparative sample |

TABLE 2-continued

| Light sensitive material | Coupler Kind | Coupler Amount (mmol/m²) | Additive Kind | Additive Amount (mol % based on coupler) | High-boiling Coupler Solvent Kind | High-boiling Coupler Solvent Amount (g/m²) | Increase in Cyan Density 60° C./70% (20 days) | Increase in Cyan Density 80° C. (20 days) | Note |
|---|---|---|---|---|---|---|---|---|---|
| $A_{27}$ | " | " | IV-41 | " | SI-5 | " | 0.02 | 0.01 | Present invention |
| $A_{28}$ | " | " | V-21 | " | SIII-8 | " | 0.03 | 0.02 | Present invention |

Comparative compound (A)

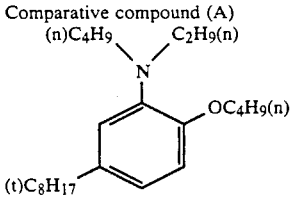

compound described in U.S. Pat. No. 4,483,918

Comparative compound (B)

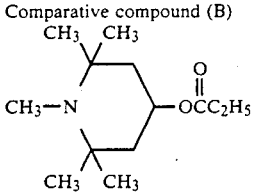

compound described in U.S. Pat. No. 4,463,085

Comparative compound (C)

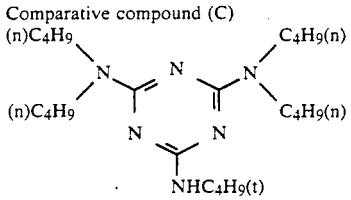

compound described in JP-A-59-218445

Comparative compound (D)
$C_{12}H_{25}N(CH_2CH_2OH)_2$
compound described in JP-A-59-229557

Comparative oil A

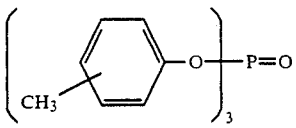

Comparative oil B

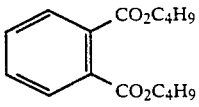

Comparative oil C

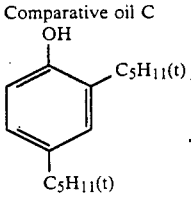

Comparative oil D

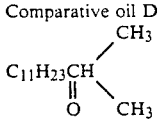

-continued

Comparative oil E

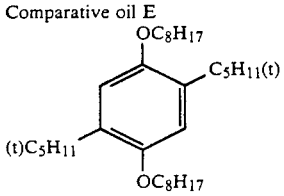

Comparative oil F

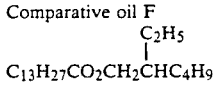

Comparative oil G

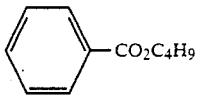

It is seen from Table 2 that the combination of the compound capable of chemically bonding with a developing agent or its oxidation product and the comparative oil fails to sufficiently depress formation of cyan stain, even though some minor depressing is observed, whereas the combination with the compound of the present invention represented by Formulae (I) to (III) can substantially depress formation of cyan stain. Combinations of known stain-preventing agents and the compounds of the present invention represented by Formulae (I) to (III) failed to give the remarkable depressing effect which was obtained by the combination of the present invention.

EXAMPLE 2

Sample B was prepared by removing the magenta coupler and the cyan coupler from the third and the fifth layers of the light-sensitive material C prepared in Example 1 and color image-stabilizing agent (b) from the first layer. Samples $B_1$ to $B_{18}$ were also prepared in the same manner as sample B except for changing the yellow coupler and the additives including the compound of the present invention as shown in Table 3. Additionally, all of the samples thus obtained had a membrane pH of about 6.

Then, the thus prepared samples were exposed through an optical wedge, then processed in the following manner to obtain color images.

Processing A

A running development processing was conducted under the following conditions using a Fuji Color Roll Processor, FMPP 1000 (partially modified) (made by Fuji Photo Film Co., Ltd.).

| Step | Time | Temp. | Tank Volume | Replenishing Amount (ml/m²) |
|---|---|---|---|---|
| Color development | 45 sec | 35° C. | 88 liters | 150 |
| Bleach-fixing | 45 sec | 35° C. | 35 liters | 50 |
| Rinsing (1) | 20 sec | 35° C. | 17 liters | — |
| Rinsing (2) | 20 sec | 35° C. | 17 liters | — |
| Rinsing (3) | 20 sec | 35° C. | 17 liters | 250 |

Additionally, the rinsing steps were conducted in a three-tank countercurrent manner wherein a replenisher was poured into rinsing tank (3), an overflow from the rinsing tank (3) was introduced to the lower part of rinsing tank (2), an over-flow from the rinsing tank (2) was introduced into the lower part of rinsing tank (1), and an over-flow from rinsing tank (1) was discarded. Additionally, an entrained amount from the pre-bath was 25 ml per m² of paper.

Formulations of the solutions in respective tanks and of replenishers thereof are shown below.

| | Tank Solution | Replenisher |
|---|---|---|
| Color developer | | |
| Water | 800 ml | 800 ml |
| Diethylenetriaminepenta-acetic acid | 3.0 g | 3.0 g |
| Bnzyl alcohol | 15 ml | 17 ml |
| Diethylene glycol | 10 ml | 10 ml |
| Sodium sulfite | 2.0 g | 2.5 g |
| Potassium bromide | 0.5 g | |
| Sodium carbonate | 30 g | 35 g |
| N-Ethyl-N-(β-methanesulfon-amidoethyl)-3-methyl-4-amino-aniline sulfate | 5.0 g | 7.0 g |
| Hydroxylamine sulfate | 4.0 g | 4.5 g |
| Fluorescent brightening agent | 1.0 g | 1.5 g |
| Water to make | 1000 ml | 1000 ml |
| pH | 10.10 | 10.50 |
| Bleach-fixing solution | | |

-continued

| | Tank Solution | Replenisher |
|---|---|---|
| Water | 400 ml | 400 ml |
| Ammonium thiosulfate (70% solution) | 150 ml | 300 ml |
| Sodium sulfite | 12 g | 25 g |
| Iron(III) ammonium ethylene-diaminetetraacetate | 55 g | 110 g |
| Disodium ethylenediaminetetra-acetate | 5 g | 10 g |
| Water to make | 1000 ml | 1000 ml |
| pH (25° C.) | 6.70 | 6.50 |
| Rinsing solution | | |
| Ethylenediamine.N,N,N',N'-tetramethylenephosphonic acid | 0.3 g | |
| Benzotriazole | 1.0 g | |
| Water to make | 1000 ml | |
| pH was adjusted to 7.5 with NaOH. | | |

Processing B

| Step | Time | Tank Volume | Replenishing Amount (ml/m²) |
|---|---|---|---|
| Color development | 45 sec | 88 liters | 150 |
| Bleach-fixing | 2 min & 00 sec | 36 liters | 350 |
| Rinsing (1) | 1 min & 00 sec | 17 liters | — |
| Rinsing (2) | 1 min & 00 sec | 17 liters | — |
| Rinsing (3) | 1 min & 00 sec | 17 liters | 1300 |

Additionally, processing solutions and replenishing solutions were the same as used in processing A.

Each of the thus processed light-sensitive materials was subjected to measurement of yellow reflection density in non-image areas one hour after the processing and again subjected to measurement of yellow reflection density in non-image areas after leaving for 20 days at 80° C. (10 to 15% RH) or for 20 days at 80° C. under 70% RH.

The results thus obtained are tabulated in Table 3.

TABLE 3

| Light-sensitive material | Coupler Kind | Coupler Amount (mmol/m²) | Additive Kind | Additive Amount mol % based on coupler | High-boiling coupler solvent Kind | High-boiling coupler solvent Amount (g/m²) | Processing step | Increase in Yellow density 80° C./70% (20 days) | Increase in Yellow density 80° C. (20 days) | Note |
|---|---|---|---|---|---|---|---|---|---|---|
| B | Y-1 | 1.0 | — | — | Comparative oil B | 0.47 | A | 0.21 | 0.11 | Comparative example |
| B | " | " | — | — | Comparative oil B | " | B | 0.02 | 0.02 | Comparative example |
| $B_1$ | " | " | Comparative compound A | 30 | SI-3 | " | A | 0.20 | 0.11 | Comparative example |
| $B_2$ | " | " | Comparative compound B | " | SII-4 | " | A | 0.21 | 0.12 | Comparative example |
| $B_3$ | " | " | Comparative compound C | " | SII-1 | " | A | 0.20 | 0.11 | Comparative example |
| $B_4$ | " | " | IV-1 | " | Comparative oil B | " | A | 0.13 | 0.07 | Comparative example |
| $B_5$ | " | " | IV-6 | " | Comparative oil A | " | A | 0.14 | 0.08 | Comparative example |
| $B_6$ | " | " | V-3 | " | Comparative oil E | " | A | 0.13 | 0.07 | Comparative example |
| $B_7$ | " | " | VI-31 | " | Comparative oil G | " | A | 0.12 | 0.08 | Comparative example |
| $B_8$ | Y-1 | 1.0 | IV-38 | 30 | SI-1 | 0.47 | A | 0.02 | 0.02 | Present invention |
| $B_9$ | " | " | IV-41 | " | SI-5 | " | A | 0.03 | 0.02 | Present invention |
| $B_{10}$ | " | " | IV-49 | " | SII-1 | " | A | 0.02 | 0.01 | Present invention |
| $B_{11}$ | " | " | VI-31 | " | SIII-1 | " | A | 0.03 | 0.02 | Present invention |
| $B_{12}$ | " | " | IV-49/III-26 | 30/30 | SIII-10 | " | A | 0.01 | 0.01 | Present |

TABLE 3-continued

| Light-sensitive material | Coupler Kind | Coupler Amount (mmol/m²) | Additive Kind | Additive Amount mol % based on coupler | High-boiling coupler solvent Kind | High-boiling coupler solvent Amount (g/m²) | Processing step | Increase in Yellow density 80° C./70% (20 days) | Increase in Yellow density 80° C. (20 days) | Note |
|---|---|---|---|---|---|---|---|---|---|---|
| | | | | | | | | | | invention |
| $B_{13}$ | Y-2 | " | — | — | Comparative oil B | " | A | 0.24 | 0.15 | Comparative example |
| $B_{13}$ | " | " | — | — | Comparative oil B | " | B | 0.02 | 0.02 | Comparative example |
| $B_{14}$ | " | " | IV-49 | 30 | Comparative oil B | " | A | 0.15 | 0.09 | Comparative example |
| $B_{15}$ | " | " | IV-72 | " | SI-2 | " | A | 0.02 | 0.02 | Present invention |
| $B_{16}$ | " | " | VI-1 | " | Comparative oil C | " | A | 0.14 | 0.09 | Comparative example |
| $B_{17}$ | " | " | VI-26 | " | SI-7 | " | A | 0.03 | 0.02 | Present invention |
| $B_{18}$ | Y-2 | 1.0 | VI-42 | 30 | SIII-5 | 0.47 | A | 0.02 | 0.02 | Present invention |

Y-2

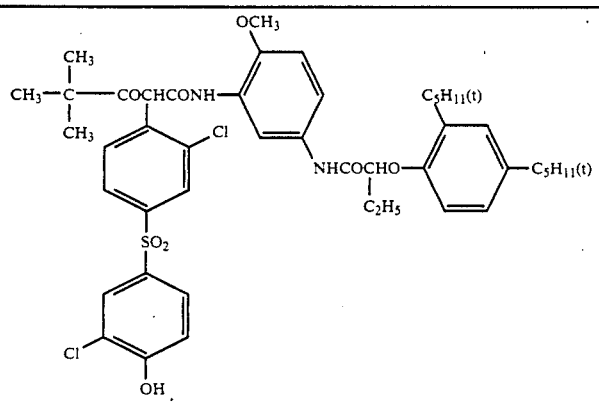

As is clear from Table 3, yellow stain was not serious in processing B wherein water-washing time and bleach-fixing time were long enough and the processing solutions were well replenished, whereas yellow stain increased in processing A wherein the processing times were shortened and replenishing amounts were reduced. This yellow stain can be depressed to some extent by adding the compound of the present invention capable of chemically binding with a developing agent or its oxidation product, but this depressing effect was insufficient in an incubation test for a long time. This yellow stain formed after the long-time incubation cannot be fully depressed even by adding known stain-preventing agents and the compounds of the present invention represented by Formulae (I) to (III), or by adding the compounds of the present invention capable of chemically binding with a developing agent or its oxidation product and high-boiling coupler solvents other than the compounds of the present invention represented by Formulae (I) to (III). This yellow stain can be substantially depressed only by the combination of the present invention.

EXAMPLE 3

Samples $C_1$ to $C_{13}$ were prepared in the same manner as with sample C prepared in Example 1 except for changing the magenta coupler in the third layer and the additives including the compound of the present invention as shown in Table 4.

Separately, samples $D_1$ to $D_{38}$ were prepared by replacing the compound represented by Formulae (I) to (III) by equal grams of the solvent used in another layer than the third layer as shown in Table 4.

Additionally, film pH of the samples was measured to be about 6.

Each of these samples was subjected to a continuous gradation exposure through an optical wedge for sensitometry, then subjected to the following processing.

| Step | Temperature | Time |
|---|---|---|
| 1. Color development | 35° C. | 45 sec |
| 2. Bleach-fixing | 35° C. | 1 min & 00 sec |
| 3. Washing with water | 25 to 30° C. | 2 min & 30 sec |

Formulations of respective processing solutions used in the color development processing steps are as shown below.

| | Amount |
|---|---|
| Color developer | |
| Water | 800 cc |
| Ethylenediaminetetraacetic acid | 1.0 g |
| Sodium sulfite | 0.2 g |
| N,N-diethylhydroxylamine | 4.2 g |
| Potassium bromide | 0.01 g |
| Sodium chloride | 1.5 g |
| Triethanolamine | 8.0 g |
| Potassium carbonate | 30 g |
| N-Ethyl-N-(β-methanesulfonamidoethyl)-3-methyl-4-aminoaniline sulfate | 4.5 g |
| 4,4'-Diaminostilbene type fluorescent brightening agent (Whitex 4 made by Sumitomo Chemical Co., Ltd.) | 2.0 g |
| Water to make | 1000 cc |
| pH was adjusted to 10.25 with KOH. | |
| Bleach-fixing solution | |

-continued

| | Amount |
|---|---|
| Ammonium thiosulfate (54 wt %) | 150 ml |
| $Na_2SO_3$ | 15 g |
| $NH_4(Fe(III)(EDTA))$ | 55 g |
| EDTA.2Na | 4 g |
| Glacial acetic acid | 8.61 g |
| Water to make | 1000 ml |
| pH | 5.4 |
| Rinsing solution | |
| EDTA.2Na.$2H_2O$ | 0.4 g |
| Water to make | 1000 ml |
| pH | 7.0 |

Then, each of the development-processed light-sensitive materials described above was subjected to measurement of magenta reflection density (stain) in non-image areas one hour after the processing, then again subjected to the same measurement of magenta reflection density (stain) in non-image areas after leaving for 10 days at 80° C. under 70% RH or for 100 days at room temperature. Results of the measurement, i.e., an increase in stain based on stain formed one hour after processing are shown in Table 4.

TABLE 4

| Light-Sensitive Material | Third Layer | | | Solvent | | Increase in Magenta Density | | Note |
|---|---|---|---|---|---|---|---|---|
| | Kind of Coupler | Additive | Amount (mol % based on Coupler) | Kind | Solvent-replaced Layer | 80° C./70% (10 days) | Room Temperature (100 days) | |
| C | M-5 | — | — | Solvent (g) in Table 1 | 3rd layer | 0.29 | 0.19 | Comparative example |
| $C_1$ | " | IV-41 | 30 | Solvent (g) in Table 1 | " | 0.13 | 0.10 | Comparative example |
| $C_2$ | " | VI-26 | " | Solvent (g) in Table 1 | " | 0.14 | 0.12 | Comparative example |
| $C_3$ | " | IV-6 | " | Comparative oil A | " | 0.14 | 0.12 | Comparative example |
| $C_4$ | " | IV-20 | " | Comparative oil B | " | 0.14 | 0.11 | Comparative example |
| $C_5$ | " | IV-22 | " | Comparative oil C | " | 0.15 | 0.13 | Comparative example |
| $C_6$ | " | IV-36 | " | Comparative oil D | " | 0.19 | 0.13 | Comparative example |
| $C_7$ | " | IV-49 | " | Comparative oil E | " | 0.14 | 0.11 | Comparative example |
| $C_8$ | " | IV-72 | " | Comparative oil F | " | 0.14 | 0.10 | Comparative example |
| $C_9$ | " | VI-1 | " | Comparative oil G | " | 0.14 | 0.10 | Comparative example |
| $C_{10}$ | " | VI-34 | " | Comparative oil G | " | 0.15 | 0.11 | Comparative example |
| $C_{11}$ | M-5 | IV-47 | 30 | SI-1 | 3rd layer | 0.04 | 0.03 | Present invention |
| $C_{12}$ | " | IV-49 | " | SII-1 | " | 0.04 | 0.02 | Present invention |
| $C_{13}$ | " | IV-72 | " | SIII-1 | " | 0.03 | 0.03 | Present invention |
| $D_1$ | " | IV-1 | " | Comparative oil B | 5th layer | 0.16 | 0.11 | Comparative example |
| $D_2$ | " | IV-5 | " | Comparative oil C | " | 0.15 | 0.10 | Comparative example |
| $D_3$ | " | VI-3 | 50 | Comparative oil F | 1st layer | 0.14 | 0.12 | Comparative example |
| $D_4$ | " | V-4 | " | Comparative oil G | " | 0.15 | 0.13 | Comparative example |
| $D_5$ | " | VI-8 | 30 | Comparative oil D | 2nd layer | 0.18 | 0.13 | Comparative example |
| $D_6$ | " | VI-31 | " | Comparative oil C | 4th layer | 0.17 | 0.12 | Comparative example |
| $D_7$ | " | IV-47 | " | SI-1 | 5th layer | 0.02 | 0.01 | Present invention |
| $D_8$ | M-5 | IV-49 | 30 | SI-1 | 1st layer | 0.03 | 0.01 | Present invention |
| $D_9$ | " | V-1 | 50 | " | 1st layer and 5th layer | 0.02 | 0.01 | Present invention |
| $D_{10}$ | " | VI-1 | 30 | SIII-1 | 5th layer | 0.03 | 0.02 | Present invention |
| $D_{11}$ | " | VI-26 | " | SIII-10 | 1st layer | 0.02 | 0.02 | Present invention |
| $D_{12}$ | M-12 | IV-6 | " | Comparative oil C | 5th layer | 0.14 | 0.09 | Comparative example |
| $D_{13}$ | " | IV-48 | " | Comparative oil D | 1ST layer | 0.12 | 0.10 | Comparative example |
| $D_{14}$ | " | IV-51 | " | SI-1 | 5th layer | 0.03 | 0.02 | Present invention |
| $D_{15}$ | " | VI-1 | " | SIII-2 | 1st layer | 0.03 | 0.01 | Present invention |
| $D_{16}$ | M-1 | IV-3 | " | Comparative | " | 0.17 | 0.12 | Comparative |

TABLE 4-continued

| Light-Sensitive Material | Third Layer: Kind of Coupler | Third Layer: Additive | Third Layer: Amount (mol % based on Coupler) | Solvent: Kind | Solvent: Solvent-replaced Layer | Increase in Magenta Density: 80° C./70% (10 days) | Increase in Magenta Density: Room Temperature (100 days) | Note |
|---|---|---|---|---|---|---|---|---|
| | | | | oil C | | | | example |
| $D_{17}$ | " | V-1 | " | Comparative oil D | 5th layer | 0.19 | 0.13 | Comparative example |
| $D_{18}$ | M-1 | Comparative compound A | " | SI-8 | 5th layer | 0.27 | 0.17 | Comparative example |
| $D_{19}$ | " | Comparative compound B | " | SII-1 | " | 0.26 | 0.16 | Comparative example |
| $D_{20}$ | " | Comparative compound C | " | SII-5 | 1st layer | 0.27 | 0.16 | Comparative example |
| $D_{21}$ | " | Comparative compound D | " | SIII-8 | " | 0.26 | 0.17 | Comparative example |
| $D_{22}$ | " | IV-24 | " | SI-1 | " | 0.03 | 0.02 | Present invention |
| $D_{23}$ | " | IV-29 | " | SI-5 | 5th layer | 0.03 | 0.01 | Present invention |
| $D_{24}$ | " | VI-41 | " | SIII-1 | " | 0.02 | 0.01 | Present invention |
| $D_{25}$ | " | VI-45 | " | SIII-2 | 1st layer | 0.02 | 0.01 | Present invention |
| $D_{26}$ | " | IV-41/III-26 | 30/30 | SI-1 | 5th layer | 0.01 | 0.01 | Present invention |
| $D_{27}$ | " | " | " | " | 1st layer | 0.01 | 0.01 | Present invention |
| $D_{28}$ | " | " | " | " | 1st layer and 5th layer | 0.01 | 0.01 | Present invention |
| $D_{29}$ | M-16 | IV-36 | 30 | Comparative oil C | 5th layer | 0.17 | 0.11 | Comparative example |
| $D_{30}$ | " | " | " | Comparative oil C | 1st layer | 0.16 | 0.13 | Comparative example |
| $D_{31}$ | " | IV-38 | " | SI-8 | 5th layer | 0.02 | 0.02 | Present invention |
| $D_{32}$ | " | VI-3 | " | SIII-6 | 1st layer | 0.03 | 0.02 | Present invention |
| $D_{33}$ | M-17 | VI-44 | " | Comparative oil D | 5th layer | 0.14 | 0.10 | Comparative example |
| $D_{34}$ | " | " | " | Comparative oil D | 1st layer | 0.15 | 0.11 | Comparative example |
| $D_{35}$ | " | " | " | SI-3 | " | 0.03 | 0.01 | Present invention |
| $D_{36}$ | " | " | " | " | 5th layer | 0.02 | 0.02 | Present invention |
| $D_{37}$ | " | VI-40 | " | SIII-1 | " | 0.03 | 0.02 | Present invention |
| $D_{38}$ | " | " | " | SI-7 | 1st layer | 0.02 | 0.01 | Present |

TABLE 4-continued

| Light-Sensitive Material | Third Layer: Kind of Coupler | Third Layer: Additive | Third Layer: Amount (mol % based on Coupler) | Solvent: Kind | Solvent: Solvent-replaced Layer | Increase in Magenta Density: 80° C./70% (10 days) | Increase in Magenta Density: Room Temperature (100 days) | Note |
|---|---|---|---|---|---|---|---|---|
| | | | | | | | | invention |

(M-16)

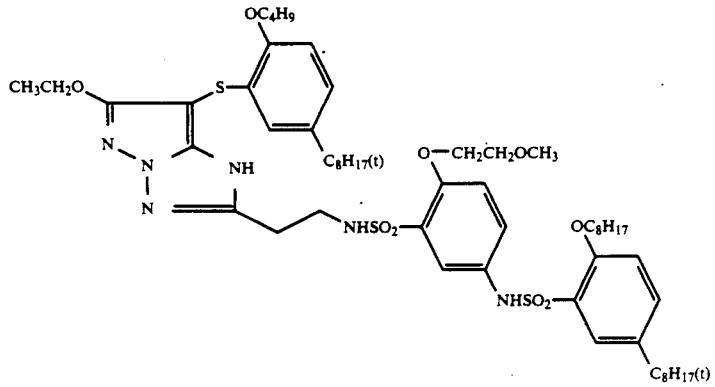

(M-17)

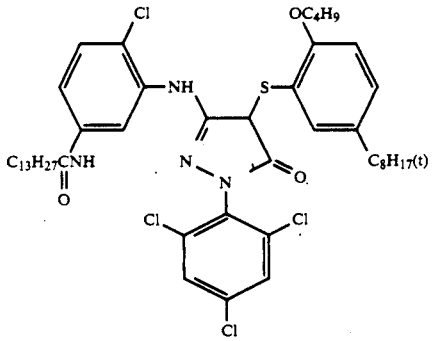

As is apparent from Table 4, it is seen that the compounds capable of chemically binding with a developing agent or its oxidation product can depress generation of magenta stain, but are insufficient for long-time storage. Magenta stain cannot be completely depressed even by the combination of the known stain-preventing agent and the compound of the present invention represented by Formulae (I) to (III), whereas substantially no generation of magenta stain was observed when the compound capable of chemically binding with a developing agent or its oxidation product and the compound of the present invention represented by Formulae (I) to (III) were used in combination. With the combination of the present invention, the same effect was obtained when the compound of the present invention represented by Formulae (I) to (III) was used in another layer than the layer to which the magenta coupler was added.

Additionally, substantially the same results as shown in Table 4 were obtained when the silver chlorobromide emulsions used in the first, third, and fifth layers were changed to various emulsions of from pure silver chloride to pure silver bromide containing various mixing ratios.

EXAMPLE 4

Samples prepared in Example 3 were exposed through an optical wedge in the same manner, then subjected to processings (a) to (f) shown below, followed by evaluation of the magenta stain preventing effect in the same manner as in Example 3. As a result, all of comparative samples were observed to suffer an increase in magenta stain, whereas samples wherein a combination of the compounds of the present invention was employed were observed to suffer substantially no magenta stain.

Processing (a)

| Processing step | Temperature | Time |
|---|---|---|
| Color development | 38° C. | 1 min and 40 sec |
| Bleach-fixing | 30 to 34° C. | 1 min and 00 sec |
| Rinsing (1) | 30 to 34° C. | 20 sec |
| Rinsing (2) | 30 to 34° C. | 20 sec |
| Rinsing (3) | 30 to 34° C. | 20 sec |
| Drying | 70 to 80° C. | 50 sec |
| (Rinsing was conducted in a 3-tank countercurrent manner of rinsing (3)→(1).) | | |

Formulations of respective processing solutions are as follows.

| | Amount |
|---|---|
| Color developer | |
| Water | 800 ml |
| Diethylenetriaminepenta-acetic acid | 1.0 g |
| 1-Hydroxyethylidene-1,1-diphosphonic acid (60%) | 2.0 g |
| Nitrilotriacetic acid | 2.0 g |
| 1,3-Diamino-2-propanol | 4.0 g |
| 1,4-Diazabicyclo(2,2,2)octane | 6.0 g |
| Potassium bromide | 0.5 g |
| Potassium carbonate | 30 g |
| N-Ethyl-N-(β-methanesulfonamido ethyl)-3-methyl-4-aminoaniline sulfate | 5.5 g |

-continued

| | Amount |
|---|---|
| N,N-Diethylhydroxylamine sulfate | 4.0 g |
| Fluorescent brightening agent (UVITEX-CK made by CIBA GEIGY Co.) | 1.5 g |
| Water to made | 1000 ml |
| pH (25° C.) | 10.25 |
| Bleach-fixing solution | |
| Water | 400 ml |
| Ammonium thiosulfate (70%) | 200 ml |
| Sodium sulfite | 20 g |
| Iron(III) ammonium ethylenediaminetetraacetate | 60 g |
| Disodium ethylenediaminetetraacetate | 10 g |
| Water to make | 1000 ml |
| pH (25° C.) | 7.00 |
| Rinsing solution | |
| Iron-exchanged water (containing up to 3 ppm each of calcium and magnesium) | |

Processing (b)

| Processing Step | Temperature | Time | Replenishing Amount* | Tank Volume |
|---|---|---|---|---|
| Color development | 35° C. | 45 sec | 161 ml | 17 liters |
| Bleach-fixing | 30 to 36° C. | 45 sec | 215 ml | 17 liters |
| Stabilizing (1) | 30 to 37° C. | 20 sec | — | 10 liters |
| Stabilizing (2) | 30 to 37° C. | 20 sec | — | 10 liters |
| Stabilizing (3) | 30 to 37° C. | 20 sec | — | 10 liters |
| Stabilizing (4) | 30 to 37° C. | 30 sec | 248 ml | 10 liters |
| Drying | 70 to 85° C. | 60 sec | | |

*per $m^2$ of light-sensitive material
(Stabilizing was conducted in a 4-tank countercurrent manner of (4)→(1).)

Formulation of respective processing solutions are as follows.

| | Tank Solution | Replenisher |
|---|---|---|
| Color developer | | |
| Water | 800 ml | 800 ml |
| Ethylenediaminetetraacetic acid | 2.0 g | 2.0 g |
| 5,6-Dihydroxybenzene-1,2,4-trisulfonic acid | 0.3 g | 0.3 g |
| Triethanolamine | 8.0 g | 8.0 g |
| Potassium bromide | 0.6 g | — |
| Potassium carbonate | 25 g | 25 g |
| N-Ethyl-N-(β-methanesulfonamidoethyl)-3-methyl-4-aminoaniline sulfate | 5.0 g | 7.0 g |
| Diethylhydroxylamine | 4.2 g | 6.0 g |
| Fluorescent brightening agent (4,4'-diaminostilbene type) | 2.0 g | 2.0 g |
| Water to make | 1000 ml | 1000 ml |
| pH (25° C.) | 10.05 | 10.45 |

| | Amount |
|---|---|
| Bleach-fixing solution (Tank solution and replenisher have the same formulation.) | |
| Water | 400 ml |
| Ammonium thiosulfate (70%) | 100 ml |
| Sodium sulfite | 17 g |
| Iron(III) ammonium ethylenediaminetetraacetate | 55 g |
| Disodium ethylenediaminetetraacetate | 5 g |
| Glacial acetic acid | 9 g |
| Water to make | 1000 ml |
| pH (25° C.) | 5.40 |
| Stabilizing solution (Tank solution and replenisher have the same formulation.) | |

-continued

| | |
|---|---|
| Formalin (37%) | 0.1 g |
| Formalin-sulfurous acid adduct | 0.7 g |
| 5-Chloro-2-methyl-4-isothiazolin-3-one | 0.02 g |
| 2-Methyl-4-isothiazolin-3-one | 0.01 g |
| Copper sulfate | 0.005 g |
| Water to make | 1000 ml |
| pH (25° C.) | 4.0 |

Processing (c)

A running development processing was conducted under the following conditions using a Fuji Color Roll Processor, FMPP 1000 (partially modified) (made by Fuji Photo Film Co., Ltd.).

| Step | Time | Temp. | Tank Volume | Replenishing Amount (ml/$m^2$) |
|---|---|---|---|---|
| Color development | 45 sec | 35° C. | 88 liters | 150 |
| Bleach-fixing | 45 sec | 35° C. | 35 liters | 50 |
| Rinsing (1) | 20 sec | 35° C. | 17 liters | — |
| Rinsing (2) | 20 sec | 35° C. | 17 liters | — |
| Rinsing (3) | 20 sec | 35° C. | 17 liters | 250 |

Additionally, the rinsing steps were conducted in a three-tank countercurrent manner wherein a replenisher was poured into rinsing tank (3), an overflow from the rinsing tank (3) was introduced to the lower part of rinsing tank (2), an over-flow from the rinsing tank (2) was introduced to the lower part of rinsing tank (1), and an over-flow from the rinsing tank (1) was discarded. Additionally, an entrained amount from the pre-bath was 25 ml per $m^2$ of paper.

Formulations of respective tank solutions and rephenishers are shown below.

| | Tank Solution | Replenisher |
|---|---|---|
| Color developer | | |
| Water | 800 ml | 800 ml |
| Diethylenetriaminepentaacetic acid | 3.0 g | 3.0 g |
| Bnzyl alcohol | 15 ml | 17 ml |
| Diethylene glycol | 10 ml | 10 ml |
| Sodium sulfite | 2.0 g | 2.5 g |
| Potassium bromide | 0.5 g | |
| Potassium carbonate | 30 g | 35 g |
| N-Ethyl-N-(β-methanesulfonamidoethyl)-3-methyl-4-aminoaniline sulfate | 5.0 g | 7.0 g |
| Hydroxylamine sulfate | 4.0 g | 4.5 g |
| Fluorescent brightening agent | 1.0 g | 1.5 g |
| Water to make | 1000 ml | 1000 ml |
| pH | 10.10 | 10.50 |
| Bleach-fixing solution | | |
| Water | 400 ml | 400 ml |
| Ammonium thiosulfate (70% solution) | 150 ml | 300 ml |
| Sodium sulfite | 12 g | 25 g |
| Iron(III) ammonium ethylenediaminetetraacetate | 55 g | 110 g |
| Disodium ethylenediaminetetraacetate | 5 g | 10 g |
| Water to make | 1000 ml | 1000 ml |
| pH (25° C.) | 6.70 | 6.50 |
| Rinsing solution | | |
| Ethylenediamine.N,N,N',N'-tetramethylenephosphonic acid | | 0.3 g |
| Benzotriazole | | 1.0 g |
| Water to make | | 1000 ml |
| pH was adjusted to 7.5 with NaOH. | | |

Processing (d)

| Step | Time | Tank Solution | Replenishing Amount (ml/m$^2$) |
|---|---|---|---|
| Color development | 45 sec | 88 liters | 150 |
| Bleach-fixing | 2 min & 00 sec | 35 liters | 350 |
| Rinsing (1) | 1 min & 00 sec | 17 liters | — |
| Rinsing (2) | 1 min & 00 sec | 17 liters | — |
| Rinsing (3) | 20 sec | 17 liters | 1300 |
| Additionally, processing solutions and replenishing solutions were the same as used in processing (c). | | | |

Processing (e)

| | Temperature | Time |
|---|---|---|
| 1. Color development | 33° C. | 3 min & 30 sec |
| 2. Bleach-fixing | 33° C. | 1 min & 30 sec |
| 3. Washing with water | 28 to 35° C. | 3 min & 00 sec |

| | Amount |
|---|---|
| Color developer | |
| Diethylenetriaminepentaacetic acid | 1.0 g |
| Benzyl alcohol | 15 ml |
| Diethylene glycol | 10 ml |
| $Na_2SO_3$ | 2.0 g |
| KBr | 0.5 g |
| Hydroxylamine sulfate | 3.0 g |
| 4-Amino-3-methyl-N-ethyl-N-(β-(methanesulfonamido)ethyl)-p-phenylenediamine sulfate | 5.0 g |
| $Na_2CO_3$ (monohydrate) | 30 g |
| Fluorescent brightening agent (4,4'-diaminostilbene type) | 1.0 g |
| Water to make | 1 liter (pH: 10.1) |
| Bleach-fixing solution | |
| Ammonium thiosulfate (70 wt %) | 150 ml |
| $Na_2SO_3$ | 15 g |
| $NH_4(Fe(EDTA))$ | 55 g |
| EDTA.2Na | 5 g |
| Water to make | 1 liter (pH: 6.9) |

Processing (f)

The same as processing (e) except for changing the cooclor developer to that of the following formulation.

| Color developer | Amount |
|---|---|
| Diethylenetriaminepentaacetic acid | 1.0 g |
| Diethylene glycol | 10 ml |
| $Na_2SO_3$ | 2.0 g |
| KBr | 0.5 g |
| Hydroxylamine sulfate | 3.0 g |
| 4-Amino-3-methyl-N-ethyl-N-(β-(methanesulfonamido)ethyl)-p-phenylenediamine sulfate | 5.0 g |
| $Na_2CO_3$ (monohydrate) | 30 g |
| Fluorescent brightening agent (4,4'-diaminostilbene type) | 1.0 g |
| Water to make | 1 liter (pH: 10.1) |

Color stain to be formed with time after color development processing can be effectively depressed by using the compound of the present invention and the compound represented by Formula (I), (II) or (III). Thus, color photographic pictures can be stored for a long time while keeping good image quality.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support having provided thereon a photographic layer, wherein the photographic material contains:

at least one compound (a) selected from (i) a compound represented by formula (IV) or (V) capable of chemically bonding with an aromatic amine developing agent, which remains after color development processing, to produce a chemically inert and substantially colorless compound or (ii) a compound represented by formula (VI) capable of chemically bonding with an oxidation product of an aromatic amine developing agent, which remains after color development processing, to produce a chemically inert and substantially colorless compound:

$$R_1''-(A)_n-X'' \quad \text{(IV)}$$

$$R_2''-\underset{\underset{B}{|}}{C}=Y \quad \text{(V)}$$

wherein $R_1''$ and $R_2''$ each represents an aliphatic group, an aromatic group or heterocyclic group; X'' represents a releasing group capable of being eliminated upon reaction with an aromatic amine developing agent; A represents a group capable of reacting with an aromatic amine developing agent to form a chemical bond; n represents 1 or 0; B represents a hydrogen atom, an aliphatic group, an aromatic group, a heterocyclic group, an acyl group or a sulfonyl group; and Y represents a group which accelerates addition of an aromatic amine developing group to a compound of formula (V); $R_1''$ and X'', or Y and $R_2''$, or Y and B may be bound to each other to form a cyclic structure; the compounds represented by Formulae (IV) and (V) are compounds which have a secondary rate constant of reaction with p-anisidine, $K_2$ (80° C.), of 1.0 liter/mol/sec to $1\times10^{-5}$ liter/mol/sec, $$J-Z \quad \text{(VI)}$$

wherein J represents an aliphatic group, aromatic group, or heterocyclic group; and Z represents a nucleophilic group or a group capable of being decomposed in a light-sensitive material to release a nucleophilic group, provided that Z is a group derived from a nucleophilic functional group having a Pearson's nucleophilic $nCH_3I$ value of 5 or more, and at least one compound (b) represented by the following Formulae (II) or (III):

$$X'\left(\underset{\underset{O}{\|}}{C}-R'\right)_m \quad \text{(II)}$$

-continued

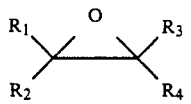

(III)

wherein X' represents a divalent to hexavalent polyvalent group; n and m each represents an integer of 2 to 6; R' represents an aliphatic group or an aromatic group, provided that R' existing in the same molecule may be the same or different from each other; $R_1$, $R_2$, $R_3$ and $R_4$, which may be the same or different, each represents a hydrogen atom, an aliphatic group, an aromatic group, an aliphatic oxycarbonyl group, an aromatic oxycarbonyl group or a carbamoyl group, provided that the sum of the carbon atoms contained in $R_1$, $R_2$, $R_3$ and $R_4$ is 8 or more, and at least one combination of $R_1$ and $R_2$, $R_3$ and $R_4$ or $R_1$ and $R_3$ may be bound to each other to form a 5- to 7-membered ring, said compound (a) and compound (b) being incorporated in the same layer or different layers.

2. A silver halide color photographic material as in claim 1, wherein Z in formula (VI) represents a nucleophilic group or a group capable of being decomposed in a light-sensitive material to release a nucleophilic group wherein the atom to be directly chemically bound to an oxidation product of an aromatic amine developing agent is an oxygen atom, a sulfur atom or a nitrogen atom.

3. A silver halide color photographic material as in claim 1, wherein compound (b) is a compound represented by formula (III).

4. A silver halide color photographic material as in claim 1, wherein the aliphatic group represented by $R''_1$, $R''_2$ and B is selected from the group consisting of a straight, brached and cyclic alkyl, alkenyl and alkynyl group, and a substituted group of them.

5. A silver halide color photographic material as in claim 1, wherein the aromatic group represented by $R''_1$, $R''_2$ and B is selected from the group consisting of a carbocyclic aromatic group and a heterocyclic aromatic group.

6. A silver halide color photographic material as in claim 1, wherein X'' is a group bound to A through an oxygen atom, a sulfur atom, a nitrogen atom, or a halogen atom.

7. A silver halide color photographic material as in claim 1, wherein A represents a divalent group selected from the group consisting of $$-O-\overset{O}{\overset{\|}{C}}-,\ -S-\overset{O}{\overset{\|}{C}}-,\ \text{and -alkylene-}\overset{O}{\overset{\|}{C}}-.$$

8. A silver halide color photographic material as in claim 1, wherein Y in formula (V) is selected from the group consisting of an oxygen atom, a sulfur atom, $=N-R_4''$, and

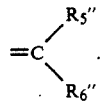

9. A silver halide color photographic material as in claim 1, wherein the compounds represented by formula (IV) and (V) may be used alone or in combination.

10. A silver halide color photographic material as in claim 1, wherein the compounds represented by formula (VI) may be used alone or in combination with compounds represented by formulae (IV) or (V).

11. A silver halide color photographic material as in claim 1, wherein the compound (a) is added to a light-sensitive material in the step of preparing said light-sensitive material.

12. A silver halide color photographic material as in claim 1, wherein the compound (a) are co-emulsified with couplers.

13. A silver halide color photographic material as in claim 1, wherein the amount of compound (a) to be used is $1\times10^{-2}$ to 10 mols, per mol of couplers.

14. A silver halide color photographic material as in claim 13, wherein the amount of compound to be used is $3\times10^{-2}$ to 5 mols, per mol of couplers.

15. A silver halide color photographic material as in claim 1, wherein X are derived from an aliphatic acid and X' are derived from an aliphatic alcohol.

16. A silver halide color photographic material as in claim 1, wherein the compounds represented by formulae (II) and (III) are added in amounts of 5 wt % to 600 wt % relative to the weight of couplers.

17. A silver halide color photographic material as in claim 16, wherein the compounds represented by formulae (II) and (III) are added in amounts of 10 wt % to 200 wt % relative to the weight of couplers.

18. A silver halide color photographic material as in claim 1, wherein the compound (a) or compound (b) is used in combination with known color-fading preventing agent.

19. A silver halide color photographic material as in claim 1, wherein a water-insoluble and organic solvent-soluble homo- or copolymer is incorporated in any hydrophilic colloidal layer of the photographic layer.

* * * * *